US011859490B2

(12) United States Patent
Haustveit et al.

(10) Patent No.: US 11,859,490 B2
(45) Date of Patent: Jan. 2, 2024

(54) SYSTEMS AND METHODS FOR MONITORING FRACTURING OPERATIONS USING MONITOR WELL FLOW

(71) Applicant: Devon Energy Corporation, Oklahoma City, OK (US)

(72) Inventors: Kyle L. Haustveit, Edmond, OK (US); Brett J. Green, Edmond, OK (US)

(73) Assignee: Devon Energy Corporation, Oklahoma City, OK (US)

( * ) Notice: Subject to any disclaimer, the term of this patent is extended or adjusted under 35 U.S.C. 154(b) by 47 days.

(21) Appl. No.: 17/406,938

(22) Filed: Aug. 19, 2021

(65) Prior Publication Data

US 2023/0058311 A1 Feb. 23, 2023

(51) Int. Cl.

| | |
|---|---|
| ***E21B 43/26*** | (2006.01) |
| ***E21B 34/08*** | (2006.01) |
| ***E21B 49/08*** | (2006.01) |

(52) U.S. Cl.

CPC ..... *E21B 49/087* (2013.01); *E21B 34/08* (2013.01); *E21B 43/26* (2013.01)

(58) Field of Classification Search

CPC .... E21B 49/087; E21B 49/0875; E21B 34/08; E21B 43/26; E21B 43/2605; E21B 43/2607; E21B 43/27

See application file for complete search history.

(56) References Cited

U.S. PATENT DOCUMENTS

| | | | | |
|---|---|---|---|---|
| 3,586,105 A | | 6/1971 | Johnson et al. | |
| 3,933,205 A | | 1/1976 | Kiel | |
| 4,718,490 A | | 1/1988 | Uhri | |
| 5,211,238 A | | 5/1993 | Carpenter | |
| 6,142,229 A | * | 11/2000 | Branson, Jr. | E21B 43/2405 166/250.15 |
| 6,439,310 B1 | | 8/2002 | Scott, III et al. | |
| 6,886,632 B2 | | 5/2005 | Raghuraman et al. | |

(Continued)

FOREIGN PATENT DOCUMENTS

WO WO 2013-008195 1/2013

OTHER PUBLICATIONS

Dawson et al., Breakthrough in Hydraulic Fracture & Proppant Mapping: Achieving Increased Precision with Lower Cost, Unconventional Resources Technology Conference, San Antonio, Texas, Aug. 1-3, 2016 (21 pages).

(Continued)

*Primary Examiner* — Catherine Loikith

(74) *Attorney, Agent, or Firm* — Polsinelli PC; Gregory P. Durbin

(57) ABSTRACT

An apparatus for use in fracturing wells includes a body defining and coupled to a wellhead of a well extending through a subsurface formation with the flow path being in communication with a wellbore of the well. The apparatus includes a flow meter in communication with the flow path and configured to measure a flow attribute of fluid from the wellbore along the flow path. The apparatus further includes a computing device communicatively coupled to the flow meter. The computing device is operable to receive a flow attribute measurement from the flow meter and to transmit an indicator in response to determining that the flow attribute measurement indicates interaction of a fracture in the subsurface formation with the well.

15 Claims, 26 Drawing Sheets

(56) References Cited

U.S. PATENT DOCUMENTS

| | | | | |
|---|---|---|---|---|
| 7,066,266 | B2 | 6/2006 | Wilkinson | |
| 8,204,727 | B2 | 6/2012 | Dean et al. | |
| 9,103,200 | B2 | 8/2015 | Baihly et al. | |
| 9,187,984 | B2 | 11/2015 | Usadi et al. | |
| 9,416,644 | B2 * | 8/2016 | McEwen-King | E21B 49/00 |
| 9,988,900 | B2 * | 6/2018 | Kampfer | E21B 43/26 |
| 11,028,679 | B1 | 6/2021 | Haustveit et al. | |
| 2005/0125209 | A1 | 6/2005 | Soliman et al. | |
| 2005/0189108 | A1 | 9/2005 | Davidson | |
| 2006/0027280 | A1 | 2/2006 | Heatley et al. | |
| 2007/0193737 | A1 | 8/2007 | Miller et al. | |
| 2010/0039893 | A1 | 2/2010 | Segal et al. | |
| 2011/0048719 | A1 | 3/2011 | Baihly et al. | |
| 2011/0120718 | A1 | 5/2011 | Craig | |
| 2012/0126992 | A1 | 5/2012 | Rodney et al. | |
| 2012/0318500 | A1 | 12/2012 | Urbancic et al. | |
| 2012/0325462 | A1 | 12/2012 | Roussel et al. | |
| 2013/0029866 | A1 | 1/2013 | Sun et al. | |
| 2013/0277050 | A1 | 10/2013 | Cherian et al. | |
| 2013/0298665 | A1 | 11/2013 | Minchau | |
| 2014/0018284 | A1 | 1/2014 | Coget et al. | |
| 2014/0251626 | A1 | 9/2014 | Gomaa et al. | |
| 2014/0334260 | A1 | 11/2014 | Chang et al. | |
| 2015/0016743 | A1 | 1/2015 | Knee | |
| 2015/0047832 | A1 | 2/2015 | Yuan | |
| 2015/0075778 | A1 | 3/2015 | Walters et al. | |
| 2015/0083398 | A1 | 3/2015 | Dawson | |
| 2015/0083405 | A1 | 3/2015 | Dobroskok et al. | |
| 2015/0176394 | A1 | 6/2015 | Roussel et al. | |
| 2015/0356403 | A1 | 12/2015 | Storm, Jr. | |
| 2016/0003020 | A1 | 1/2016 | Sharma | |
| 2016/0018654 | A1 | 1/2016 | Haddick et al. | |
| 2016/0061016 | A1 | 3/2016 | Ciezobka et al. | |
| 2016/0061026 | A1 | 3/2016 | Cherian et al. | |
| 2016/0177708 | A1 | 6/2016 | Stokely | |
| 2016/0237799 | A1 | 8/2016 | Dawson | |
| 2017/0002652 | A1 | 1/2017 | Kampfer et al. | |
| 2017/0342823 | A1 | 11/2017 | Shah et al. | |
| 2019/0346579 | A1 | 11/2019 | Roussel et al. | |

OTHER PUBLICATIONS

Kampfer et al., A Novel Approach to Mapping Hydraulic Fractures Using Poromechanic Principles, American Rock Mechanics Association, Prepared for the 50th US Rock Mechanics/Geomechanics Symposium held in Houston, Texas, Jun. 26-29, 2016 (15 pages).

NSI Technologies, Frac Tips: Can Rate Reductions Near the End of a Frac Treatment Induce Tip Screenout?, NSI Technologies Inc., Tulsa/Houston, vol. 2, No. 1, 2011 (2 pages).

* cited by examiner

400

402 404 406 408 44

| Stage | Trigger | Action | Test | If Successful | If Not Successful |
|---|---|---|---|---|---|
| … | … | … | … | … | … |
| 47 | +5 psi on first ramp | Rate cycle to 0 bpm for 3 minutes | Rate of pressure change decrease by >20% | Continue base schedule | After 5 min., repeat rate cycle and start linear gel |
| 48 | +20 psi on first ramp | Rate cycle to 0 bpm for 3 minutes | Rate of pressure change decrease by >20% | Continue base schedule | After 5 min., repeat rate cycle and start linear gel |
| … | … | … | … | … | … |

FIG. 4

SYSTEMS AND METHODS FOR MONITORING FRACTURING OPERATIONS USING MONITOR WELL FLOW

TECHNICAL FIELD

Aspects of the present disclosure involve completion of wellbores for production of hydrocarbons from subsurface formations and, more particularly, fracturing of subsurface formations through which such wellbores extend.

BACKGROUND

Hydraulic fracturing is a technique for improving yields (greater volume over a longer period of time) of oil and/or gas production from unconventional reservoirs, including shales, typically characterized by tight or ultra-tight subsurface formations where the oil or gas in the formation does not flow in commercially viable volumes through conventionally drilled wellbores. In many cases, fracturing is performed in a horizontal section of a wellbore where a vertical section extends from the surface to a target area (pay zone) of the formation, such as shale strata some distance from the surface, and the horizontal section of the wellbore extends from the vertical section and is drilled through the target area. For example, it may be known that shale may be found between 6000 and 7000 feet below the surface of an area, and in some specific formation. In such cases, a vertical section of a well may be drilled to 6500 feet below the surface and the horizontal section of the well may then be drilled outward for several thousand feet from the vertical section within the strata at approximately 6500 feet depth.

Once drilled, a well is generally completed by running and fixing casing within the wellbore (e.g., by cementing), perforating the casing where fracturing is targeted, and applying a well stimulation technique, such as hydraulic fracturing, to the surrounding formation. In open hole wells, the step of running and fixing casing within the well is omitted. Fracturing, generally speaking, involves pumping of fluid from the surface at high rate and pressure into the wellbore and into the formation surrounding the wellbore. The resource bearing formation surrounding the wellbore fractures under the pressure and volume of the injected fluid, increasing the size and quantity of pathways for hydrocarbons trapped within the formation to flow from the formation into the wellbore. The hydrocarbons may then be recovered at the surface of the well.

It is with these observations in mind, among others, that aspects of the present disclosure were conceived.

SUMMARY

The present disclosure is directed to systems and methods for monitoring fracturing operations. More specifically, the systems and methods disclosed include a fracture monitoring system for identifying interactions between a monitor well (or a monitoring portion of well) and a fracture propagating from a target well. The fracture monitoring system includes a pressure control valve that regulates pressure within the monitor well and a flow meter that measures attributes of flow through the pressure control valve when the pressure control valve is open to regulate pressure within the monitor well. Based on the flow attribute measurements, the fracture monitoring system distinguishes between thermally induced flow (e.g., due to thermal expansion of fluid within the monitor well) and fracture-induced flow. When the fracture monitoring system detects fracture-induced flow, the fracture monitoring system may generate and transmit an indicator/signal that may in turn be used to automatically modify fracturing operations or alert personnel of a likely interaction between the monitor well and a propagating fracture.

In one aspect of the present disclosure, an apparatus for monitoring fracturing operations is provided. The apparatus includes a body defining a flow path. The body is generally coupleable to a wellhead of a well extending through a subsurface formation such that the flow path is in communication with a wellbore of the well. The apparatus further includes a flow meter in communication with the flow path. The flow meter is configured to measure a flow attribute of fluid from the wellbore along the flow path. The apparatus also includes a computing device communicatively coupled to the flow meter. The computing device is operable to receive a flow attribute measurement from the flow meter and to transmit an indicator in response to determining that the flow attribute measurement indicates interaction of a fracture in the subsurface formation with the well.

In another aspect of the present disclosure, a method of monitoring fracturing operations is provided. The method includes obtaining a measurement of a flow attribute for fluid exiting a monitor wellbore of a monitor well. The monitor well is in a subsurface formation, and the measurement of the flow attribute is measured during a fracturing operation conducted on a target well in the subsurface formation. The method further includes transmitting an indicator in response to the flow attribute indicating an interaction of a fracture extending from the target well with the monitor well.

In yet another aspect of the present disclosure, a method of fracturing multiple wells is provided. The method includes obtaining a first flow attribute measurement for a first flow attribute. The first flow attribute measurement corresponds to fluid exiting a first well, the first well is in a subsurface formation, and the first flow attribute is measured during a first fracturing operation conducted on a second well in the subsurface formation. The method further includes modifying each of the first fracturing operation and a second fracturing operation conducted on the first well in response to the first flow attribute measurement indicating interaction of a first fracture extending from the second well with the first well.

BRIEF DESCRIPTION OF THE DRAWINGS

The foregoing and other objects, features, and advantages of the present disclosure set forth herein will be apparent from the following description of embodiments of those inventive concepts, as illustrated in the accompanying drawings. It should be noted that the drawings are not necessarily to scale; however the emphasis instead is being placed on illustrating the principles of the inventive concepts. Also, in the drawings the like reference characters may refer to the same parts or similar throughout the different views. It is intended that the embodiments and figures disclosed herein are to be considered illustrative rather than limiting.

FIG. 4 is a table illustrating example stages of a well completion.

DETAILED DESCRIPTION

Figure 1:
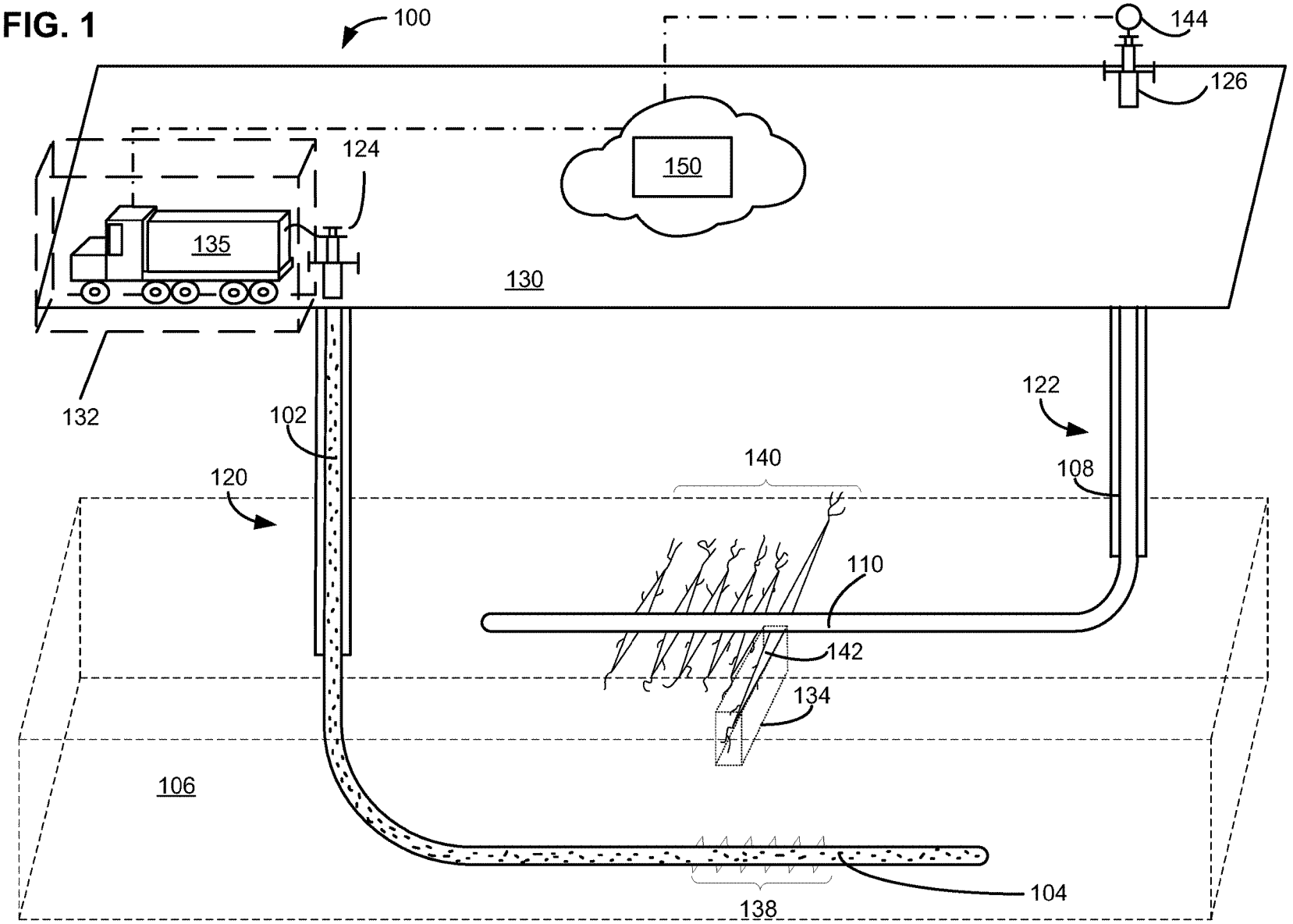
FIG. 1 is a schematic diagram of an example well completion environment for completing a fracturing operation in accordance with the present disclosure.

Aspects of the presently disclosed technology involve controlling one or more aspects of a fracturing operation, alone or in combination. In certain implementations, the presently disclosed technology involves rate cycling of fracturing fluid injected into a wellbore during the fracturing operation based on measurements made at a monitor well. Rate cycling is a technique in which the rate at which fracturing fluid is pumped into a well is varied throughout the fracturing operation. The cycles are controlled based on feedback from the monitor well. Generally, the flow rate may be cycled between a relatively higher flow rate to promote development and propagation of fractures within the formation and a relatively lower flow rate to release stresses induced in the formation during the high flow rate period, although many other cycles and bases for such cycles are possible.

It is understood that rate cycling of fracturing fluid during a fracturing operation may provide several benefits, alone or in combination. First, rate cycling may inhibit focused growth of only a limited number of dominant fractures in an area of the wellbore being completed. Stated differently, controlled rate cycling may distribute the fracturing fluid across many fractures and grow such fractures rather than focusing the fluid to relatively fewer numbers of dominant fractures in any given stage being fractured. Second, rate cycling may initiate new fractures within the stage being completed. Thus, in a simplified example, rather than growing the dominant fracture group, several new fractures may be successively initiated and grown after a rate cycle or rate cycles. Third, rate cycling may be controlled and used to arrest breakthrough of fractures from a wellbore being completed into an adjacent wellbore. Fourth, rate cycling may facilitate fracturing operations without the need for diverters in the fracturing fluid. In effect, it is believed that rate cycling has the effect of diverting an increased proportion of fracturing fluid from dominant fractures undergoing significant propagation prior to the rate cycle into new, or smaller fractures, after the rate cycle. Fifth, rate cycling may facilitate greater production volume and greater production longevity of a fractured wellbore and possibly reduce initial completion costs. For example, it is believed that a greater number of fractures may be initiated resulting in greater production from the wellbore at less relative cost than the same wellbore fractured without the controlled rate cycling techniques described herein. Moreover, the same wellbore may be completed without particulate diverters thus providing additional cost advantages and/or production advantages relative to conventional techniques using particulate diverters.

Propagation and distribution of fractures may also be controlled by varying other parameters of a fracturing operation. Such parameters may include, without limitation, fracturing fluid viscosity, proppant size, proppant concentration, fracturing fluid additive ratios, and fracturing fluid injection rate. To further promote or inhibit fracture growth and distribution, one or more of such parameters may be modified during the course of a fracturing operation in response to measurements obtained from a monitor well and. For example, if increased fracture height is desired, fracturing fluid viscosity may be increased. Conversely, if further fracture height is to be inhibited, viscosity may be reduced. As another example, if increased lateral propagation of fractures is desired, viscosity may be decreased. Conversely, if lateral propagation is to be inhibited, viscosity may be increased.

The success of a fracturing operation generally depends on adequate distribution and propagation of fractures within the area of the formation around a wellbore being fractured. However, due to the remoteness of the fractures being formed it is often difficult or cost-prohibitive to accurately determine how a given fracturing operation is progressing.

To control fracturing operations (e.g., by modifying fracturing operation parameters such as injection rate, viscosity, proppant size, proppant concentration, etc.) during fracturing of a wellbore being completed (referred to herein as an active well), systems and methods according to certain implementations of the present disclosure monitor pressure in an adjacent well, referred to herein as a monitor well. A portion of the monitor well is poroelastically coupleable to the active well such that a pressure response is produced in the monitor well during fracturing of the active well. For example, the monitor well may include a section spaced within 1,000 to 2,000 feet from the stage of the active well being completed and include at least one fracture, referred to herein as a monitor or transducer fracture, that extends from the monitor well toward the stage of the active well undergoing completion. Stated simply, as fluid is pumped into the active well and fractures are formed and/or propagate through the formation, the transducer fracture is compressed, thereby increasing pressure within the monitor well. More specifically, according to the principles of poroelasticity, fractures propagating from the active wellbore during fracturing induce pressure changes in the monitor well when the fractures from the active well overlap the transducer fracture of the monitor well. When this occurs, pressure in the monitor well increases relative to some baseline pressure or rate of pressure change, such as a leak off rate. Such pressure changes may be observed, for example, as an increase in pressure relative to a baseline pressure of the monitor well or a decrease in the leak off rate of the monitor well as compared to a baseline leak off rate of the monitor well obtained prior to initiating the fracturing operation in the active well.

In certain implementations, characteristics of one or more of the monitor well, the active well, and the transducer fracture are used, at least in part, to characterize the pressure response of the monitor well as well as use the information to further define completion operations. For example, the geometry of the monitor well and/or the transducer fracture may be used in analyzing the pressure response caused by injecting fracturing fluid into the active well. A calibration operation may also be performed to determine characteristics of one or more of the active well, the monitor well, and the subsurface formation between the active well and the monitor well. For example, in one embodiment, a fracture formation rate of the subsurface formation may be determined. To do so, a single entry point may be made in the active well and fracturing fluid may be pumped into the active well at a known rate. When a corresponding pressure response in the monitor well is observed, the single fracture has extended from the active well to overlap the monitor well and/or a fracture of the monitor well. Accordingly, by knowing the distance between the active well and the monitor well/monitor well fracture and the rate at which fracturing fluid was provided to the active well, an approximate relationship between flow rate of fracturing fluid and fracture growth can be determined. For example, if 100 barrels of fracturing fluid cause a pressure response in a monitor well 1000 feet away from the active well, every barrel of fracturing fluid creates approximately 10 feet of fracture half-length.

Changes in the pressure within the monitor well can then be used to approximate, without limitation, the location, size, direction, and similar characteristics of fractures associated with the active well and to dynamically control or inform the fracturing operation. For example, the fracturing operation may be controlled in response to changes in pressure observed within the monitor well by, without limitation, one or more of changing the flow rate of fracturing fluid provided to the active well, changing the duration for which a particular flow rate is maintained, changing the pressure of fracturing fluid provided to the active well, changing the concentration of proppants and/or density of the fracturing fluid, and controlling whether to continue or cease fracturing operations in whole or in part. Such controls may be done alone or in various possible combinations. Accordingly, pressure within the monitor well may be used to dynamically adjust parameters of the fracturing operation in response to characteristics of the subsurface formation through which the fractures extend, characteristics of the fractures, characteristics of initial perforations in the wellbore, and other sources of variability in the fracturing operation.

In certain implementations, control of fracturing operations may be achieved, at least in part, by a computing system adapted to receive and process data collected from the monitor well. The computing system may be communicatively coupled to equipment for performing a fracturing operation such that the computing system may modify one or more operational parameters of the equipment in response to the received data. The logic and outputs governing control by the computing system may be maintained in a fracturing operation plan executable by the computing system. Control of the equipment may also be accomplished, in whole or in part, through manual intervention by an operator. For example, the computing system may receive data and generate an updated fracturing operation plan that may then be manually executed by an operator who activates, deactivates, or otherwise modifies operational parameters of equipment for performing the fracturing operation.

The monitor well is generally capped under pressure and pressure within the monitor well is measured using, for example, gauges, or transducers located at the well head. Alternatively, downhole transducers may be installed within the monitor well and communicatively coupled to communication devices disposed at the well head. In certain implementations, a baseline leak off rate of the monitor well is obtained prior to fracturing of the active well. The gradual decrease in pressure within the monitor well over time, caused by fluid and pressure loss into the surrounding formation, is known as the leak off rate. The leak off rate is generally a function of the porosity, permeability, and pore pressure of the formation surrounding the monitor well and the baseline leak off rate corresponds to the leak off rate of the monitor well when the active well is not being fractured and often will be done prior to initiation of fracturing of the active well. During completion of the active well, the leak off rate in the monitor well is compared to the baseline leak off rate and/or one or more other observed leak off rates, with the differences being the leak off rates being used to determine when and to what extent to control the fracturing operation. While much of the discussion herein references a comparison to a leak off rate, it is also possible to compare pressure in the monitor well to a discrete pressure value, a discrete flow value or some other discrete attribute of the monitor well indicative of an induced poroelastic effect between fractures forming from the active well and the monitor well.

Initial pressurization of the monitor well can be achieved in various ways. For example, the monitor well may be maintained under pressure following completion/fracturing of the monitor well. Alternatively, the monitor well may be pressurized by injecting fluid, such as water, into the monitor well. Notably, this latter approach facilitates the repurposing of dead or otherwise unused wells as monitor wells. In still other implementations, the monitor well may be a producing well. In implementations in which the monitor well is a producing well, additional steps may be taken to facilitate use of the monitor well including, without limitation, one or more of adding water or other fluids to the monitor well, installing downhole gauges, and estimating hydrostatic pressure within the well based on the fluid being produced in the monitor well.

The foregoing discussion primarily described implementations of the present disclosure in which pressure changes within a monitor well result from poroelastic coupling with an active well that is being fractured and modifying fracturing operations based on such observations. In other implementations of the present disclosure, fracturing operations may be controlled, at least in part, in response to pressure changes induced in the monitor well due to direct fluid communication between the active well and the monitor well. Such direct fluid communication may occur as a result of a fracture fully extending between the active well and the monitor well, thereby enabling fracturing fluid to enter the monitor well. In such circumstances, the pressure response caused by the direct fluid communication may similarly be used to modify or otherwise control fracturing operations.

In still other implementations, control of fracturing operations is achieved without the use of a separate monitor well. Instead of using a monitor well, a portion of the active well is isolated and equipped with a pressure gauge or similar device for measuring pressure within the isolated section. Similar to the previously discussed monitor well, the isolated section may also include a transducer fracture extending into the surrounding subsurface formation. When an uphole section of the well is subsequently fractured, a pressure response may be observed within the isolated section due to poroelastic coupling between the fractures extending from the uphole section and the transducer fracture extending from the isolated section. This pressure response may subsequently be used to control modify or otherwise control fracturing operations.

FIG. 1 is a schematic diagram of an example well completion environment 100 for completing a fracturing operation in accordance with the present disclosure. The well completion environment 100 includes a subsurface formation 106 through which an active well 120 and a monitor well 122 extend. The active well 120 includes a vertical active well section 102 and a horizontal active well section 104. Similarly, the monitor well 122 is also a horizontal well and includes a vertical monitor well section 108 and a horizontal monitor well section 110.

The monitor well 122 includes at least one transducer fracture 142 extending toward the active well 120 with the area from the tip of the transducer fracture 142 rearward toward the monitor well defining a poroelastic region 134. The poroelastic region 134 corresponds to a portion of the subsurface formation 106 where the active well 120 is poroelastically coupleable with the monitor well 122. Poroelastic coupling, as used herein, refers to a physical phenomenon in which two regions within or adjacent to a porous material are arranged such that when a force or pressure is applied to one region, the force or pressure is transmitted, at least in part, to the second region as a result of the poroelastic properties of the material. Accordingly, the poroelastic region 134 corresponds to a region within the subsurface formation 106 and adjacent a fracture of the monitor well 122 in which the active well 120 and the monitor well 122 may be poroelastically coupled to each other. As described below in more detail, such poroelastic coupling occurs when a fracture formed adjacent the active well 120 propagates and overlaps a fracture of the monitor well 122, referred to herein as a transducer fracture 142, enabling observations of pressure or other response within the monitor well 122 during fracturing of the active well 120. Hence, the monitor well 122 includes at least one transducer fracture 142 extending toward the active well 120 such that a region from the tip of the transducer fracture 142 rearward toward the monitor well 122 defines the poroelastic region 134.

The active well 120 includes an active wellhead 124 disposed at a surface 130. Similarly, the monitor well 122 includes a monitor wellhead 126 at the surface 130. The monitor wellhead 126 further includes a pressure gauge 144 for measuring pressure within the monitor well 122. In certain implementations, instead of or in addition to pressure gauge 144, the monitor wellhead 126 includes a pressure transducer configured to transmit pressure data from the monitor wellhead 126 to a computing system 150. In the well completion environment 100, the computing system 150 is communicatively coupled to a pumping system 132 (illustrated in FIG. 1 as including a pump truck 135) such that the computing system 150 can transmit pressure data, control signals, and other data to the pumping system 132 to dynamically adjust parameters of the fracturing operation based on pressure measurements received from the monitor wellhead 126. The pumping system 132 generally provides fracturing fluid into the active well 120 and, in certain implementations, may include additional equipment for modifying characteristics of the fracturing fluid and/or the manner in which the fracturing fluid is injected into the active well 120. Such equipment may be used, for example, to add or change a proppant or other additive of the fracturing fluid in order to modify, among other things, the viscosity, proppant concentration, proppant size, or other aspects of the fracturing fluid. Accordingly, such equipment may include, without limitation, one or more of tanks, pumps, filters, and associated control systems. The computing system 150 may include one or more local or remote computing devices configured to receive and analyze the pressure data to facilitate control of the fracturing operation.

The computing system 150 may be a single computing device communicatively coupled to components of the well completion environment 100, or forming a part of the well completion environment 100, or may include multiple, separate computing devices networked or otherwise coupled together. In the latter case, the computing system 150 may be distributed such that some computing devices are located locally at the well site while others are maintained remotely. In certain implementations, for example, the computing system 150 is located locally at the well site in a control room, server module, or similar structure. In other implementations, the computing system is a remote server that is located off-site and that may be further configured to control fracturing operations for multiple well sites. In still other implementations, the computing system 150, in whole or in part, is integrated into other components of the well completion environment 100. For example, the computing system 150 may be integrated into one or more of the pumping system 132, the active wellhead 124, and the monitor wellhead 126. Pressure gauge 144 is configured to measure pressure within the monitor well 126 during fracturing of the active well 120. As shown in the well completion environment 100, pressure gauge 144 is coupled to the monitor wellhead 126.

Pressure gauge 144 is communicatively coupled to the computing system 150, such as by a pressure transmitter. In alternative implementations, pressure gauge 144 may be replaced or supplemented with other pressure measurement devices. For example, in certain implementations, pressure may be measured using, without limitation, one or more digital and/or analog pressure gauges coupled to the monitor wellhead 126, downhole pressure transmitters disposed within the monitor well 124, and pressure sensors incorporated into one or more flow meters (such as differential pressure flow meters). The pressure measurement device may be permanently fixed into casing, coiled tubing, or other structure disposed within the active well 120 or may be temporarily inserted into the active well 120 using, for example, a wireline or other conveyance. In still other implementations, other measuring devices may be used to indirectly determine pressure within the monitor well 120, such as by measuring a temperature within the monitor well 120 that is then used to determine pressure within the monitor well 120.

Well completion environment 100 is depicted after perforation but before fracturing of the active well 120. Accordingly, horizontal active well section 104 includes a plurality of perforations 138 extending into subsurface formation 106 and, more specifically, towards the poroelastic region 134. The entire formation surrounding the wellbores may demonstrate poroelasticity. The term poroelastic region is meant to refer to the area, typically between the wellbores, where a propagating fracture from the active wellbore may overlap a fracture (e.g., the transducer fracture 142) extending from the monitor well 122 and produce a poroelastic response in the monitor well 122. The perforations 138 are formed during completion of the active well 120 to facilitate introduction of fracturing fluid into the subsurface formation 106 adjacent the horizontal active well section 104. For example, in certain completion methods, casing is installed within the well and a perforating gun is positioned within the active well 120 adjacent the portion of the subsurface formation 106 to be fractured. The perforating gun includes shaped charges that, when detonated, create perforations that extend through the casing and into the adjacent formation, thereby creating an initial fluid path from the subsurface formation 106 into the active well 120. During fracturing, fracturing fluid is pumped into the active well 120 and the fluid passes through the perforations 138 under high pressures and rate. As pressure increases, the fracturing fluid injection rate increases through the perforations 138, forming fractures that propagate through the subsurface formation 106, thereby increasing the size and quantity of fluid paths between the subsurface formation 106 and the active well 120. In contrast to the active well 120, the monitor well 122 is previously completed and includes one or more fractures 140. It is also possible that the monitor well 122 intersects one or more preexisting fractures, which may serve as transducer fractures. Hence, the monitor well 122 includes at least one transducer fracture 142 extending toward the active well 120 with the area from the tip of the transducer fracture 142 rearward toward the monitor well being the poroelastic region 134.

Alternative fracturing methods may also be used in conjunction with the systems and methods disclosed herein. For example, in certain implementations, the fracturing operation is an open-hole fracturing operation. In contrast to methods in which a casing is installed and then perforated prior to fracturing, open-hole fracturing is performed on an unlined section of the wellbore. Generally, open-hole fracturing involves isolating sections of the uncased wellbore using packers or similar sealing elements. Sliding sleeves or similar valve mechanisms disposed between the packers are then opened to permit pumping of the fracturing fluid into the surrounding formation. As pressure within the formation increases, fractures are formed and propagated. In multistage wells, this process is repeated for each stage moving up the wellbore.

The active wellhead 124 is coupled to a pumping system 132 for pumping fracturing fluid into the active well 120. In the well completion environment 100, for example, the pumping system 132 includes a pump truck 135 coupled to the active wellhead 124. The pump truck 135 includes a tank or other means for storing the fracturing fluid and a pump coupleable to the active wellhead 124 for pumping fluid into the active well 120. In other embodiments, the pumping system 132 includes other equipment for providing fracturing fluid to the active well 120 including, without limitation, storage tanks or other vessels and one or more additional pumps. The pumping system 132 may further include equipment configured to modify the fracturing fluid, for example, by adding one or more additives, such as proppants, to the fracturing fluid. The pumping system 132 may also include equipment, such as filters, to treat and recycle fracturing fluid. As shown in the implementation of FIG. 1, the pumping system 132, and more particularly pump truck 135, is communicatively coupled to the computing system 150. Accordingly, the pump truck 135 can receive sensor data, control signals, or other data from the computing system 150, including data configured to be used in control and monitoring of an ongoing fracturing operation.

During fracturing, fracturing fluid is pumped by the pumping system 132 into the active well 120. The fracturing fluid enters the subsurface formation 106 through the perforations 138. As the fracturing fluid continues to enter the subsurface formation 106, pressure within a portion of the subsurface formation 106 adjacent the perforations 138 increases, leading to the formation and propagation of fractures within the subsurface formation 106. As the fractures from the active well 120 propagate into the poroelastic region 134, the active well 120 and the monitor well 122 become poroelastically coupled. More specifically, one or more dominant fractures (such as the dominant fracture 212 illustrated in FIG. 2A) from active well 120 extend into the poroelastic region 134 and overlaps the transducer fracture 142 of the monitor well 122. As a result, the active well 120 and the monitor well 122 become poroelastically coupled such that forces or pressures applied to the subsurface formation 106 by injection of the fracturing fluid into the active well 120 are transmitted through the poroelastic region 134 and applied to the transducer fracture 142 of the monitor well 122. The transmitted forces or pressures create a pressure response in the monitor well 122 that may be measured using pressure gauge 144 or other pressure measurement device and used to dynamically adjust the fracturing operation. For example, in one embodiment, measurements from pressure gauge 144 are used to determine when to initiate a rate cycle (or change to one or more other fracturing operation parameters) during the fracturing operation.

In alternative implementations of the present disclosure, one or both of the active well 120 and the monitor well 122 are vertical wells. Moreover, implementations of the present disclosure may include more than one active well and/or more than one monitor well. For example, multiple monitor wells may be used to monitor fracturing of one active well.

In addition to or instead of poroelastic coupling of the active well 120 and the monitor well 122, the active well 120 and the monitor well 122 may be directly coupled such that they are in direct fluid communication with each other. For example, during the fracturing operation, a fracture extending form the active well 120 may intersect one or more of the transducer fracture 142, a different fracture of the monitor well 122, and the monitor well 122 itself. In such instances, pumping of fracturing fluid into the active well 120 will induce a pressure response in the monitor well 122 that may be used to actively control the corresponding fracturing operation. Notably, the active well 120 and the monitor well 122 may be both poroelastically coupled and in direct fluid communication with each other such that the pressure response observed in the monitor well 122 is a result of both poroelastic coupling and direct coupling. Additionally, depending on the porosity of the formation and other factors, pumping fluid into the active well 120 may generate some pressure response in the monitor well 122 without poroelastic coupling or direct fluid communication. For example, after pumping of fracturing fluid for a particular stage has been completed, the recently injected fracturing fluid may leak off into the monitor well 122 creating a pressure response within the monitor well 122 independent of poroelastic coupling.

As noted above, well completion environment 100 includes one active well 120 and one monitor well 122. In alternative implementations, well completion environments in accordance with this disclosure may include more than one of either active wells or monitor wells. For example, in certain implementations, multiple monitor wells may monitor fracture growth in one or more active wells. Because each monitor well has a different location and orientation, each monitor well would therefore identify fracture growth in different directions. Similarly, one monitor well may be used to monitor fracture growth in multiple active wells. For example, one active well may be positioned between two or more active wells such that the monitor well is poroelastically coupleable and provides a pressure response when fracturing any of the active wells.

Figure 2A:
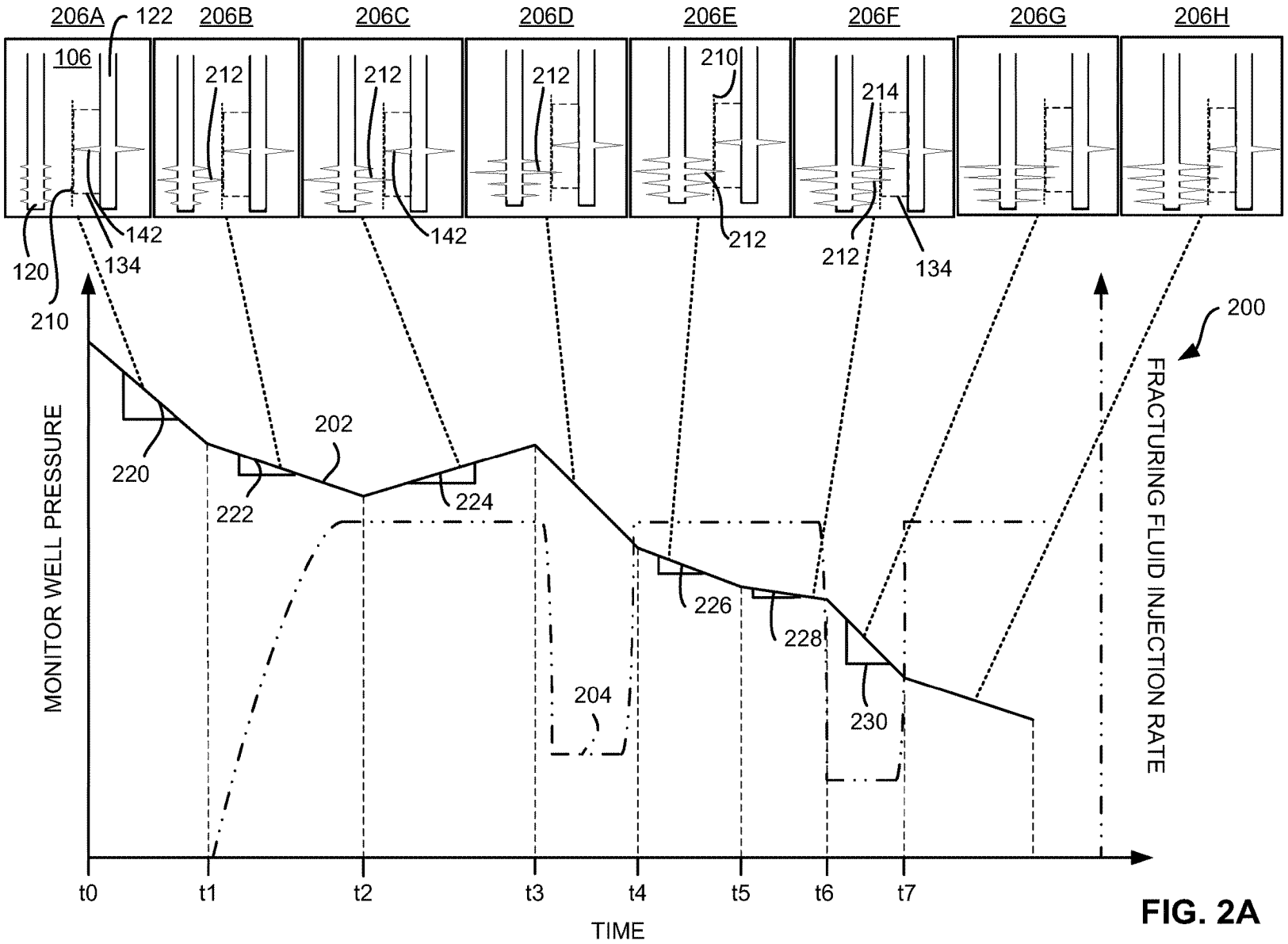
FIG. 2A is an example graph illustrating monitor well pressure and fracturing fluid flow rate over time during a fracturing operation.

FIG. 2A is an example graph 200 illustrating monitor well pressure and fracturing fluid flow rate over time during a fracturing operation according to the present disclosure. For explanatory purposes, the following description of FIG. 2A references components of the well completion environment 100 of FIG. 1. Accordingly, the graph 200 includes a pressure line 202 (shown as a solid line) corresponding to pressure readings obtained from a pressure gauge 144 or transducer configured to measure pressure within the active well 122 and a flow rate line 204 (shown as a periodic dashed line) corresponding to the flow rate of fracturing fluid provided by a pumping system 132 into the active well 120 during the fracturing operation. FIG. 2A further includes a set of schematic illustrations 206A-H. The illustrations 206A-H depict, during various stages of the fracturing operation, each of the horizontal active well section 104, the horizontal monitor well section 110, the poroelastic region 134 disposed between the active well 120 and the monitor well and a plane 210 (to not unnecessarily obscure the illustrations not every feature is labeled in each illustration). The plane 210 corresponds to the point in the poroelastic region 134 beyond which the active well 120 and the monitor well 122 become poroelastically coupled. Accordingly, as a fracture from the active well 120 propagates beyond the plane 210, a pressure response becomes observable within the monitor well 122 due to poroelastic coupling. For purposes of simplicity, only the transducer fracture 142 of the monitor well 122 is depicted in illustrations 206A-H.

The fracturing operation depicted in the graph 200 of FIG. 2A generally illustrates an implementation of systems and methods described herein for controlling rate cycling of a fracturing operation. More specifically, the fracturing operation controls rate cycling of a fracturing operation in the active well 120 based on pressure changes (and/or lack of pressure changes) observed in the monitor well 122, where the changes in the rate of pressure change are due to poroelastic coupling of the active well 120 and the monitor well 122. As previously discussed, rate cycling generally involves pumping fracturing fluid into a subsurface formation at other than a steady flow rate. Accordingly, the pressure changes observed in the monitor well 122 are used to trigger various changes in the flow rate of fracturing fluid pumped into the active well 120. In other implementations, changes in pressure within the monitor well 122 can be used to control other parameters of the fracturing operation alone or in combination with parameters relating to rate cycling. For example, and without limitation, changes in pressure within the monitor well 122 can be used to control one or more fracturing operation parameters including, without limitation, the pressure at which fracturing fluid is pumped into the active well 122, the concentration of proppants or additives within the fracturing fluid, the density of the fracturing fluid, and the type of fracturing fluid used. In many cases, such changes may further be coordinated with rate cycling but may not occur at the same times as rate is changed. For example, one or more of the fluid pressure, proppant/additive concentration, fluid density, and type of fracturing fluid may be changed as the fluid flow rate is increased or decreased at the beginning or end of a rate cycle or at any time after the target rate for the rate cycle is achieved.

Referring now in more detail to FIG. 2A, during time interval t0 to t1, a baseline leak off rate for monitor well 122 is obtained. The baseline leak off rate is the rate at which pressure within monitor well 122 declines absent influence from the active well 120. More particularly, the baseline leak off rate is the rate at which pressure reduces within monitor well 122 absent pressure effects attributable to pumping fracturing fluid into the active well 120 due to poroelastic coupling of the active well 120 and the monitor well 122. The baseline rate is indicated in the graph 200 by a baseline slope 220.

After a baseline leak off rate is established, fracturing fluid is pumped into the active well 122. More specifically, during interval t1 to t2, the pumping system 132 is activated and the flow rate of fracturing fluid into the active well 120 is increased until a first flow rate is reached at time t2. As illustrated in the transition between schematic illustration 206A and 206B, the introduction of fracturing fluid into active well 120 induces propagation of fractures originating from the active well 120, including the formation of a first dominant fracture 212. As fluid is pumped into the active well 120 at an increasing flow rate, the first dominant fracture 212 begins to enter the poroelastic region 134 by crossing the plane 210 indicating when poroelastic coupling occurs. During this ramp up period, a pressure increase is observed within the monitor well 122 because of the poroelastic coupling between the first dominant fracture 212 and the transducer fracture 142. This pressure increase is illustrated in the graph 200 as a reduction in slope of the pressure line between times t1 and t2. The rate of pressure change during time interval t1 to t2, illustrated by a first slope 222, is reduced as compared to the baseline slope 220 observed during time interval t0 to t1. Notably, the first slope 222 is still negative, indicating that pressure within the monitor well 122 is still declining despite the pressure effects caused by the fracturing fluid. However, the rate at which the pressure is declining during time interval t1 to t2 is less than that observed during time t0 to t1.

At time t2 (and as shown in illustration 206C) the first flow rate is reached and the first dominant fracture 212 continues to propagate and further overlap the transducer fracture 142. As indicated in time interval t2 to t3, achieving the first flow rate and the corresponding progression of the first dominant fracture 212 into the poroelastic region 134 results in an even greater increase of pressure within monitor well 122 as compared to the pressure increase observed during time interval t1 to t2. In the example provided, the pressure increase experienced during time interval t2 to t3 is significant enough to cause the pressure within monitor well 122 to increase between time t2 and t3 as indicated by a second, positive slope 224.

At time t3, a rate cycle is initiated by reducing the fracturing fluid flow rate provided by the pumping system 132. The reduction in fracturing fluid flow rate induces a relaxation of the poroelastic region 134 and a corresponding reduction in pressure within the monitor well 122. Accordingly, the leak off rate (i.e., the change in pressure of the monitor well 122 over time) during time interval t3 to t4 substantially returns to the baseline leak off rate measured during time interval t0 to t1. As shown in illustration 206D, relaxation of the poroelastic region 134 may further result in closure, in whole or in part, of fractures within the subsurface formation 106, including the first dominant fracture 212.

Figure 2B:
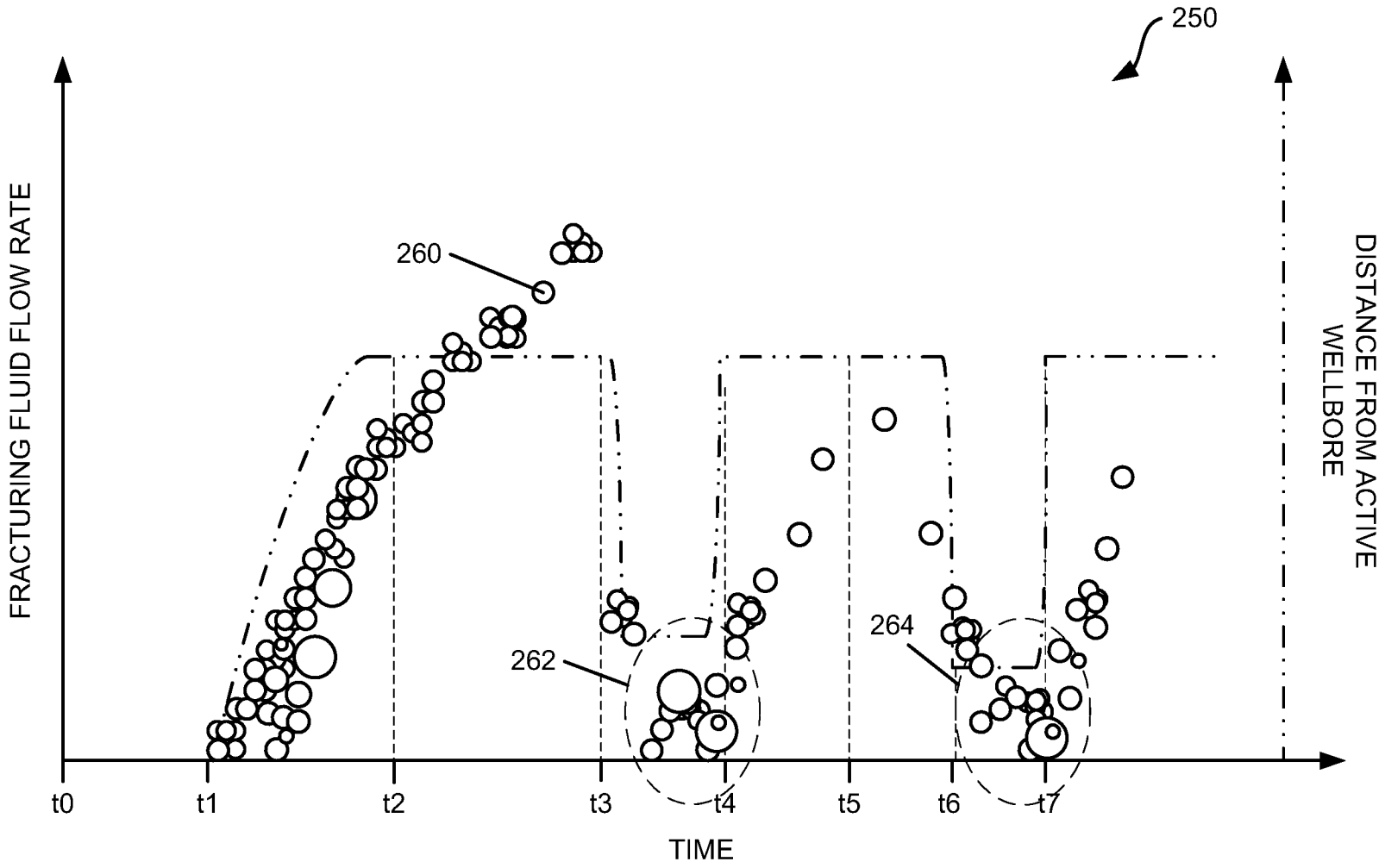
FIG. 2B is a second example graph illustrating microseismic data corresponding to the fracturing operation illustrated by the graph of FIG. 2A.

FIG. 2B is a second graph 250 illustrating additional data corresponding to the fracturing operation illustrated by graph 200 of FIG. 2A and, more specifically, additional data corresponding to the occurrence of microseismic events within the active well 120 during the fracturing operation of FIG. 2A. The data illustrated in the second graph 250 generally corresponds to experimental results observed during fracturing operations similar to that depicted in FIG. 2A. Microseismic events are represented in the second graph 250 as circular indicators, such as indicator 260, with the relative magnitude of the microseismic event indicated by the relative size of each indicator. As illustrated in the second graph 250, initial fracturing of the active well 120 occurs between time interval t1 to t3 and results in microseismic events displaced progressively farther into the subsurface formation from the active wellbore. When the flow of fracturing fluid is reduced at time t3, microseismic events occur nearer the active wellbore, as indicated by a first cluster 262. The microseismic events are generally the result one or more of closure of fractures formed during the prior high flow rate cycle and the formation of new fractures and/or propagation of existing fractures closer to the active wellbore. As described in more detail below, a second rate cycling occurs at time interval t7. The second rate cycling results in a second cluster 264 of microseismic events near the wellbore. Similar to the first cluster 262, the second cluster 264 generally corresponds to closure of fractures formed in the previous high flow rate period (i.e., time interval t4 to t5), or formation of new fractures or propagation of existing fractures near the wellbore. The closure of fractures or slowing of growth during a rate cycle aids in the treatment of smaller, non-dominant fractures by diverting the fracturing fluid away from the dominant fracture. More specifically, the energy required to reinitiate the slowed or closed fracture may exceed that required to begin propagating one of the other smaller, non-dominant fractures. The opening of fractures near the wellbore results in higher fracture intensity and/or complexity near the wellbore and, as a result, greater production from the well.

At time t4, a second fracturing cycle is initiated by increasing the fracturing fluid flow rate to that used during time interval t2 to t3. Similar to time interval t2 to t3, the increased flow rate of fluid into the active well 120 induces a pressure increase within the monitor well 122, as indicated by a third slope 226 which is less negative than the baseline slope 220. Notably, the third slope 226 is also more negative than the second slope 224 observed during time interval t2 to t3 (i.e., during formation and propagation of the first dominant fracture 212). Based on the difference between the second slope 224 and the third slope 226 and the fact that the fracturing fluid flow rate is substantially identical during the two time intervals, it can be inferred that the first dominant fracture 212 receives a lesser proportion of the fracturing fluid being pumped into the active well 120. In other words, a higher proportion of the fracturing fluid is being diverted to secondary fractures, promoting propagation of the secondary fractures.

As noted above, allowing fractures within the subsurface formation to partially or completely close promotes fracturing fluid flow into secondary fractures nearer the wellbore. In certain implementations, the increased diversion of fracturing fluid to secondary fractures observed during time interval t4 to t5 is achieved without the use of known chemical or mechanical diversion techniques, thereby resulting in improved efficiency of the well completion process. In chemical diversion, for example, a first fluid is pumped into the wellbore that solidifies and seals certain fractures in order to divert fracturing fluid to other, unsealed fractures or portions of the wellbore. Following fracturing, a second fluid is pumped into the well to dissolve the first fluid. Similarly, in mechanical diversion, a mechanical device, such as a ball or packer assemblies, is used to temporarily plug a first portion of the wellbore to divert fracturing fluid to a second portion of the wellbore. Subsequently, the mechanical device must be either dissolved or drilled out to reestablish fluid communication with the first portion of the wellbore. Each of these traditional diversion methods requires additional fluid pumping cycles and/or tool runs, resulting in increased completion time and costs.

As the secondary fractures propagate, one of the secondary fractures may overtake the first dominant fracture 212. As shown in illustration 206F and indicated by time interval t5 to t6, a second dominant fracture 214 has propagated into the poroelastic region 134 and overtaken the first dominant fracture 212. Overtaking by one of the secondary fractures may be observed as a variation in the rate of pressure change within the monitor well 122. In the graph 200, the fourth slope 228 corresponds to a rate of pressure change when the first dominant fracture 212 is dominant. Accordingly, if a rate of pressure change is observed within the monitor well 122 that differs from the fourth slope 228, it can be inferred that a secondary fracture has overtaken the first dominant fracture 212. In the graph 200, the rate of pressure change within the monitor well changes at time t5 to a fifth slope 230, indicating a change in the growth rate of the dominate fracture, potentially being the emergence of a new dominant fracture, i.e., the second dominant fracture 214. Unlike the pressure increase experienced during time interval t2 to t3, the pressure increase induced during time interval t5 to t6 is insufficient to cause an increase in pressure within the monitor well 122 but merely causes a further decrease in the leak off rate.

At time t6, a second rate cycle is initiated by reducing the fracturing flow rate for a second time. This reduction induces another relaxation of the poroelastic region 134, facilitating a return of the monitor well 122 to the baseline leak off rate observed during time interval t0 to t1. At time t7, a third fracturing cycle is initiated by increasing the fracturing fluid flow rate.

The process of cycling fracturing fluid flow rate can be repeated as many times as required to achieve sufficient fracturing of the subsurface formation 106. Whether sufficient fracturing of the subsurface formation 106 has been achieved may be determined using various techniques including, without limitation, counting the occurrence of a predetermined number of rate cycles, pumping a predetermined volume of the fracturing fluid into the active well, pumping the fracturing fluid for a predetermined time, observing temperature changes within the subsurface formation, and observing microseismic events within the subsurface formation. In certain implementations, completion of the fracturing operation may be determined by pressure responses in the monitor well. For example, the fracturing operation may be deemed completed when subsequent rate cycling does not induce variable pressure responses in the monitor well 122 or any pressure response at all. Such behavior of the monitor well 122 may indicate that either fracturing fluid is no longer being diverted to fractures other than the dominant fracture or that the majority of fractures from the active well already overlap the transducer fracture.

Figure 3:
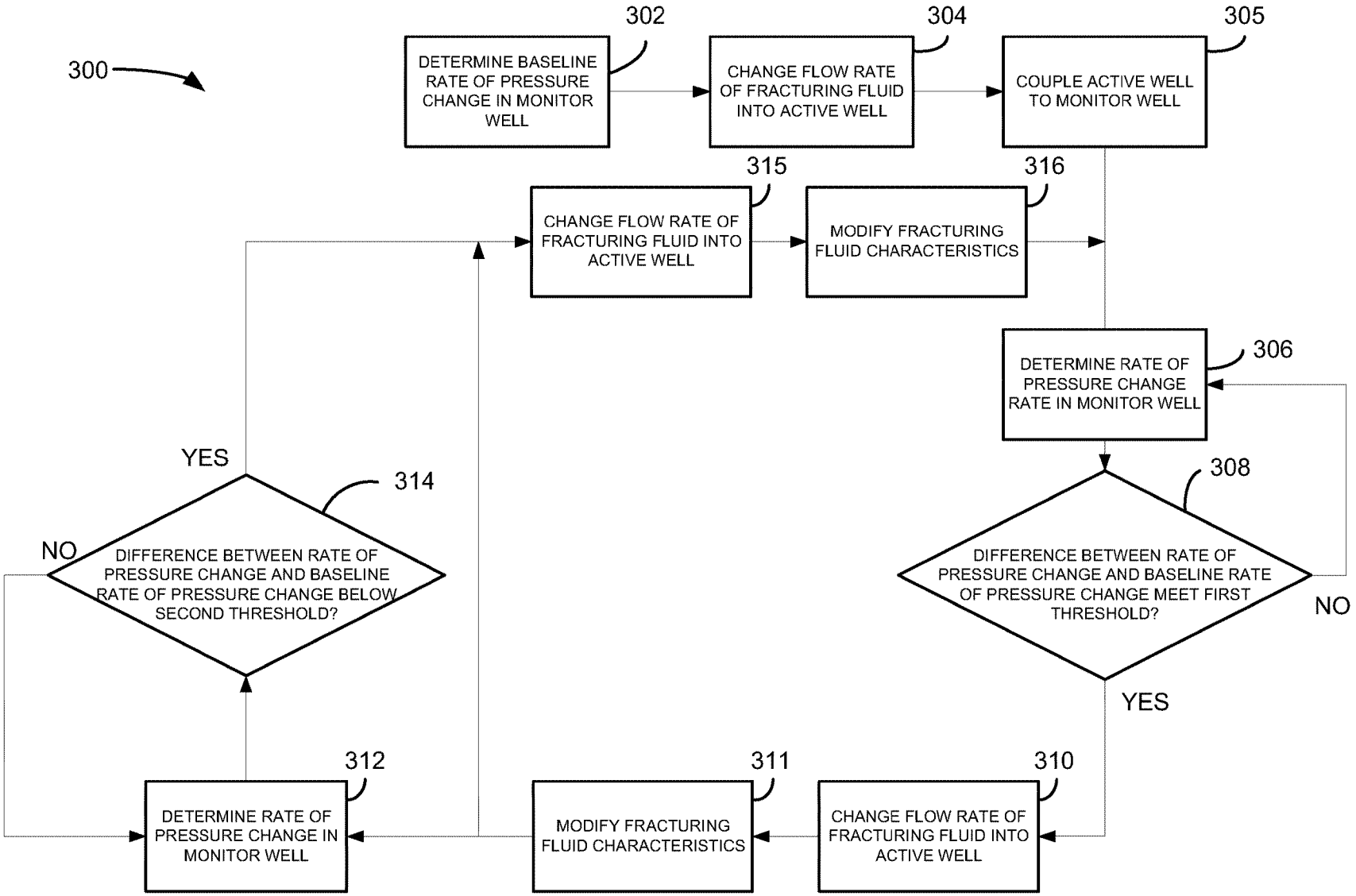
FIG. 3 is a flow chart illustrating an example method for controlling rate cycling during a fracturing operation.

FIG. 3 is a flow chart illustrating an example method 300 for controlling rate cycling during a fracturing operation. With reference to the well completion environment 100 (shown in FIG. 1), example method 300 includes an operation 302 that determines a baseline rate of pressure change in the monitor well 122. Determining the baseline rate of pressure change may include observing pressure within the monitor well 122 over time, such as by referring to pressure measurements obtained from a pressure gauge 144 coupled to a monitor wellhead 126 over a known time interval. In certain implementations, the baseline rate of pressure change corresponds to a leak off rate of the monitor well 122.

Prior to obtaining a baseline pressure rate change, the monitor well 122 may be pressurized. In certain implementations, pressurization of the monitor well 122 occurs as a result of completion of the monitor well 122. For example, the monitor well 122 is pressurized as a result of a fracturing operation applied to the monitor well 122. In other implementations, the monitor well 122 may be pressurized by injection of fluid, such as water, into the monitor well 122. In one specific example, the monitor well may be filled with water and the leak off rate measured thereafter. The volume of fluid (water) in the well provides hydrostatic pressure sufficient to measure leak off rate, in one example.

After obtaining a baseline rate of pressure change and coupling, an operation 304 changes the flow rate of fracturing fluid into a well to be fractured, such as the active well 120 shown in FIG. 1. More particularly, after the baseline rate of pressure change is obtained, the flow rate of fracturing fluid into the active well 120 is increased. In one implementation, a pumping system 132 injects the fracturing fluid into the active well 120. Stated differently, fracturing may be initiated in the active well while at the same time monitoring pressure, or some other parameter sufficient to infer a poroelastic effect between the monitor and the active well, at the monitor well.

As fracturing fluid is pumped into the active well 120, an operation 305 couples the active well 120 to the monitor well 122. In certain implementations, the coupling operation includes poroelastically coupling the active well 120 to the monitor well 122. In alternative implementations, the active well 120 and the monitor well 122 are directly coupled and in fluid communication instead of or in addition to being poroelastically coupled.

Subsequent operations 306, 308 identify or otherwise determine the rate of pressure change in the monitor well 122 and whether the difference between the rate of pressure change in the monitor well 122 and the baseline rate of pressure change obtained during operation 302 exceeds a first predetermined threshold. As long as the difference does not exceed the first predetermined threshold, operations 306 and 308 are repeated, either continuously or at discrete time intervals. In other words, the rate of pressure change within the monitor well 122 is observed and compared to the baseline rate of pressure change to determine when injecting fracturing fluid into the active well 120 creates a pressure response in the monitor well 122. The pressure response observed in the monitor well 122 is due, at least in part, to the poroelastic coupling between the active well 120 and the monitor well 122 and the transmission of pressure from the active well 120 to the monitor well 122 through the poroelastic region 134.

The present disclosure contemplates any number of possible fracturing fluid pumping parameter changes based on the pressure response in the monitor well. The difference in slope may be used, the time at which some difference is maintained, the degree of change in pressure, as well as other factors. Hence, various possible parameters and combination of parameters may be used as a threshold. Similarly, the number and type of response to the change may be any number of possibilities. For example, one rate cycle may occur, stepped cycles may occur, cycles may occur at different intervals and to different degrees, other changes, such as proppant or viscosity changes may be coordinated with the changes.

When the observed difference between the dynamically measured rate of pressure change and the base line rate of pressure change exceeds the predetermined threshold, an operation 310 changes the flow rate of fracturing fluid into the active well 120. In certain implementations, the flow rate is decreased to a lower flow rate, including no flow, for a predetermined period of time. In such implementations, the previously injected fluid may be permitted to flow from the active well into a tank or other storage system. In still other embodiments, the flow rate may be increased.

In addition to changing the flow rate of fracturing fluid into the active well 120, an operation 311 to modify characteristics of the fracturing fluid may be carried out. For example, and without limitation, one or more of the density, viscosity, proppant type, proppant concentration, additive concentration, and other characteristics of the fracturing fluid may be modified in response to the rate of pressure change observed in the monitor well.

In certain implementations, an operator may manually change the flow rate of fracturing fluid provided by the pumping system 132 in response to a system generated prompt. For example, the computing system 150 may generate commands or prompts, in response to some change in the monitor well pressure, guiding the operator to adjust the flow rate provided by the pumping system 132. Commands may be sent directly to the pumping system 132 or may generate an alert, prompt, or similar response on a control panel, graphical user interface, or other device of a user of the pumping system 132. In alternative embodiments, the pumping system 132 is communicatively coupled to a computing device, such as the computing system 150 of FIG. 1, that is configured to receive pressure measurements from the monitor well 122 and to provide control signals to the pumping system 132.

In certain implementations, the fracturing fluid flow rate is reduced during operation 310. After reduction of the fracturing fluid flow rate, operations 312, 314 determine the rate of pressure change in the monitor well 122 and whether the difference between the rate of pressure change in the monitor well 122 and the baseline rate of pressure change obtained during operation 302 are below a second predetermined threshold. As long as the difference is above the second predetermined threshold, operations 306 and 308 are repeated, either continuously or at discrete time intervals. In other words, the rate of pressure change within the monitor well 122 is observed and compared to the baseline rate of pressure change to determine when the pressure response observed in the monitor well 122 has subsided, thereby indicating sufficient relaxation of the poroelastic region 134 between the active well 120 and the monitor well 122. After such subsidence, the fluid flow rate of the fracturing fluid and the fracturing fluid characteristics are again modified in operations 315 and 316, respectively, thereby initiating a second rate cycle. Subsequent cycles may be conducted until sufficient fracturing of the active well 120 is achieved.

In alternative implementations, the duration for which a flow rate is maintained before rate cycling can be based on observations of microseismic events within the active well 120. As previously discussed in the context of FIGS. 2A and 2B, reducing the flow rate of the fracturing fluid pumped into the active well 120 generally leads to the occurrence of microseismic events near the wellbore, which generally indicate closure of fractures or formation and/or propagation of fractures other than the dominant fracture. Accordingly, observation of such microseismic events may be used to determine when to increase the flow rate of fracturing fluid. For example, in certain implementations the flow rate of the fracturing fluid is increased when one or more microseismic events occurs having a minimum predetermined magnitude and/or within a predetermined distance from the wellbore. Alternatively, a flow rate may be maintained for some period of time and/or at some prescribed level prior to rate cycling. Hence, a second threshold is not used to determine when to change flow rates.

Method 300 is intended only as an example embodiment of a method in accordance with the present disclosure and alternative implementations are possible. In one alternative implementation, flow rate of the fracturing fluid is increased and/or decreased in response to the difference between the baseline rate of pressure change and the observed rate of pressure change being maintained for a predetermined amount of time. In still other implementations, other parameters may be modified in addition to or instead of the flow rate of the fracturing fluid. Such parameters include, without limitation, the type of fracturing fluid being used, the relative proportion of components of the fracturing fluid, the amount or type of proppant added to the fracturing fluid, and the amount or type of other additive either added to or excluded from the fracturing fluid. Moreover, modifications to any parameters associated with the fracturing operation may vary from rate cycle-to-rate cycle. For example, the flow rates used during one rate cycle may differ from prior or subsequent rate cycles.

In certain implementations, properties of the fracturing fluid including, without limitation, one or more of the density, viscosity, proppant type, proppant concentration, additive concentration, and other characteristics of the fracturing fluid may be modified in response to the rate of pressure change observed in the monitor well 122. For example, rate cycling may induce only a minor variation or no variation in the rate of pressure change within the monitor well 122. Such minimal changes may indicate that a less than desirable amount of the fracturing fluid is being diverted away from the dominant fracture. To promote diversion of fracturing fluid, various techniques may be applied. For example, the size and/or concentration of proppant may be increased to promote bridging in the dominant fracture, thereby obstructing the flow of fracturing fluid into the dominant fractures. In another technique, the viscosity of the fracturing fluid may be changed. More specifically, a high viscosity fracturing fluid may be used to form a high viscosity "plug" in the dominant fracture that prevents or resists a subsequently injected low viscosity fluid from entering the dominant fracture.

The example implementation of the present disclosure illustrated in FIG. 1 included a monitor wellhead 126 and corresponding pressure gauge 144 for measuring pressure within the monitor well 122. In the example, the monitor well 122 defines a single volume such that pressure changes induced by poroelastic coupling between the active well 120 and any portion of the monitor well 122 are reflected by pressure gauge 144. In other implementations, however, a monitor well may be divided into isolated intervals with each interval having a respective pressure gauge (or similar sensor adapted to measure pressure) and a respective transducer fracture. By doing so, pressure responses in each interval may be monitored to detect fracture propagation through distinct portions of a subsurface formation. The pressure responses may then be used to modifying fracturing operation parameters, thereby controlling fracturing operations.

FIG. 4 is a table 400 illustrating a portion of an example fracturing operation plan and, more specifically, a fracturing operation plan that includes automated rate cycling and subsequent monitoring of the success of the automated rate cycling. As shown, the table 400 includes entries for each of stages 47 and 48 of the fracturing operation.

In general, the fracturing operation plan includes instructions and operational parameters for conducting one or more fracturing operations, each of which may include multiple stages. For example, the instructions may include, among other things, activating, deactivating, or modifying the performance of one or more pieces of equipment for carrying out the fracturing operation and/or changes to parameters governing operation of such equipment. The fracturing operation may further include thresholds, limits, and other logical tests. Such tests may be used, for example, to generate alerts or alarms, to initiate control or other routines, to select subsequent operational steps, or to modify current or subsequent steps in the fracturing operation. In implementations of the present disclosure, the fracturing operation plan may be executed, at least in part, by a computing system and the fracturing operation plan may be stored within memory accessible by the computing system. For example, in certain implementations the fracturing operation plan may include computer-executable instructions that may be executed by the computing system in order to control at least a portion of a fracturing operation. Executing the fracturing operation plan may then cause the computing system to, among other things, issue commands to equipment in accordance with the fracturing operation plan, receive and analyze data related to steps in the fracturing operation plan, and update or otherwise modify parameters of the fracturing operation plan in accordance with the received data.

The fracturing operation plan may also include instructions for operations that require manual intervention by an operator. For example, in some implementations, executing a fracturing operation in accordance with the fracturing operation plan may require an operator to provide confirmation or acknowledgement prior to a computing system executing one or more steps of the fracturing operation plan. In other implementations, more direct intervention by the operator may be required. For example, the operator may be required to manually activate, deactivate, or modify performance parameters of equipment.

Referring now to the example fracturing operation illustrated by the table 400, an initial trigger 402 is provided for each stage of the fracturing operation. The trigger 402 is generally a condition that, when met, initiates a rate cycle operation, as indicated in the "Action" column 404. For example, in stage 47, the trigger to initiate rate cycling is an increase of 5 psi within the monitor well following initiation of the first ramp. The first ramp generally corresponds to the first injection of fracturing fluid and initiation of fracture propagation for the stage. Similarly, in stage 47, the rate cycling trigger is an increase of 20 psi following the first ramp. Notably, the trigger of either of stages 47 and 48 may be dynamically determined, at least in part, by pressure responses observed in the monitor well during fracturing of one or prior stages.

In response to the trigger, rate cycling is initiated by reducing the fracturing fluid injection rate for a predetermined amount of time. For stages 47 and 48, such rate cycling includes reducing the injection rate of fracturing fluid to 0 bpm for three minutes. Following a rate cycle, each stage may also include a test to determine the effect of the rate cycling. As noted in table 400, the test 406 for each of stages 47 and 48 is an observed rate of pressure change decrease of more than 20%. If such a decrease in the rate of pressure change is observed, the fracturing operation proceeds according to the base schedule per column 408. If, however, no such pressure rate decrease is observed within a predetermined time (e.g., five minutes), a subsequent rate cycle may be initiated or other adjustments to the fracturing operation parameters may be applied, as shown in column 410. For example, as indicated for each of stages 47 and 48, the fracturing fluid is changed to a linear gel fracturing fluid.

Figure 5:
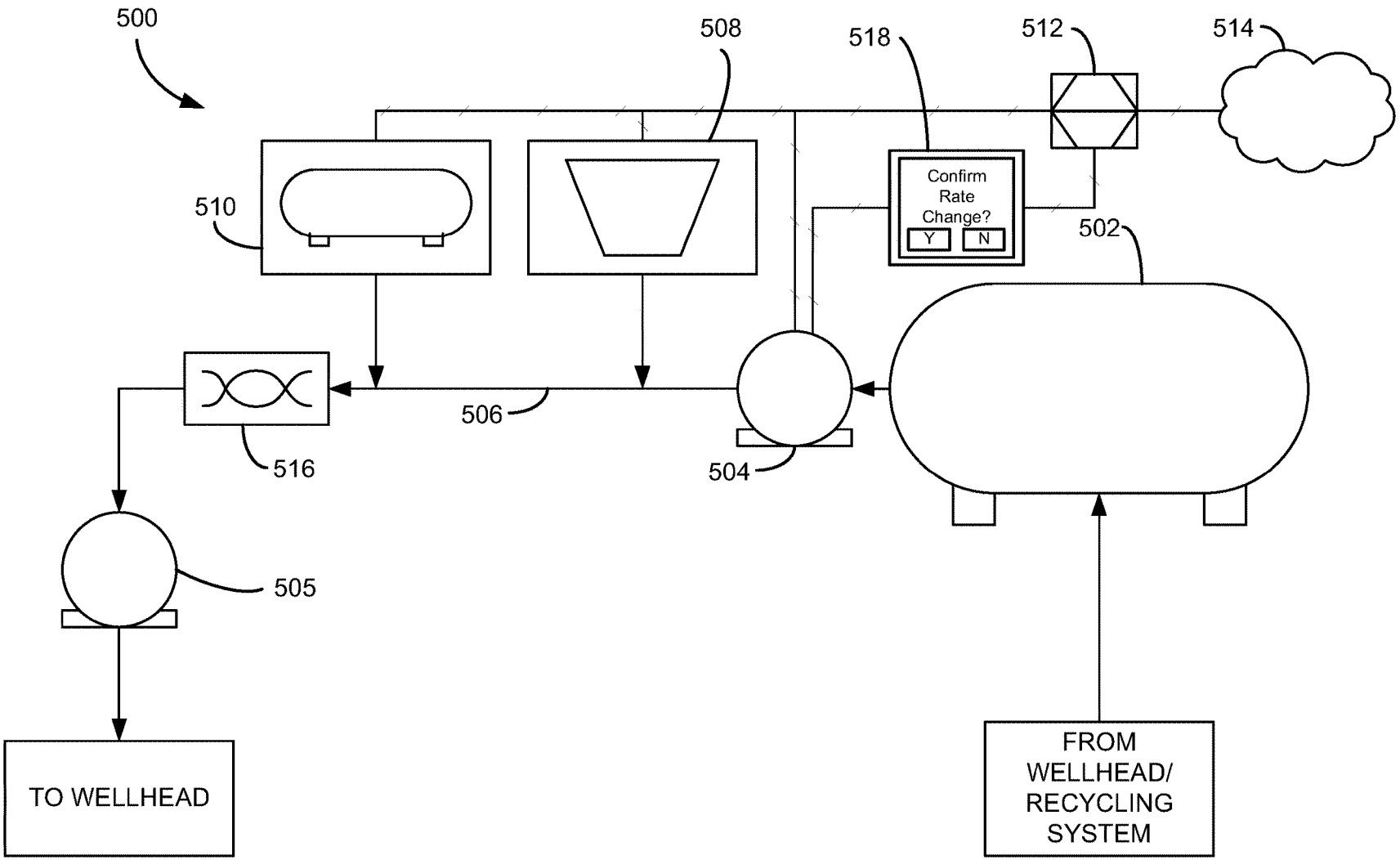
FIG. 5 is a schematic illustration of a pumping system for use in systems according to the present disclosure.

FIG. 5 is a schematic illustration of a pumping system 500 for use in systems according to the present disclosure. Pumping system 500 includes a primary fluid storage 502 coupled to a pump or pumps 504 and 505 configured to pump fluid from primary fluid storage 502 along an outlet 506 and to a wellhead of an active well to facilitate fracturing of the active well. A proppant system 508, an additive system 510, and a blender 516 are further coupled to an outlet 506. Each of the proppant system 508, the additive system 510, and the pump 504 are further communicatively coupled to a computing device 512. In certain implementations, computing device 512 is also communicatively coupled, either directly or indirectly, to a display of a control panel, human machine interface, or similar computing device.

During operation, the computing device 512 transmits control signals to the pump 504 to control pumping of fluid from the primary fluid storage 502 by the pump 504. As fluid is pumped from the fluid storage 502 to the active well through the outlet 506, proppants and other additives may be introduced into the fluid by the proppant system 508 and the additive system 510, respectively. In the pumping system 500, each of the proppant system 508 and the additive system 510 are each communicatively coupled to and controllable, at least in part, by the computing device 512. Accordingly, the computing device 512 can control the amount of proppant and additive introduced into the fluid. The outlet 506 may further include a blender 516 or similar mixing device configured to mix the fluid from the primary fluid storage 502 with proppants introduced by the proppant system 508 and/or additives introduced by the additive system 510.

The pumping system 500 may also operate, at least in part, based on control signals received from a user. For example, the pumping system 500 includes a display 518 or similar device for providing system data, alerts, prompts, and other information to a user and for receiving input from the user. As shown in FIG. 5, the display 518 may be used to prompt a user to confirm initiation of a change to the flow rate of fracturing fluid provided by the pumping system 500. In alternative implementations, the display 518 may further allow the user to receive other prompts and to issue other commands, such as those corresponding to operation of the proppant system 508, the additive system 510, or other components of the pumping system 500.

In certain implementations, the primary fluid storage 502 is coupled to the wellhead to permit recycling of fluid during a fracturing operation. Return fluid from the wellhead may require filtering or other processing prior to reuse and, as a result, the pumping system 500 may further include or be coupled to equipment configured to treat return fluid. Such equipment may include, without limitation, settling tanks or ponds, separators, filtration systems, and reverse osmosis systems.

As illustrated in FIG. 5, the computing device 512 is communicatively coupled to a network 514 and is configured to receive data over the network 514. For example, in certain implementations the computing device 512 receives pressure measurements taken from a monitor well, such as the monitor well 122 shown in FIG. 1, and/or control signals from a control system or other computing device, such as computing system 150 (shown in FIG. 1), derived from such pressure measurements. Computing device 512 then controls the pumps 504, 505, the proppant system 508, the additive system 510, and other components of the pump system 500 based on the measurement data and/or control signals. In alternative implementations, one or more components of the pump system 500 are manually controlled, at least in part, by an operator. For example, in certain implementations, the output of the pumps 504, 505 is manually controlled by an operator who receives pressure measurement data from a second operator at the monitor well 122 or by reading a gauge or display configured to communicate pressure within the active well 120.

Fracturing Operation Monitoring Using Sealed Monitor Wells

In the previous implementations discussed herein, fracturing operations for a target well were monitored in part using an offset/monitor well. More specifically, pressure changes within the monitor well resulting from poroelastic coupling between a monitoring fracture (or factures) of the monitor well and the fractures formed during fracturing of the target well are used to determine progress of the fractures of the target well and, subsequently, to control fracturing operations (e.g., by triggering a rate cycle).

In another aspect of the present disclosure, systems and methods are provided for monitoring of hydraulic fracturing treatments using a sealed monitor well instead of the monitoring fracture of the previous implementations. The sealed monitor well may be cased but unperforated and substantially filled with a fluid (e.g., water). In certain applications, sufficient fluid may be present in the monitor well due to previous well operations. However, in other applications, additional fluid may be added to the sealed monitor well prior to sealing the monitor well to completely fill the monitor well to surface with fluid.

The monitor well is fitted with one or more pressure transducers, which may be disposed at various locations within the monitor well and/or installed in a wellhead of the monitor well. As fractures from an adjacent target well approach and/or overtake the monitor well, force is exerted on the monitor well, increasing the internal pressure of the monitor well as measured by the pressure transducers. Based on measurements of such pressure changes, the progress of fracturing operations of the target well may be ascertained. Like the previous implementations discussed herein, fracturing operations of the target well may then be controlled or otherwise modified in response to the pressure changes observed in the monitor well.

Various sections of the monitor well could also be isolated from each other and pressure may be monitored in each section. By doing so the monitor well may be divided into distinct chambers or monitoring portions to better define the subsurface effects being monitored. Sectioning of the monitor well may be achieved, for example, by bridge plugs, packers, or other suitable isolation tools. In certain implementations transducers may be deployed via a tubing string to monitor pressure in each isolated section.

Monitor wells for use in the systems and methods described herein may be preexisting wells or may be drilled specifically for purposes of monitoring fracturing operations. In general, however, the monitor wells are preferably located proximate the target well such that the monitor well extends across a growth path for fractures extending from the target well and, if possible, transverse or generally perpendicular to the predominant fracture growth direction. In some instances, the monitor well, or at least a portion thereof, will be generally parallel the well bore being fractured.

During fracturing operations of the target well, hydraulic fractures approach the monitor well and induce stresses in the rock surrounding the monitor well. As such stresses increase, such as by the introduction of additional hydraulic fracturing fluid into the target well, portions of the monitor well may be compressed. Such compression may result in pressure changes (increases) within the monitor well for several reasons. For example, assuming that the monitor well is substantially sealed, the pressure change within the monitor well may be a result of the compressive forces from the fracture and associated fracturing fluids intercepting or otherwise interacting with the monitor well casing and thereby acting upon fluid contained within the monitor well. Pressure increases may also be observed due to compression of the monitor well casing reducing the inner diameter of the monitor well, thereby causing the level of liquid maintained within the monitor well to increase and, as a result, the hydraulic head provided by the liquid.

In certain cases, interaction between the hydraulic fractures extending from the target well and the monitor well may also be observed as an initial reduction in pressure within the sealed monitor well. For example, as a fracture extends from the target well, the forces and pressures within the formation associated with the propagating fracture may reduce in-situ stresses on the monitor well and, as a result, may cause a decrease in pressure within the monitor well. Once the fracture reaches the sealed monitor well, the net stress (added to the steady state in-situ stresses) induced by the extending fracture may switch from being tensile to compressive. In the immediate vicinity of the fracture surface, the induced compressive stresses may be approximately equal to the fracture fluid pressure within the extending fracture at the point of interest. Accordingly, a pressure reduction may be observed as the fracture approaches the monitor well followed by an increase in pressure once the fracture tip passes the monitor well.

In certain implementations, a single monitor well may be used to monitor fracturing operations for two or more target wells. In one example, a single monitor well may be used to facilitate a "zipper" fracturing operation for multiple target wells. Such an operation may generally include fracturing of multiple target wells in an alternating manner to improve overall operational efficiency. For example, a first stage of a first well may be plugged and perforated using a wireline or similar tool. As the first stage of the first well is fractured, a first stage of a second well may be plugged and perforated, preferably (although not necessarily) from the same or a nearby well pad such that the same wireline tool and pumping system may be used in the second well. A second stage of the first well may then be plugged and perforated while the first stage of the second well is fractured. This process is repeated for each stage of the first and second wells. In such implementations, a monitor well may be disposed between each of the multiple wells undergoing fracturing operations to direct or control such operations. For example, a single monitor well may be disposed between the first well and the second well to determine when a given stage of the first well has been sufficiently fractured and, as a result, when to begin fracturing a corresponding stage of the second well (and vice versa).

In another example operation, the monitor well may be positioned between a depleted region and two or more target wells being completed in a zipper operation. Alternatively, the monitor well may be located on the opposite side of the depleted area such that the depleted area and the two or more target wells are disposed on the same side of the monitor well. The target wells may then be alternatingly completed using the monitor well to determine whether completion order is affecting fracture propagation direction. For example, if stages in a target well further away from the region of depletion are fractured ahead of comparable stages of a target well closer to the region of depletion, the fractures in the target well closer to the region of depletion could be driven towards the depleted region. By monitoring pressure within the monitor well, one may identify such interactions between the target wells and may determine fracture order or delays between zipper operations to minimize such interactions.

One or more pressure transducers may be disposed along the monitor well or otherwise positioned to measure pressure within the monitor well. Without limitation, example locations for pressure transducers include at a heel of the monitor well, at a toe of the monitor well, at one or more intermediate locations between the heel and the toe, and at the wellhead of the monitor well. In certain implementations, pressure transducers may be disposed along the monitor well that correspond to different stages of the target well. By providing pressure transducers at multiple locations along the monitor well, additional information regarding the actual or approximate location at which fractures from the target well overtake the monitor well may be ascertained. In certain implementations, the information from the pressure transducers may also be supplemented or validated by strain measurements obtained from strain gauges or one or more optical fibers disposed along the wellbore and which measure strain on the casing caused by interactions with the fracture of the target well. For example, and without limitation, such strain measurement devices may be distributed along the casing of the monitor well, particularly between the heel and the toe of the monitor well and could include discrete strain gauges of optical fibers.

Pressure gauges or similar pressure and/or force measurement devices may also be used to monitor external formation pressure and forces exerted by the formation on the monitor well, providing additional details regarding fractures extending from the target well and the monitor well. In certain implementations, communication may be established between the formation and such external gauges by perforation shots directed away from the monitor well into the rock using a perforation gun located on the casing exterior of the monitor well. In another implementation, the inner diameter of the monitor well casing may be divided into discrete, isolated chambers, each having its own pressure transducer. Internal pressure sensing transducers could also be deployed inside the casing via tubing with isolation between sections via packers or deployed on the casing outer diameter and ported to the inner diameter.

In general, pressure measurement devices configured to measure pressure of a common, open portion of a wellbore will exhibit substantially the same pressure response as each other. Accordingly, to the extent pressure within specific portions of the monitor well are to be observed, such portions may be isolated (e.g., using packers, etc.) to define separate pressure measurement zones or monitoring portions/sections. However, it should be appreciated that maintaining fluid communication between at least a portion of the wellbore and a wellhead may be advantageous. For example, a pressure transducer disposed at a relatively shallow location within the well can be used to detect pressure responses caused by interactions of fractures and the monitor well provided the location of measurement by the pressure transducer is in fluid communication with the location of the interaction (e.g., by disposing the pressure transducer below a water or similar fluid level in the well bore). Advantages of doing so include, but are not limited to, a reduction in the required transducer pressure rating and improved pressure measurement resolution.

Although strain measurements are described herein as being used to validate or as otherwise supplemental to pressure measurements, systems and methods described herein may also rely on strain measurements as the primary (e.g., with pressure measurements used as supplemental data) or the only way of identifying interactions between the monitor and target wells. Accordingly, to the extent the foregoing disclosure discusses the use of pressure transducers and pressure measurements, it should be appreciated that strain gauges and strain measurements may generally be implemented in a similar manner.

As previously discussed, the pressure response measured in the monitor well may be, at least in part, due to pressure exerted on a fluid sealed within the monitor well. To the extent air or other compressible fluid is disposed within the sealed monitor well (for example, near the wellhead), such compressible fluid may negatively impact the accuracy, resolution, and timeliness with which pressure responses within the monitor well may be detected. Accordingly, the monitor well may be prepared such that the monitor well is substantially filled with a liquid, such as water. For example, water may be pumped or otherwise provided into the monitor well prior to fracturing of the target well and air or other compressible fluids may be substantially removed from the monitor well prior to sealing the monitor well.

Figure 6:
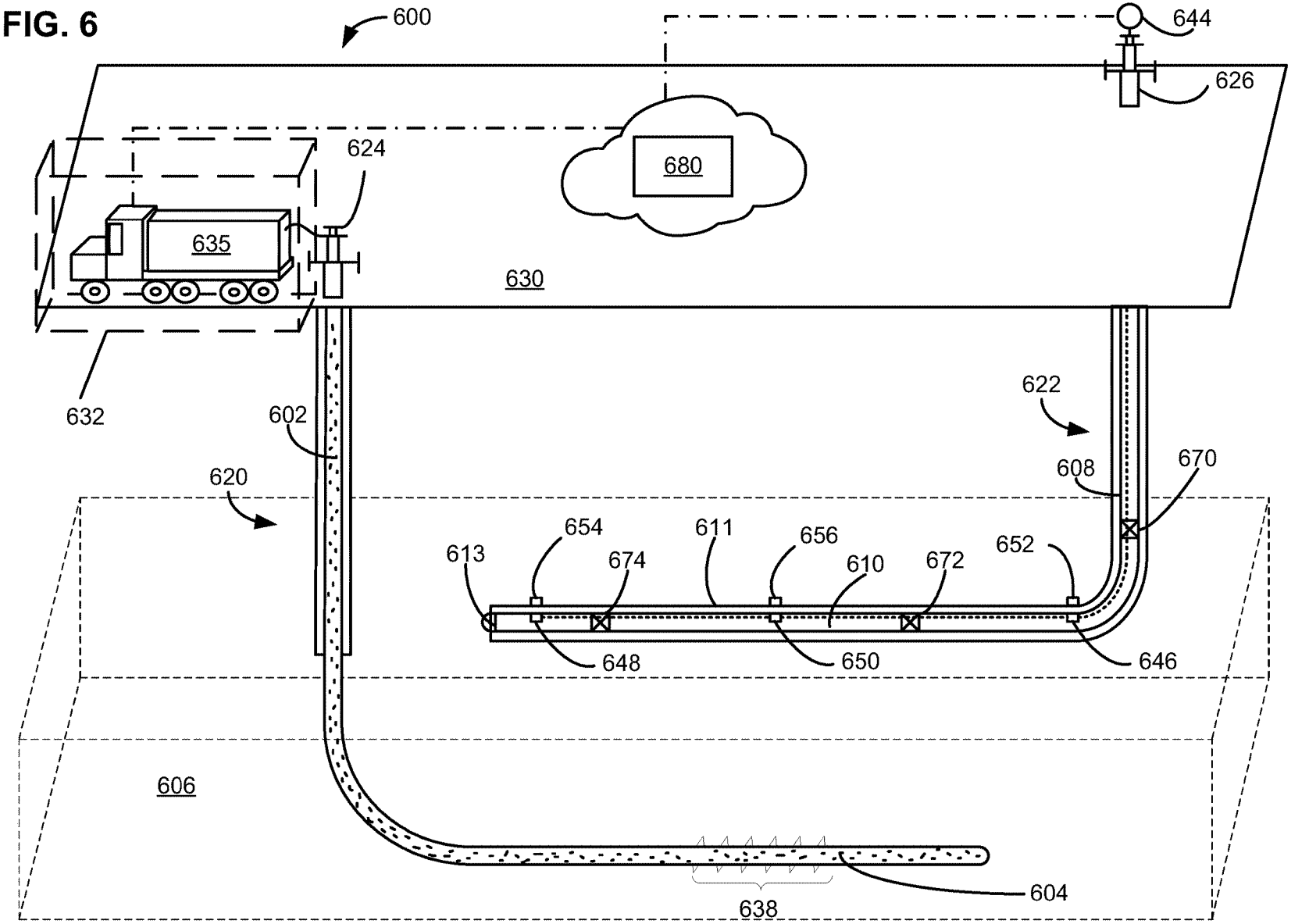
FIG. 6 is a schematic diagram of an example well completion environment including a target well and a monitor well and illustrating a fracturing operation in accordance with the present disclosure.

FIG. 6 is a schematic diagram of an example well completion environment 600 for completing a fracturing operation in accordance with the present disclosure. The well completion environment 600 includes a subsurface formation 606 through which an active or target well 620 and a monitor well 622 extend. The target well 620 includes a vertical active well section 602 and a horizontal active well section 604. Similarly, the monitor well 622 is also a horizontal well and includes a vertical monitor well section 608 and a horizontal monitor well section 610. The monitor well 622 and target well 620 are shown from substantially offset vertical sections; however, it is also possible that the monitor well 622 and the target well 620 may be initiated from the same pad. Thus, the relative orientation of the wells 620, 622 is provided as an example and should not be construed as limiting.

In implementations of the present disclosure, the monitor well 622 may generally be located relative to the target well 620 such that the monitor well 622 is likely to interact with fractures extending from the target well 620. For example, the monitor well 622 may be located to at least partially extend through the same strata of the subsurface formation through which the target well 620 passes and/or may be disposed at a particular distance from the target well 620 to which it may reasonably be assumed that fractures will extend.

In contrast to the monitor well 122 of the well completion environment 100 discussed in the context of FIG. 1, the monitor well 622 may be sealed. For example, as illustrated in FIG. 6, each of the vertical monitor well section 608 and the horizontal monitor well section 610 may be encompassed by a casing 611. The horizontal well section 610 may also include a plug 613 or similar downhole feature such that the internal volume of the monitor well 622 is closed. In alternative implementations of the present disclosure, one or both of the target well 620 and the monitor well 622 may be vertical wells. In some instances, a monitor well may be one that will be completed, or has been completed, and may in some instances be a producing well or previously producing well. Moreover, implementations of the present disclosure may include more than one active well and/or more than one monitor well. Accordingly, one or more monitor wells may be used to monitor fracturing of one or more active wells.

The target well 620 includes a target wellhead 624 disposed at a surface 630. Similarly, the monitor well 622 includes a monitor wellhead 626 at the surface 630. The monitor wellhead 626 may further include multiple pressure gauges and transducers for measuring pressure at various locations within the monitor well 622. For example, the monitor well 622 includes each of a wellhead pressure transducer 644, a heel pressure transducer 646 located in or near the heel of the monitor well 622, a toe pressure transducer 648 located near the toe of the monitor well 622, and an intermediate pressure transducer 650 disposed between the heel pressure transducer 646 and the toe pressure transducer 648. The pressure transducers 646, 648, and 650 are positioned to measure pressure within monitor well 622. It should be appreciated that the quantity and placement of pressure transducers in implementations of the present disclosure are not limited to the arrangement illustrated in FIG. 6 and any suitable number of pressure transducers for measuring pressure within the monitor well 622 may be used.

In addition to pressure transducers 644, 646, 648, and 650, various other sensors and transducers may be used in implementations of the present disclosure. For example, each of the heel pressure transducer 646, the intermediate pressure transducer 650, and the toe pressure transducer 648 are supplemented with a respective strain gauge, strain transducer, or other externally sensing pressure transducers 652, 654, and 656. Each of the strain gauges 652, 654, and 656 is coupled to the casing 611 adjacent the respective pressure transducer 646, 648, and 650. Accordingly, each of the strain gauges 652, 654, and 656 may measure strain on the casing 611 at their respective locations. It should be appreciated that while the strain gauges 652, 654, and 656 are shown as having a one-to-one relationship with the pressure transducers 646, 648, and 650, more or fewer strain gauges may be used in other implementations of the present disclosure and the strain gauges may be positioned at locations along the casing 611 that do not necessarily correspond to a location of a pressure transducer. Moreover, different combinations of sensors are possible, and implementations without pressure sensors are possible. Fiber based sensing arrangements that can detect a fracture approaching and/or intercepting the monitor well are also possible. For example, a fiber optic-based strain gauge may be disposed on the casing 611 to facilitate strain measurements.

Each of the pressure transducers 644, 646, 648, and 650 may be configured to measure pressure within a respective monitoring portion of the monitor well 622. To do so, one or more packets, plugs, or similar isolation tools may be disposed at various locations within the monitor well 622. For example, as illustrated in FIG. 6, three packers 670, 672, and 674, are disposed at various locations within the monitor well 622 to form three distinct sections of the monitor well 622, each including a respective one of the pressure transducers 644, 646,648, and 650 to measure pressure within the section.

Another example of sensors that may be used in implementations of the present disclosure include, without limitation, externally sensing pressure transducers. In one example implementation, such transducers may be installed with perforation guns on the outer diameter of the casing 611 and perforations may be shot away from the casing 611 (i.e., not penetrating the casing). As a result, the perforations together with the externally sensing pressure transducers form a pressure sensing system that will sense fractures extending from the target well 620 as they approach the monitor well 622. Yet another type of sensor that may be used in implementations of the present disclosure is a contact stress or tactile pressure sensor, which generally measure contact stresses or contact pressure between two mating surfaces. Accordingly, such sensors may be mounted to an exterior surface of the casing 611 to measure contact forces and pressure exerted onto the outer surface of the casing 611.

Each of the gauges, sensors, and transducers of the well completion environment 600 is adapted to obtain a corresponding measurement. Such measurement data may then be transmitted to a computing system 680. In the well completion environment 600, the computing system 680 is communicatively coupled to a pumping system 632 (illustrated in FIG. 6 as including a pump truck 635) such that the computing system 680 can transmit pressure data, control signals, and other data to the pumping system 632 to dynamically adjust parameters of the fracturing operation based on pressure measurements received from the monitor well 622 and monitor well wellhead 626. The pumping system 632 generally provides fracturing fluid into the target well 620 and, in certain implementations, may include additional equipment for modifying characteristics of the fracturing fluid and/or the manner in which the fracturing fluid is injected into the target well 620. Such equipment may be used, for example, to add or change a proppant or other additive of the fracturing fluid in order to modify, among other things, the viscosity, proppant concentration, proppant size, or other aspects of the fracturing fluid. Accordingly, such equipment may include, without limitation, one or more of tanks, pumps, filters, and associated control systems. The computing system 680 may include one or more local or remote computing devices configured to receive and analyze the pressure data to facilitate control of the fracturing operation.

The computing system 680 may be a single computing device communicatively coupled to components of the well completion environment 600, or forming a part of the well completion environment 600, or may include multiple, separate computing devices networked or otherwise coupled together. In the latter case, the computing system 680 may be distributed such that some computing devices are located locally at the well site while others are maintained remotely. In certain implementations, for example, the computing system 680 is located locally at the well site in a control room, server module, or similar structure. In other implementations, the computing system is a remote server that is located off-site and that may be further configured to control fracturing operations for multiple well sites. In still other implementations, the computing system 680, in whole or in part, is integrated into other components of the well completion environment 600. For example, the computing system 680 may be integrated into one or more of the pumping system 632, the target wellhead 624, and the monitor wellhead 626.

The pressure transducers 644, 646, 648, 650 (and any other transducers or sensors, such as the strain gauges 652, 654, 656) are communicatively coupled to the computing system 680, such as by respective transmitters. Similar transducers and sensors may also be installed or disposed in the target well 620 and communicatively coupled to the computing system 680 to measure or otherwise obtain data regarding conditions in the target well 620. Although described herein as measuring pressure and strain, other transducers and sensors that may be implemented in the well completion environment 600 may also measure temperature, flow rate, level, various chemical measurements, or any other condition or quantity that may be of interest in either the target well 620 or the monitor well 622.

Well completion environment 600 is depicted after perforation but before fracturing of the target well 620. Accordingly, active well horizontal section 604 includes a plurality of perforations 638 that extend into the formation 606 from the target well 620. In the implementation illustrated in FIG. 6, the perforations 638 are formed and extend from an uncased portion of the target well 620 into the surrounding formation 606. In contrast, in implementations in which fracturing operations are to occur in a cased portion of a target well, the perforations would also extend through the well casing. The perforations 638 may be formed during the initial completion of the target well 620 to direct fracturing fluid into the subsurface formation 606 at the respective perforations. For example, in certain completion methods, casing is installed within the well and a perforating gun is positioned within the target well 620 adjacent the portion of the subsurface formation 606 to be fractured. The perforating gun includes shaped charges that, when detonated, create perforations that extend through the casing and into the adjacent formation, thereby creating an initial fluid path from the target well 620 into the formation. During fracturing, fracturing fluid is pumped into the target well 620 and the fluid passes through the perforations 638 under high pressure and rate. The injection of fracturing fluid into the formation at the perforations forms one or more fractures that emanate from the well into the subsurface formation 606. The fractures form fluid paths between the subsurface formation 606 and the target well 620 so that oil and/or gas in the formation flows to and into the well.

Alternative fracturing methods may also be used in conjunction with the systems and methods disclosed herein. For example, in certain implementations, the fracturing operation is an open-hole fracturing operation. In contrast to methods in which a casing is installed and then perforated prior to fracturing, open-hole fracturing is performed on an unlined section of the wellbore. Generally, open-hole fracturing involves isolating sections of the uncased wellbore using packers or similar sealing elements. Sliding sleeves or similar valve mechanisms disposed between the packers are then opened to permit pumping of the fracturing fluid into the surrounding formation. As pressure within the formation increases, fractures are formed and propagated. In multi-stage wells, this process is repeated for each stage moving up the wellbore. Of course, multi-stage fracking may also be performed in a cased well.

The active wellhead 624 is coupled to a pump system 632 for pumping fracturing fluid into the target well 620. In the well completion environment 600, for example, the pump system 632 includes a pump truck 635 coupled to the active wellhead 624. The pump truck 635 includes a tank or other means for storing the fracturing fluid and a pump connected to the active wellhead 624 for pumping fluid into the target well 620. In other embodiments, the pump system 632 includes other equipment for providing fracturing fluid to the target well 620 including, without limitation, storage tanks or other vessels and one or more additional pumps. The pump system 632 may further include equipment configured to modify the fracturing fluid, for example, by adding one or more additives, such as proppants or chemicals, to the fracturing fluid. The pump system 632 may also include equipment, such as filters, to treat and recycle fracturing fluid. As shown in the implementation of FIG. 6, the pump system 632, and more particularly pump truck 635, is communicatively coupled to the computing system 680. Accordingly, the pump truck 635 can receive sensor data, control signals, or other data from the computing system 680, including data configured to be used in controlling and monitoring of an ongoing fracturing operation.

In addition to being sealed, the monitor well 622 may contain and be substantially filled with a liquid, such as water. In certain implementations, during preparation of the monitor well 622, liquid may be introduced into the monitor well 622 or otherwise allowed to substantially fill the monitor well 622 in order to displace air, gaseous hydrocarbons, or other highly compressible fluids or media that may be present in the monitor well 622. By doing so, the monitor well 622 may be made to be more responsive to applied stresses than if the monitor well 622 contained the highly compressible fluid. For purposes of this disclosure, the term "substantially filled" should not be interpreted to mean any specific degree to which the monitor well 622 is filled. Rather, the monitor well 622 is sufficiently filled if the amount of fluid present within the monitor well 622 provides improvement in detecting a pressure response of the monitor well 622 due to interactions with a fracture extending from the target well 620 as compared to if the monitor well 622 did not contain any such fluid.

Figure 7A:
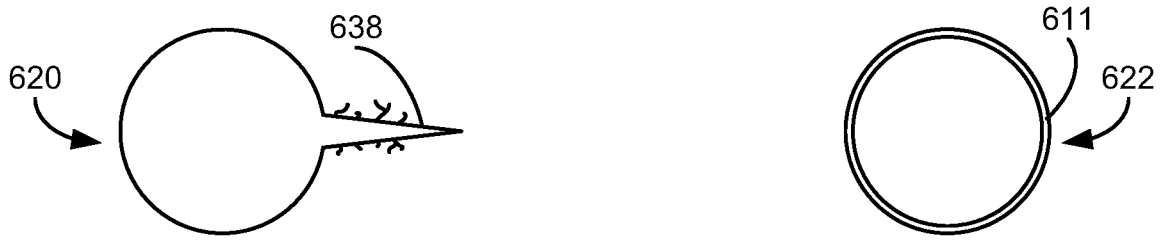
FIGS. 7A-D are cross-sectional views of a target well and a monitor well during a fracturing operation in accordance with the present disclosure.
Figure 7B:
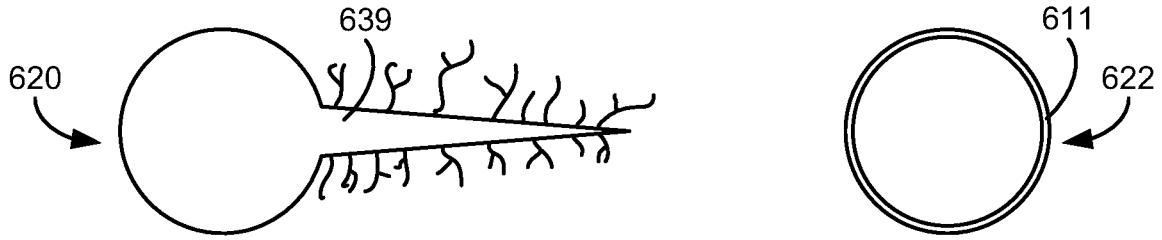

FIGS. 15A-D are cross-sectional views of the well completion environment 600 illustrating the formation and propagation of fractures from the target well 620 toward the monitor well 622 to illustrate various aspects of the present disclosure. In the following description, reference is also made to elements of the well completion environment 600 illustrated in FIG. 6. Referring first to FIG. 7A, each of the target well 620 and the monitor well 622 are shown prior to injection of fracturing fluid. For simplicity, only one perforation 638 is illustrated extending from the target well 620, however, it should be appreciated that multiple perforations may extend from the target well 620 in multiple directions. As pumping system 632 pumps fracturing fluid into the target well 620, the fracturing fluid enters the subsurface formation 606 through the perforations 638. As the fracturing fluid continues to enter the subsurface formation 606, pressure within a portion of the subsurface formation 606 adjacent the perforations 638 increases, leading to the formation and propagation of fractures 639 within the subsurface formation 606, as illustrated in FIG. 7B.

Figure 7C:
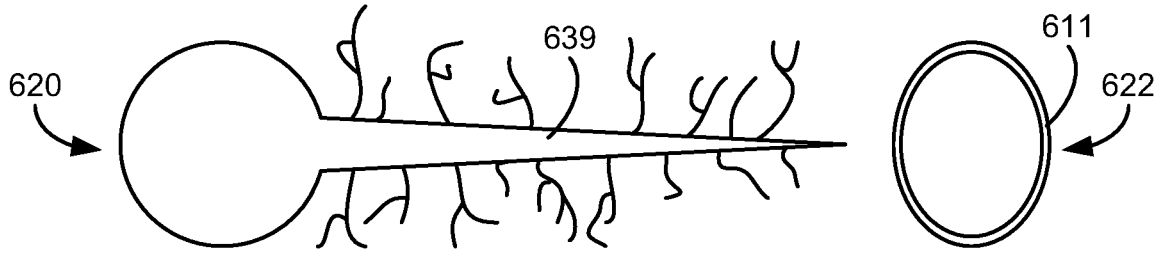

As illustrated in FIG. 7C, as the fractures 639 grow and continue to propagate outward toward the monitor well 622, stresses are induced in the portion of the subsurface formation 606 disposed between the target well 620 and the monitor well 622. Such stresses may result in force being applied to the monitor well 622 and may result in deformation of the monitor well 622 or, more specifically the casing 611 of the monitor well. Such deformation results in change of pressure within the monitor well 622 which may be attributable to the external pressure exerted on the casing 611 and/or the change in hydraulic head caused by the changing diameter of the casing 611.

The change of pressure within the monitor well 622 may generally be an increase as the fracture crosses the path of the monitor well 622, however, in at least some cases the pressure within the monitor well 622 may also decrease as the fracture approaches the monitor well 622 and relieves in-situ stresses within the formation 606. Accordingly, while the current disclosure focuses on pressure increases as being the primary change indicating interaction between fractures of the target well 620 and the monitor well 622, implementations of the present disclosure may also rely on pressure decreases within the monitor well 622 as indicative of interactions between the fracture and the monitor well 622.

Figure 7D:
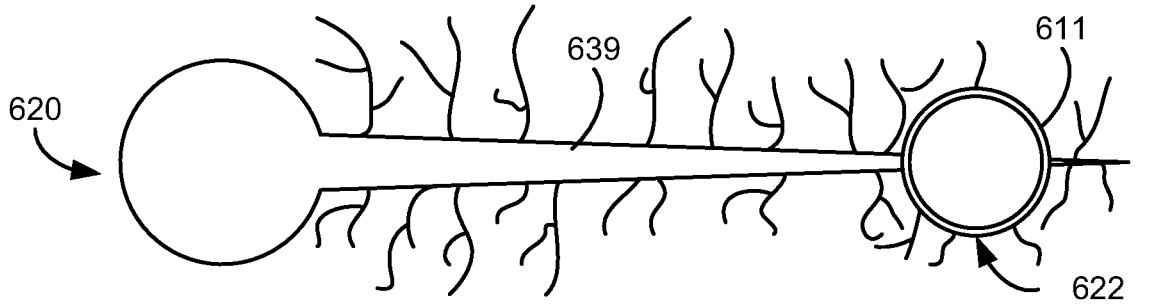

Although illustrated in FIG. 7C as resulting in a lateral compression of the monitor well 622, it should be appreciated that such deformation is not intended to be to scale and illustrates just one possibility of deformation that may result from stresses induced in the subsurface formation 606. Actual deformation of the monitor well 622 may differ and may depend on, among other things, the actual direction of propagation of the fracture 639 from the target well 620, the relative location and change of location relative to the monitor well 622 (above, below, intercepting, etc.) and the various properties of the subsurface formation 606. As the fractures continue to propagate and cross the path of monitor well 622, as illustrated in FIG. 7D, the compressive effects on the monitor well 622 may increase, resulting in further deformation of the monitor well casing 611 and increased pressure within the casing 611.

Pressure changes within the monitor well 622 provide information regarding the propagation of fractures from the target well 620 and, as a result, identifying and characterizing such pressure changes may be used to control fracturing operations, among other things. Generally, pressure changes observed in the monitor well 622 during pumping of fracturing fluid into the target well 620 indicate when fractures extending from the target well 620 have propagated near or have crossed the path of the monitor well 622. Accordingly, the time between initiating injection of fracturing fluid into the target well 620 and a corresponding response in the monitor well 622, the total fluid volume pumped into the active stage before identifying a response in the monitor well 622, the degree of the pressure response in the monitor well 622, the rate of change of the pressure within the monitor well 622, and other information related to the pressure response (or other sensed response) in the monitor well 622 may be used to control one or more fracturing operation parameters or otherwise inform fracturing operations. Fracturing operation parameters generally refers to any aspect of a fracturing operation that may be controlled or varied to modify the fracturing operation. Example fracturing operation parameters include, without limitation, fracturing fluid viscosity, proppant size, proppant concentration, fracturing fluid additive ratios, fracturing fluid injection rate, fracturing fluid injection duration (e.g., for rate cycling), duration between pumping cycles, fracturing fluid injection pressure, fracturing fluid composition, and the like.

As previously discussed, pressure transducers may be disposed at various locations of the monitor well 622, such as the heel pressure transducer 646, the intermediate pressure transducer 650, and the toe pressure transducer 648. By implementing multiple pressure transducers along the length of the monitor well 622, localized pressure changes may be observed and, as a result, the approximate location of fractures inducing such pressure changes may be inferred. As illustrated in FIG. 6, identifying the location of the fractures may be facilitated by isolating portions of the wellbore (such as by using packers 670-674) and using one or more pressure transducers to measure pressure within each isolated portion of the monitor well 622. Accordingly, when a pressure response is measured by a particular subset of the pressure transducers, it may be assumed that fractures have crossed the monitor well 622 at some point along the corresponding section.

Another advantage gained by isolating sections of the monitor well 622 and including pressure transducers for measuring pressure responses in each isolated section is that the pressure response in the smaller section increases and is therefore more easily observable than if the monitor well was not subdivided. For example, in a 20,000 foot well (as measured from surface to toe) without isolation and filled with a fluid, the entire fluid volume is compressed as a fracture approaches and/or crosses over the monitor well 622. As a result of the compressibility of the fluid within the well, the observed response in an "open" (i.e., without isolation) 20,000 foot well may be relatively small (e.g., on the order of only 1 psi). However, if a bridge plug or similar device is set at 10,000 feet (or any other depth that divides the wellbore), the sensed pressure change in the lateral would double (e.g. on the order of 2 psi) because only half of the fluid is available to be compressed as is available in the fully open scenario. Further subdividing the monitor well 622 further increases the response. Continuing the current example, suppose a 10,000 foot lateral portion of the well is divided into five 2,000 foot sections, each of which is isolated from each other. If a fracture were to cross the monitor well 622 near the center of one of the 2,000 foot sections, the induced pressure change would be on the order of 10 psi since only 1/10th of the entire fluid volume of the monitor well 622 is being compressed. Accordingly, in addition to being useful in determining the approximately location at which a fracture has approached/crossed the monitor well 622, isolating and monitoring sections of the monitor well 622 improves the sensitivity with which the monitor well 622 is able to detect such interactions.

In an example application, suppose a dominant fracture propagates from the target well 620 to overtake the monitor well 622 near the toe of the monitor well 622. If the toe portion of the monitor well 622 is isolated, only the toe pressure transducer 648 may register a pressure increase, may register a pressure increase before the other pressure transducers (for example, if the dominant fracture expands to cross two sections of the monitor well 622), or may register a pressure increase that is greater than the other pressure transducers. As a result, it may be assumed that the dominant fracture is likely in the vicinity of the toe of the monitor well 622. The location of dominant fractures may also be inferred from other sensors, such as the strain gauges 652-656. For example, if a dominant fracture extends from the target well 620 and overtakes the monitor well 622 near the toe of the monitor well 622, the toe strain gauge 654 may measure strain on the monitor well casing 611 that precedes and/or exceeds strain measured by the strain gauges 652, 656 disposed at the heel and intermediate locations of the monitor well 622. Moreover, other strain sensors may not detect a change from a fracture proximate a distant sensor.

As previously noted, if sections of the monitor well 622 are not isolated, each pressure transducer along the monitor well 622 may register approximately the same pressure measurement at steady state. However, by observing how pressure changes propagate through the monitor well 622, an approximation of the location at which a fracture crosses the monitor well may be ascertained. In other words, while pressure may ultimately equalize along the length of the monitor well 622, different portions of the monitor well 622 may reach pressure at slightly different times. As a result, the earliest locations to reach pressure may be used to approximate the location of the fracture. Other measurements, such as strain, may also be used alone or in combination with pressure measurements in open wells to facilitate identification of fracture locations.

Notably, while the target well 620 shown in FIG. 6 is illustrated as including only a single stage, systems and methods in accordance with the present disclosure may be applied to multi-stage wells. More specifically, the target well 620 may be divided into multiple stages that are consecutively plugged, perforated, and fractured and the monitor well 622 may be used to monitor the formation and propagation of fractures for each stage. In certain implementations, the monitor well 622 may include multiple groups of one or more pressure transducers or similar sensors distributed along the wellbore with each of the groups aligning or otherwise corresponding with a respective stage of the target well 620. Accordingly, as each stage of the target well 620 is fractured, respective responses may be observed in the monitor well 622 Nonetheless, in some implementations a limited set of sensors or simply one sensor may be used to measure responses of the monitor well.

The pressure response of the monitor well 622 may vary in applications in which multiple fractures from the target well 620 cross the monitor well 622. For example, an initial fracture may cross the monitor well 622, resulting in a first increase in pressure within the monitor well 622. When propagation of this initial fracture halts and pressure within the initial fracture begins to subside (e.g., due to fluid leak off from the fracture being greater than fluid being supplied to the fracture), a corresponding decline in pressure within the monitor well 622 may be observed. If a second fracture from the target well 620 (or other well) subsequently crosses the monitor well 622 (e.g., following a rate cycle or similar operation), a second, smaller pressure increase as compared to that observed with the initial fracture may be observed in the monitor well 622.

If a third fracture subsequently crosses the monitor well 622, the pressure response of the monitor well 622 may be dependent on the location at which the third fracture crosses the monitor well 622. For example, if the third fracture is between the first and second fractures, little to no response may be observed in the monitor well 622. However, if the third fracture is not disposed between the first and second fractures, another pressure increase may be observed in the monitor well 622.

Following a fracturing operation and, in particular, after cessation of pumping fracturing fluid into any fractures formed during such an operation, the fracturing fluid may gradually leak into the surrounding formation, which may be observed in the monitor well 622 as a gradual decline in pressure. When pressure within the monitor well 622 returns to pre-fracturing operation levels, it may be assumed that the fractures induced during the operation have closed (which may, in certain cases, require hours or days to occur). Accordingly, pressure changes within the monitor well 622 following a fracturing operation may be used to determine when closure time has occurred and when to initiate subsequent well operations.

Figure 8:
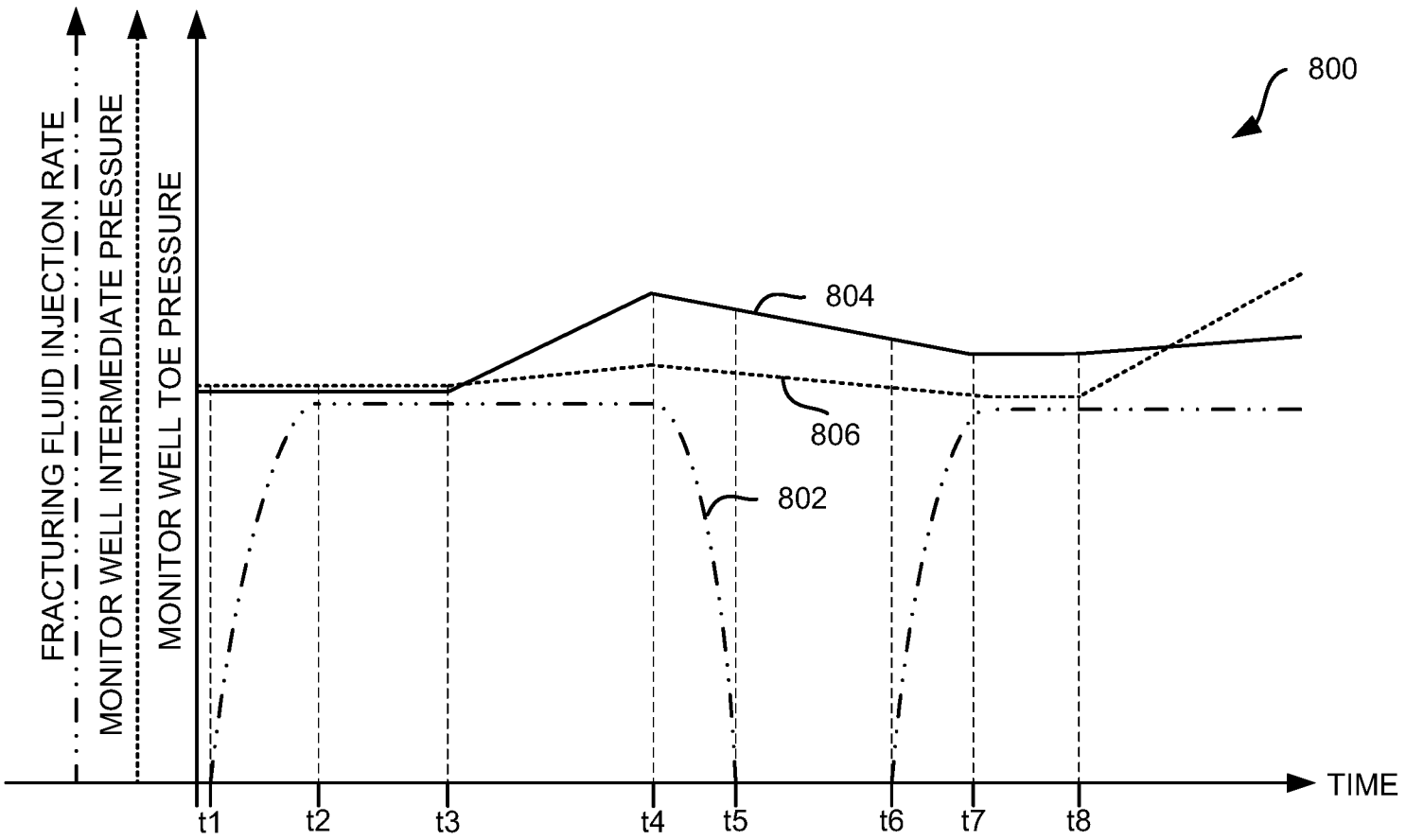
FIG. 8 is a graph illustrating a pressure response of a monitor well during an example fracturing operation of a target well.

FIG. 8 is a graph 800 illustrating an example fracturing operation consistent with the foregoing description. The graph 800 illustrates various metrics over time during an example fracturing operation. More specifically, the graph 800 includes a first line 802 indicating fracturing fluid injection rate into the target well 620, a second line 804 indicating first pressure measurements taken at a first location of the monitor well 622, and a third line 806 indicating second pressure measurements taken at a second location of the monitor well 622. For purposes of the current example, the first location of the monitor well 622 (indicated by the second line 804) is assumed to be a toe of the monitor well 622 and, as a result, the pressure measurement indicated by the second line 804 may correspond to measurements obtained from the toe pressure transducer 648. Similarly, the second location of the monitor well 622 indicated by the third line 806 is assumed to be at an intermediate location of the monitor well 622 and, as a result, the pressure measurement indicated by the third line 806 may correspond to pressure measurements obtained from the intermediate pressure transducer 650. For purposes of FIG. 8, it is assumed that the pressure lines 804, 806 correspond to pressure measurements obtained from pressure transducers disposed in respective isolated sections of the wellbore.

Referring still to FIG. 8, beginning at t1, the fracturing fluid injection rate is gradually increased to a first injection rate at time t2. During the time period between t1 and t2, the pressure in each of the first location and the second location of the monitor well 622 remains substantially constant, indicating that fractures have not yet sufficiently propagated from the target well 620 to interact with the monitor well 622.

At time t3, a pressure change is observed in each of the first and second monitor well locations, indicating that a dominant fracture from the target well 620 has sufficiently propagated toward and influenced pressure within the monitor well 622. As illustrated by the difference in slope between the toe pressure measurement line 804 and the intermediate pressure measurement line 806, the dominant fracture has likely propagated at or near the toe of the monitor well 622 and, more specifically, has approached and/or crossed the isolated section of the monitor well 622 corresponding to the toe. As previously mentioned, the location of the dominant fracture may be verified by, among other things, strain gauge readings corresponding to locations of the casing 611 of the monitor well 622.

At time t4, a rate cycle is initiated by reducing the fracturing fluid injection rate from the first rate and eventually stopping injection at time t5 (at time t5 it is also possible that the rate may be substantially reduced from the first rate (e.g., 90 barrels per minute to 10 barrels per minute)). In response, the pressures and stresses within the formation may gradually subside, as indicated by a gradual decline in the pressures observed in the monitor well and indicated by lines 804 and 806. As previously discussed, rate cycling by alternating periods of high fracturing fluid injection with low or no fracturing fluid injection may enable the development and propagation of other additional fractures extending from the target well 620 and, as a result, to promote more complete fracturing of the subsurface formation 606.

Although FIG. 7 illustrates an immediate decline in monitor well pressure in response to reducing the fracturing fluid injection rate, it should be appreciated that in certain cases a delay may be present between the reduction in injection rate and an observed pressure response in the monitor well 622. Such a delay may depend on, among other things, the leak off rate into the surrounding formation. Also, pressure within the monitor well 622 may continue to increase after reducing injection rate and even if pressure within the target well 620 decreases as fluid may continue to flow towards the tip of the fracture.

At time t6, the injection rate is increased until a target injection rate is reached at time t7. At time t7 and until time t8, there is not a pressure response in the monitor well, which may indicate that the fracture that caused the first pressure increase is not growing but rather that new fractures are propagating from the target well 620. At time t8, the pressure within the monitor well 622 is again observed as increasing, indicating that stresses induced by the injection of fracturing fluid into the target well 620 are causing corresponding pressure responses in the monitor well 622. However, unlike during the time period of t3 to t4, in which a greater response was observed in the toe of the monitor well 622, the time period beginning at t8 indicates a sharper response in the intermediate portion of the monitor well 622 and, as a result, indicates the development of fractures proximate the intermediate portion of the monitor well 622. In other words, FIG. 8 indicates that the rate cycling undertaken was successful in forming and/or propagating additional fractures from the target well 620.

As previously noted, FIG. 8 illustrates a case in which pressure lines 804 and 806 are obtained from pressure transducers disposed in respective isolated sections of a monitor well. In other implementations, however, the pressure transducers may be disposed at different locations of an open (i.e., not isolated) well or disposed in the same isolated portion of the monitor well 622. In such cases, the pressure measurements obtained from such transducers may be substantially the same (e.g., a slight offset may be present due to differences in hydrostatic head attributable to the location of the transducers within the monitor well 622) or otherwise track each other throughout the fracturing operation. Accordingly, to differentiate when new fractures cross the monitor well 622 other metrics may be required. For example and without limitation, in one implementation the location of a fracture may be approximated by determining which pressure transducer leads the other (provided the pressure transducers sample the pressure within the monitor well 622 at a sufficiently high rate). In other implementations, other sensors may be used alone or in combination with the pressure transducers to determine the location of fractures. For example, strain gauges or other force sensors disposed on the casing of the monitor well 622 may be used to determine the location of forces applied to the casing by propagating fractures.

Figure 9:
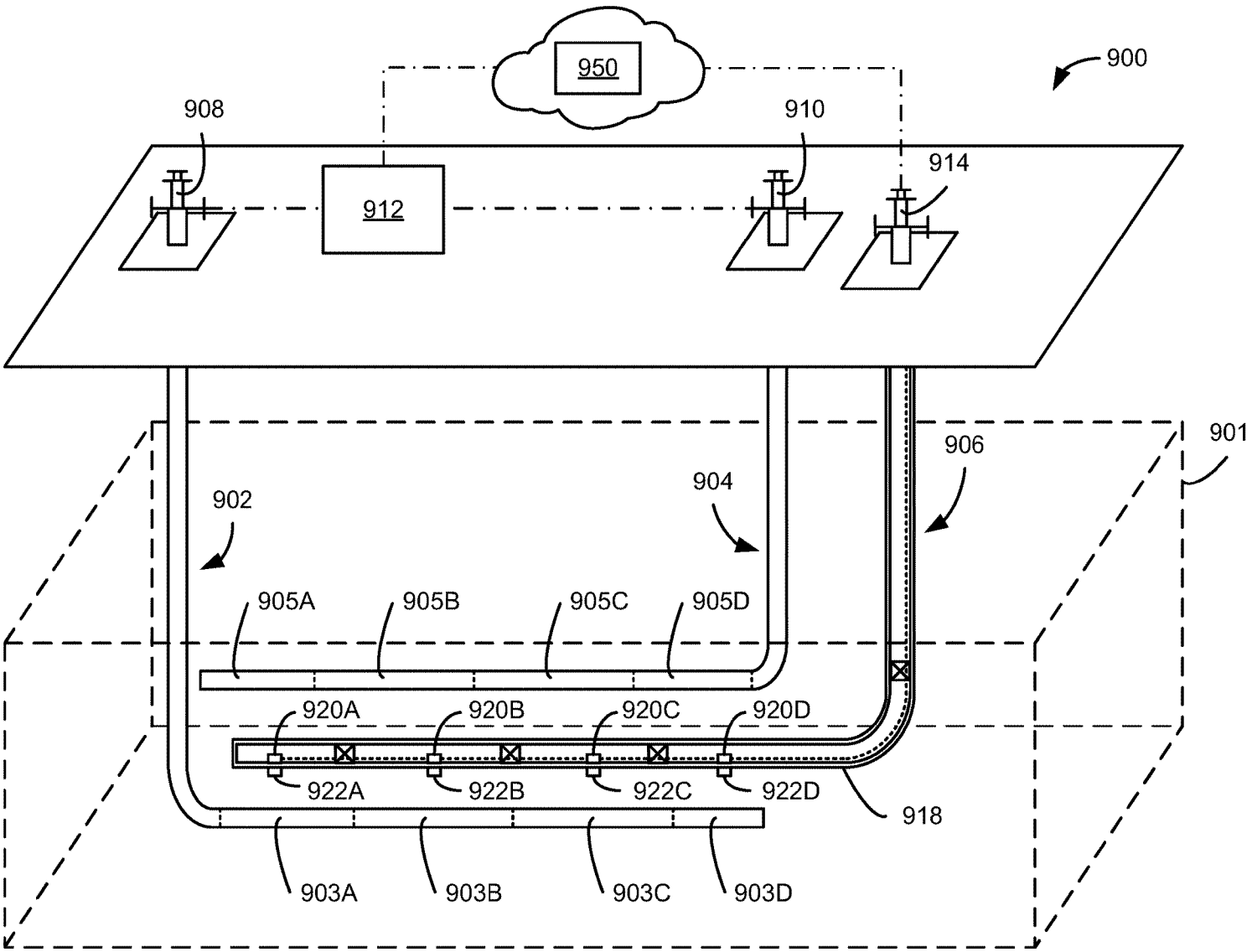
FIG. 9 is a schematic diagram of another example well completion environment including two target wells and a monitor well and illustrating a fracturing operation in accordance with the present disclosure.

FIG. 9 is a schematic illustration of an alternative well environment 900 including a first target well 902, a second target well 904, and a monitor well 906, which may be sealed, extending through a subsurface formation 901 and illustrates the use of the single monitor well 906 for monitoring and controlling fracturing operations in each of the target wells 902, 904. As illustrated, the monitor well 906 is generally disposed between the target wells 902, 904 such that the monitor well 906 may intercept fractures propagating from each of the target wells 902, 904. The monitor well 906 and each of the target wells 902, 904 are shown from substantially offset vertical sections; however, it is also possible that the monitor well 906 and target wells 902, 904 may be initiated from the same pad. Thus, the relative orientation of the wells is provided as example and should not be construed as limiting. Moreover, it should be appreciated that the location of the monitor well 906 of FIG. 9 is provided as an example and, as a result, should not be viewed as limiting. For example, in the specific context of FIG. 9, any of wells 902, 904, and 906 may be configured as a monitor well for operations conducted on the other two wells. More generally, in multi-well applications, the monitor well 906 is positioned such that it may intercept fractures extending from any number of target wells.

Each of the target wells 902, 904 is divided into a respective set of stages. More particularly, the first target well 902 is divided into stages 903A-D (from the toe to the heel of the first target well 902) and the second target well 904 is divided into stages 905A-D (from the toe to the heel of the second target well 904). During completion, each stage of each of the target wells 902, 904 may be fractured in order from the toe to the heel, the heel to the toe, or any other suitable order. Fracturing generally includes a process of isolating the stage being fractured (such as by installing a downhole isolation plug), perforating the stage, and pumping fracturing fluid into the perforations to form and propagate fractures from the active target well into the surrounding formation.

As illustrated in FIG. 9, each of the target wells 902, 904 includes a respective wellhead assembly 908, 910 adapted to be coupled to a pumping system 912. The pumping system 912 may generally include equipment adapted to control injection of fracturing fluid into the target wells 902, 904 and general processing of such fracturing fluid. Among other things, the pumping system 912 may be adapted to modify the injection rate and/or pressure of the fracturing fluid, size, and/or concentration of proppant in the fracturing fluid, concentration of any additives in the fracturing fluid, and any other similar parameter associated with injecting fracturing fluid into either of the target wells 902, 904. Although illustrated as being coupled to a shared pumping system 912, each of the target wells 902, 904 may instead by coupled to a respective pumping system, each of which is adapted to monitor and control fracturing operations for one of the target wells 902, 904. The monitor well 906 and the target wells 902, 904 are shown from substantially offset vertical sections; however, it is also possible that the wells 902-906 may be initiated from the same pad. Thus, the relative orientation of the wells is provided as example and should not be construed as limiting.

The monitor well 906 may also include a wellhead 914, may be at least partially sealed, and may be at least partially filled with a liquid, such as water, or other relatively incompressible substance to facilitate observations of pressure responses within the monitor well 906. In one implementation, the monitor well 906 may be encompassed by a casing 918 and may include one or more plugs (not shown) to seal portions of the monitor well 906. The monitor well 906 may further include various sensors disposed in the wellhead 914, along the casing 918, or within the casing 918 to monitor pressure within the monitor well 906, strain on the casing 918, and other operational parameters. For example, the monitor well 906 includes multiple pressure transducers 920A-D disposed along its length as well as corresponding strain gauges 922A-D coupled to the casing 918.

As illustrated in FIG. 9, each of the pressure transducers 920A-D is disposed in a respective isolated section of the monitor well 906. In particular bridge plugs 970A-D are installed along the length of the monitor well 906 to form the isolated sections of the monitor well 906. Nevertheless and as previously discussed in the context of FIG. 6-8, in at least some implementations of the present disclosure, the monitor well 906 may be at least partially open such that the pressure transducers 920A-D measure pressure within the same volume.

Although discussed herein as being cased but not completed, it should be appreciated that monitor wells in accordance with the present disclosure may also be at least partially completed. For example, in one implementation a partially completed (e.g., a well including at least one fracture) well may be configured as a monitor well by installing a solid bridge plug or similar isolation tool above the uppermost fracture. By doing so, a sealed portion of the well is isolated from any previously completed portions. Internal pressure of the sealed portion may then be monitored and used to assess interaction of the well with the offset wells being completed.

Each of the pumping system 912 and the various sensors and transducers of the monitor well 906 are communicatively coupled to a computing system 950. The computing system 950 is generally configured to receive measurements from the sensors of the monitor well 906 and, based on the received measurements, to control operation of the pumping system 912.

As described below in more detail, the monitor well 906 is used to monitor and facilitate fracturing operations for each of the target wells 902, 904. In one example implementation, the monitor well 906 may be used to facilitate alternate fracturing of stages of the first target well 902 with those of the second target well 904. For example, the monitor well 906 may be used to monitoring fracturing operations for the toe stage 903A of the first target well 902. In response to determining that sufficient fracturing of the toe stage 903A has occurred (e.g., by a suitable pressure response of the monitor well 906), the computing system 950 may then initiate fracturing of the toe stage 905A of the second target well 904. This process may be repeated for at least some of the remaining stages of the target wells 902, 904

As illustrated in FIG. 9, the target wells 902, 904 extend through the subsurface formation 901 in substantially opposite directions and originate from separate well pads. However, in other implementations, the target wells 902, 904 may extend adjacent to one another and/or may originate from a common well pad. For example, in so-called "zipper" fracturing operations, multiple target wells are drilled such that at least a portion of the wells are substantially parallel to one other. Such target wells may also extend from a common well pad. The stages of the target wells are then fractured alternately. For example, a first stage of a first target well is fractured followed by a first stage of a second target well followed by a second stage of the first target well, and so on. It should be appreciated that alternately fracturing the wells may include fracturing one or more stages at a time. In other words, a first set of stages may be fractured in the first well followed by a first set of stages of the second well, followed by a second set of stages of the first well, and so on, with each set of stages including one or more stages. In addition to providing a more complete fracturing of the subsurface formation through which the target wells extend, such operations may provide substantial efficiencies by allowing each well to be serviced/completed from a single well pad and/or by enabling preparation (e.g., plugging and perforating) of stages of one of the target wells during fracturing of the other.

In applications in which multiple wells may be fractured from a common well pad, the wellheads of such wells may include a manifold adapted to redirect flow of fracturing fluid between the target wells. In such cases, the manifold (or other similar valve systems for redirecting fracturing fluid flow between target wells) may also be in communication with the pumping system 912 and/or the computing system 950 such that the pumping system 912 and/or the computing system 950 may control the flow of fracturing fluid between the target wells.

Figure 10:
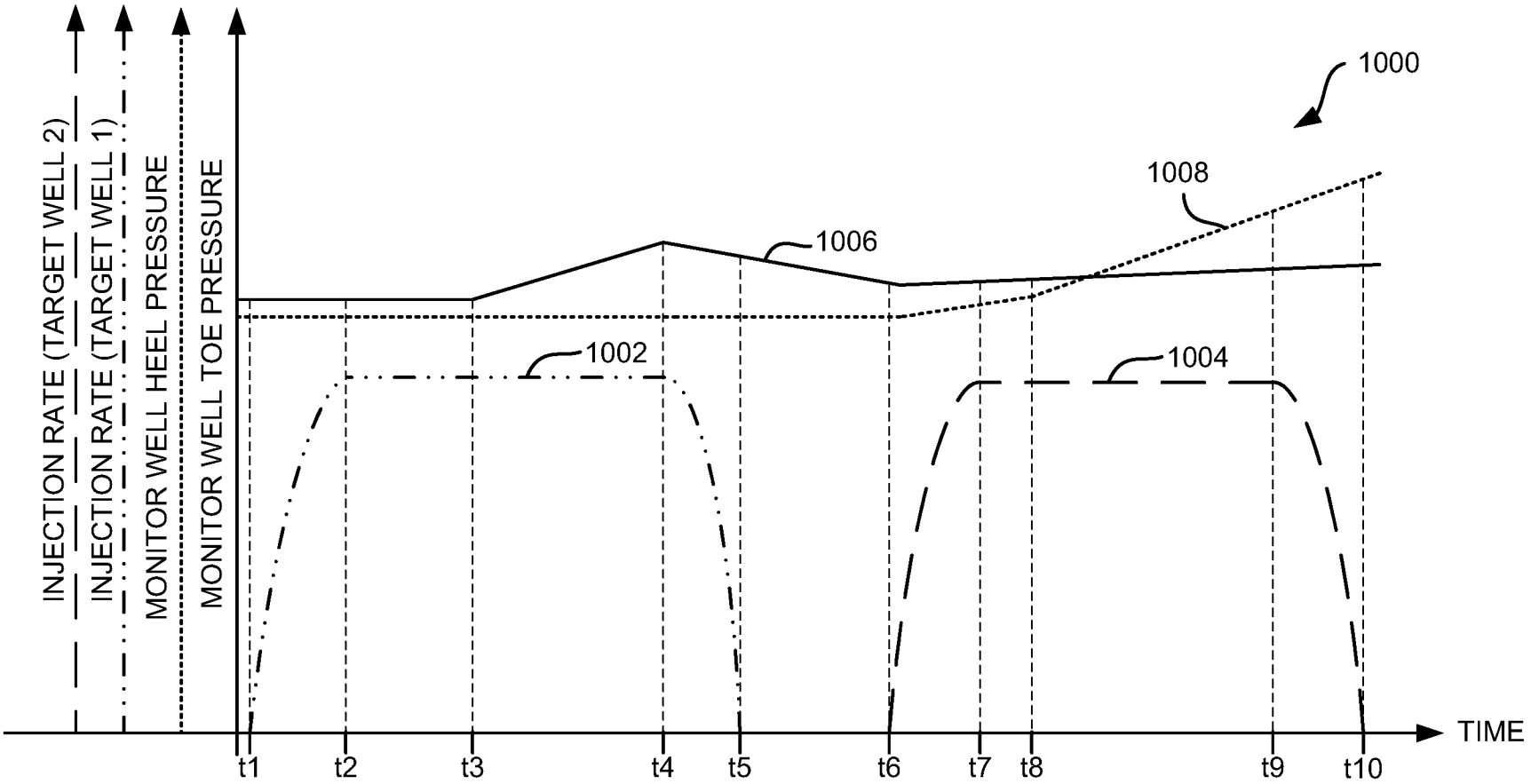
FIG. 10 is a graph illustrating a pressure response of a monitor well during an example fracturing operation of two target wells.

FIG. 10 is a graph 1000 illustrating an example fracturing operation consistent with the foregoing description of fracturing multiple target wells using a single monitor well. The graph 1000 illustrates various metrics over time during an example fracturing operation. More specifically, the graph 1000 includes a first line 1002 indicating fracturing fluid injection rate into the first target well 902, a second line 1004 indicating fracturing fluid injection rate into the second target well 904, a third line 1006 indicating first pressure measurements taken at a first location of the monitor well 906, and a fourth line 1008 indicating second pressure measurements taken at a second location of the monitor well 906. For purposes of the current example, the first location of the pressure transducer in the monitor well 906 (indicated by the third line 1006) is assumed to be at a heel of the monitor well 906 (or more specifically an isolated heel section of the monitor well 906) and, as a result, the pressure measurements indicated by the third line 1006 may correspond to pressure measurements obtained from the heel pressure transducer 920D. Similarly, the second location of the pressure transducer in the monitor well 906 (indicated by the fourth line 1008) is assumed to be at a toe of the monitor well 906 (or, more specifically, an isolated toes section of the monitor well 906) and, as a result, the pressure measurement indicated by the fourth line 1008 may correspond to measurements obtained from the toe pressure transducer 920A.

Beginning at t1, the fracturing fluid injection rate for the first target well 902 is gradually increased to a first injection rate at time t2. During the time period between t1 and t2, the pressure in each of the first location and the second location of the monitor well 906 remains substantially constant, indicating that fractures have not yet sufficiently propagated from the first target well 902 to interact with the monitor well 906.

At time t3, a pressure change is observed at the first monitor well location (i.e., the isolated heel portion of the monitor well 906), indicating that a dominant fracture from the first target well 902 has sufficiently propagated toward and influenced pressure within the monitor well 906, as measured by pressure transducer 920D. The presence of the dominant fracture from the first target well 902 may be verified by, among other things, strain gauge readings obtained from the strain gauge 922D. In contrast, the pressure measurements obtained at the toe pressure transducer 920A location (i.e., the isolated toe portion of the monitor well 906) remain relatively unchanged.

At time t4, the fracturing fluid injection rate for the first target well 902 is reduced from the first rate. In the specific illustrated example, this decrease eventually results in complete cessation of fracturing fluid being provided into the first target well 902 at time t5. Alternatively, the fracturing fluid injection rate may instead be reduced to a sufficiently low level that interactions between the first target well 902 and the monitor well 906 are significantly reduced. In either case, reducing the fracturing fluid injection rate may cause the pressures and stresses within the formation to gradually drop, as indicated by a gradual decline in the pressures observed in the heel of the monitor well 906 between times t4 and t6.

At time t6, fracturing of the second target well 904 begins. More specifically, the fracturing fluid injection rate for the second target well 904 is increased until a target injection rate is reached at time t7. At time t8, the pressure within the monitor well 906 is again observed as increasing. However, such increase is observed primarily in the isolated toe portion of the monitor well 906, indicating that dominant fractures from the toe stage 905A of the second target well 904 have sufficiently propagated to influence pressure within at least a portion of the monitor well 906. When such a response is detected, the injection of fracturing fluid into the second target well 904 may be reduced or stopped, as indicated by the transition between times t9 and t10.

The foregoing process may be repeated for additional stages of the target wells 902, 904. In other words, fracturing fluid may be injected into a stage of the first target well 902 until a sufficient pressure or other response is detected in the monitor well 906. After such a response, fracturing fluid may be diverted or otherwise provided to the second target well 904 to fracture a corresponding stage of the second target well 904. As previously discussed, during periods in which one of the target well 902, 904 is being fractured, the other target well may be prepared for a subsequent fracturing operation, such as by running wireline or similar tools to plug and/or perforate the target well not currently being fractured.

In certain cases, preparation for subsequent fracturing operations may include pumping fluid downhole. For example, plug and perforating tools are often transported downhole using a pump down operation. Such pumping activities in a previously fractured well may result in a response in the monitor well due to at least some of the fractures remaining open. Accordingly, in certain multi-well implementations of the present disclosure, differentiation must be made between monitor well responses attributable to preparation-related activities and those attributable to propagation of fractures from wells being actively fractured. In some cases, such differentiation may be achieved by identifying where the pressure response is observed. For example, if previously formed fractures from a first well crossed a toe portion of the monitor well and a second well is being actively fractured in proximity to the heel of the monitor well, pressure responses observed in the toe portion of the monitor well during both preparation activities in the first well and active fracturing of the second well may be disregarded (or otherwise not attributed to the active fracturing of the second well).

While the pressure transducers in the foregoing example are described as being in isolated sections of the monitor well, it should be appreciated that in other implementations, the pressure transducers may be disposed at different locations of an open (i.e., not isolated) well or disposed in the same isolated portion of the monitor well. In such cases, the pressure measurements obtained from such transducers may be substantially the same or otherwise track each other. Accordingly, to differentiate when new fractures cross the monitor well and, in particular, when fractures originate from a first well of a multi-well operation versus a second well, other metrics may be required. For example and without limitation, in one implementation the location of a fracture may be approximated by determining which pressure transducer leads the other. In other implementations, other sensors may be used alone or in combination with the pressure transducers to determine the location of fractures. For example, strain gauges or other force sensors disposed on the casing of the monitor well may be used to determine the location of forces applied to the casing by propagating fractures. In either case, the location of fractures crossing the monitor well in combination with known information regarding the location of the wells being fractured and likely fracture propagation paths for each well, may be used to identify when fractures from a given well have crossed the monitor well.

Figure 11:
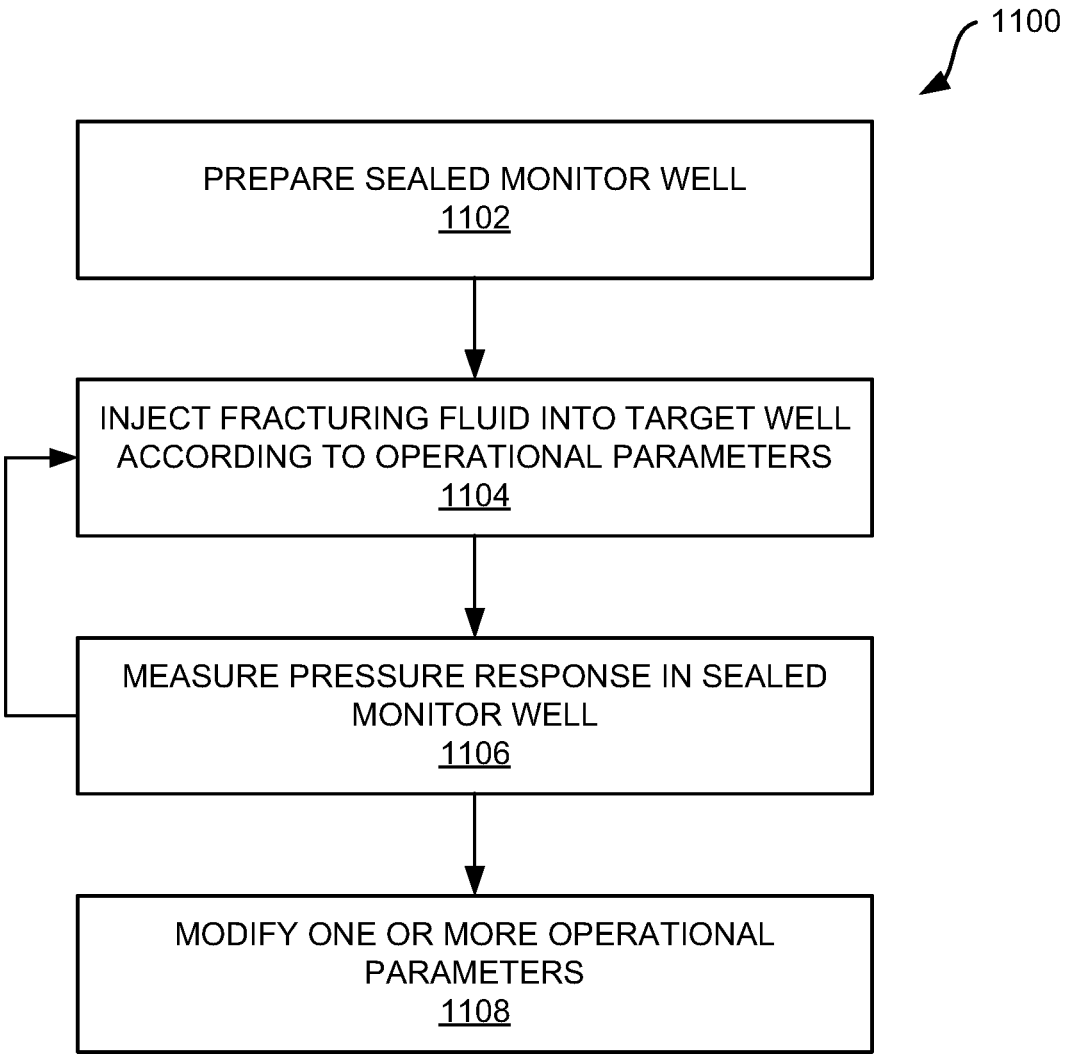
FIG. 11 is a flow chart illustrating a method of performing a fracturing operation in accordance with the present disclosure.

FIG. 11 is a flow chart illustrating an example method 1100 of fracturing one or more target wells in a subsurface formation. In general, such fracturing is facilitated by a monitor well that extends through the subsurface formation. More specifically, the monitor well is positioned relative to the target well(s) such that as fractures propagate through the subsurface formation and induce stresses therein, a corresponding pressure response is observable within the monitor well. Based on such pressure responses, parameters of the fracturing operation may be dynamically modified.

At operation 1102 the monitor well is prepared. Preparation of the monitor well may include one or more of drilling the monitor wellbore, installing a casing within the monitor well and sealing a portion of the monitor wellbore. To improve the pressure response of the monitor well, the monitor well may also be filled with a liquid, such as water. Accordingly, preparation of the monitor well may further include injecting liquid into the monitor well. Injecting liquid into the monitor well may also facilitate the removal of gases and other relatively compressible fluids from within the monitor well that may negatively impact the responsiveness of the monitor well. Preparation of the monitor well may also include installation of subsurface transducers in the monitor well and/or splitting the monitor well into two or more separate pressure chambers, each with its own transducer, to monitor individual, isolated pressure responses at specific locations along the monitor well.

In implementations in which preparation of the monitor wellbore includes actual drilling to the monitor wellbore, such drilling may be performed to locate the monitor well such that the monitor well extends through a plane perpendicular to at least a portion of the intended target well. For example, the monitor wellbore may be drilled to be at least partially parallel to the target well. In implementations in which multiple target wells are to be fractured, the monitor well may be drilled to extend between the target wells or it may be located such that all target wells are on one side of the monitor well. In general, however, the monitor well may be drilled such that the monitor well extends through a location in the subsurface formation through which fractures of the target well are likely to propagate or within which stresses are likely to be induced during fracturing of the target well.

With the monitor well prepared, a fracturing fluid is pumped into the target well according to one or more fracturing operation parameters (operation 1104). As fracturing fluid is pumped into the target well resulting in formation and/or propagation of fractures from the target well and, more specifically, from perforations formed in the target well.

As the fractures propagate through the subsurface formation, they extend toward the monitor well and induce a measured pressure response within the monitor well (operation 1106). To measure the pressure response, the monitor well includes one or more pressure transducers or similar sensors configured to measure pressure within the monitor well and to communicate such measurements to a computing system. One or more pressure transducers may be distributed along the monitor well and/or may be located within a wellhead of the monitor well. In general, the measured pressure response may correspond to any change in pressure within at least a portion of the monitor well. For example and without limitation, the measured pressure response may be an absolute change in pressure, a relative change in pressure, an increase or decrease in a rate of pressure change, or any other pressure-related metric.

In certain implementations, one or more additional sensors may be used to verify and locate the pressure response. For example, and without limitation, one or more strain gauges may be disposed along the casing of the monitor well to measure deformation of the casing in response to stresses induced in the subsurface formation during fracturing operations. Like the measured pressure response, the measured strain response may be considered to indicate a fracture if a measured strain response meets certain criteria. For example, and without limitation, the measured strain response may correspond to an absolute change in strain, a relative change in strain, an increase or decrease in a rate of change of strain, or any other strain-related metric.

As illustrated in FIG. 11, the process of injecting fracturing fluid (operation 1104) and measuring the pressure response within the monitor well (operation 1106) may be repeated until, for example, a particular response (e.g., a pressure increase, a pressure decrease, a rate of pressure change, etc.) is measured. In response to identifying and optionally verifying the pressure change response within the monitor well, one or more of the fracturing operation parameters may be modified (operation 1108). In one example implementation, modifying the fracturing operation parameters may include reducing the fracturing fluid injection rate, including reducing the injection rate to zero. Modifying the fracturing operation parameters may also include, without limitation, one or more of modifying the injection rate and/or pressure of the fracturing fluid, modifying the size and/or concentration of proppant in the fracturing fluid, changing a concentration of any additives in the fracturing fluid, and changing any other similar parameter associated with injecting fracturing fluid into the target wells.

In one example implementation, modifying the fracturing operation parameters may include each of reducing an injection rate for a first target well and increasing an injection rate for a second target well. In implementations in which each of the first target well and the second target well are coupled to respective pumping systems, each pumping system may be controlled to change the injection rates. In other implementations in which fracturing fluid is provided to both target wells from a common pumping system, modifying the injection rates for the target wells may include actuating one or more valves or similar fluid control devices to adjust the proportion of fracturing fluid delivered to each target well.

Additional aspects of fracturing operations and monitoring of fracturing operations according to the present disclosure are provided in U.S. patent application Ser. Nos. 16/362,214 and 15/879,187, each of which is incorporated herein by reference in their entirety and for all purposes.

As noted above, an operator may use sealed monitor wells or sealed portions of a monitor well to identify propagation of fractures from other wells within the same formation due to interactions between the fractures and the monitor well. For example, as a fracture propagates through the formation, resulting forces may be transferred from the propagating fracture, through the formation (e.g., due to poroelastic coupling of the monitor well and fracture or other modes of energy transfer between the fracture and monitor well) and to the monitor well casing. Such forces may cause deformation of the monitor well casing, reducing the internal volume of the monitor well wellbore. To the extent the monitor well is sealed or flow from the monitor well is otherwise restricted, such changes to the internal volume of the monitor well may result in an observable pressure increase within the monitor well, among other indications. However, the pressure response in the monitor well may be subtle and, as a result, detection of the response may be subject to other forces and phenomena. For example, temperature changes within the monitor well may cause fluid within the monitor well to expand, thereby increasing pressure within the monitor well. Such temperatures changes may be the result of fluid disposed within the monitor well (including fluid added to the monitor well) being heated by the surrounding subsurface formation. Generally speaking, aspects of the present invention involve monitoring fluid flow from a well, which fluid flow may be due in part from pressure changes due to conditions within the well such as temperature, and differentiating between the conditions induced fluid flow and fracture driven fluid flow to isolate and otherwise detect fracture interactions within a well.

More particularly, to account for thermally induced pressure changes within the monitor well, the present disclosure includes a fracture monitoring system that relies on fluid flow to identify interactions between the monitor well and fractures of a target well. The fracture monitoring system generally includes a flow meter and corresponding controller for measuring flow from a pressure control valve configured to control pressure within the monitor well. More specifically, when pressure increases within the well, the pressure control valve opens, a portion of fluid from within the monitor well exits through the pressure control valve, and the flow meter measures one or more attributes of the flow from the monitor well. Based on the attribute, the controller determines whether the flow is the result of thermally induced flow or other factors, such as interaction with a fracture from a target well. In certain implementations, such determinations are made by obtaining a baseline value or measurement for an attribute of flow measured by the flow meter before initiating a fracturing operation. The controller then compares the baseline to subsequently obtained values or measurements for the attribute. To the extent the controller determines the later obtained value/measurement is inconsistent with the baseline value/measurement or otherwise meets a similar criteria, the controller may transmit an indicator, such as a message or command signal, indicating interaction between the monitor well and the fracture has occurred. When received by a well monitoring system, the indicator may generate an alert for personnel to address, initiate or otherwise be involved with modifying fracturing operations, or perform other similar functions.

Figure 12:
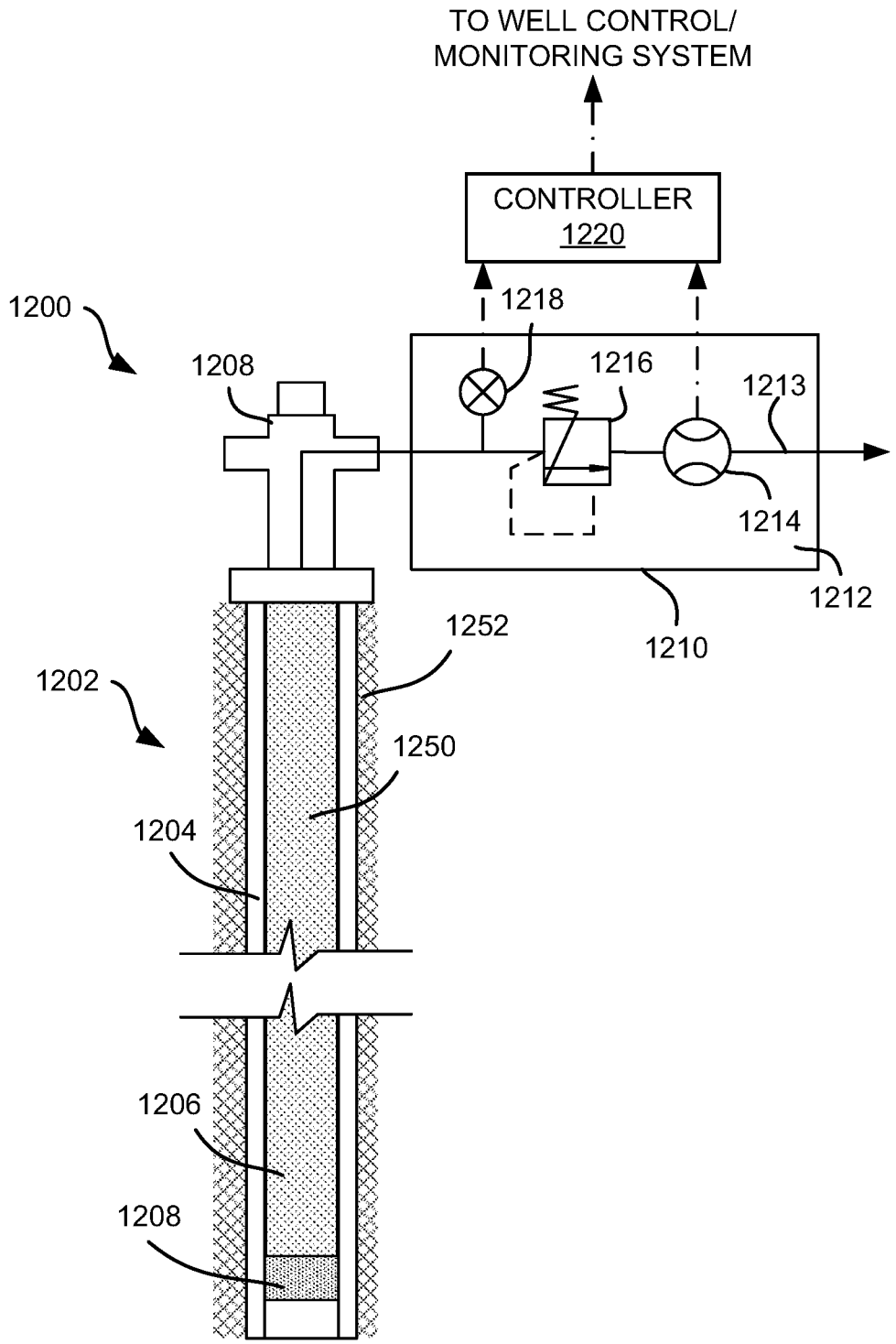
FIG. 12 is a schematic illustration of a well environment including a monitor well having a fracture monitoring system according to the present disclosure.

FIG. 12 is an illustration of a well environment 1200 including a monitor well 1202 in a subsurface formation 1252. Monitor well 1202 includes a wellbore 1206 including a casing 1204 extending through subsurface formation 1252 and an optional downhole packer/plug 1209. Monitor well 1202 further includes a wellhead 1208 that caps wellbore 1206 and through which fluids may be extracted or introduced into wellbore 1206.

As discussed herein, monitor well 1202 may be used to detect fracture propagation from a target well in subsurface formation 1252. More specifically, as fractures propagate from the target well during a fracturing operation, forces are transferred from the fractures, through subsurface formation 1252, and to casing 1204. The transferred forces squeeze casing 1204, simultaneously decreasing the volume of wellbore 1206 and increasing pressure within wellbore 1206. Accordingly, by monitoring for certain changes in monitor well 1202, monitor well 1202 can be used to analyze propagation of fractures from the target well and to control fracturing operations accordingly.

In certain implementations, the response of monitor well 1202 can be improved by substantially sealing wellbore 1206 of monitor well 1202 (or a monitoring portion of monitor well 1202) and filling wellbore 1206 with a fluid 1250, such as, but not limited to water or fracturing fluid, and which may be in a substantially liquid state. Among other things, substantially sealing wellbore 1206 controls for various external factors and provides a baseline wellbore condition against which changes resulting from interactions with a target well fracture can be readily identified. Filling wellbore 1206 with a liquid (e.g., water), on the other hand, generally improves the responsiveness of monitor well 1202 to such interactions. In contrast, when wellbore 1206 includes an air gap or similar gas at its head, the relative compressibility of the gas compared to a liquid may make changes in wellbore 1206 harder to identify versus when wellbore 1206 is substantially filled with a liquid. Nevertheless, in certain implementations, an air gap may be present within wellbore 1206. In such implementations, flow meter 1214 may be adapted to measure one or both of gas and liquid flow from wellbore 1206.

Although sealing monitor well 1202 and filling monitor well 1202 with a liquid are beneficial, thermal changes in fluid 1250 can obfuscate the presence and/or cause of pressure changes in monitor well 1202. Typically, fluid 1250 is injected into wellbore 1206 at a temperature that is below, and sometimes substantially below, a temperature of subsurface formation 1252. Accordingly, after injection, fluid 1250 is heated by subsurface formation 1252. Such heating causes an expansion of fluid 1250 (or gaseous components of fluid 1250) and, if monitor well 1202 is sealed, a corresponding pressure increase within wellbore 1206. Such thermally induced pressure changes to monitor well 1202 may obfuscate pressure changes due to interactions with fractures extending from the target well. Stated differently, in certain cases, fracture-induced changes in monitor well 1202 may be incorrectly attributed to thermal expansion of fluid 1250, while in other cases, thermally induced changes in monitor well 1202 may be incorrectly identified as fracture-induced changes.

The problem of distinguishing between thermally induced and fracture-induced pressure changes in monitor well 1202 may be particularly pronounced shortly after initial injection of fluid into wellbore 1206. In most contexts, the temperature difference between fluid 1250 and subsurface formation 1252 would be relatively high at that time. As a result, substantial heat transfer from subsurface formation 1252 to fluid 1250 may occur, contributing to substantial pressure changes within wellbore 1206. If a fracturing operation were to be conducted while fluid 1250 is undergoing substantial expansion, contributions of fractures from the target well to pressure within wellbore 1206 may be difficult to distinguish from pressure changes caused by thermal expansion of fluid 1250 based on pressure measurements alone. Accordingly, if an operator were to rely exclusively on pressure measurements to monitor fracture propagation, the operator may attribute fracture-induced pressure changes to thermal expansion or vice versa.

To address the foregoing issues, among others, monitor well 1202 includes a fracture monitoring system 1210 that controls pressure within wellbore 1206 and identifies interactions between monitor well 1202 and fractures from target wells based on flow. As illustrated, fracture monitoring system 1210 generally includes a device body 1212 that may be coupled to an outlet of wellhead 1208 and that may define a flow path 1213 between wellhead 1208 and an outlet of fracture monitoring system 1210. Fracture monitoring system 1210 further includes each of a flow meter 1214, a pressure control valve 1216, and a pressure sensor 1218 in communication with flow path 1213. In certain implementations, a controller 1220 or similar computing device may be communicatively coupled to one or more components of fracture monitoring system 1210 to receive signals/data and/or control the one or more components. For example, controller 1220 is shown in FIG. 12 as being communicatively coupled to each of flow meter 1214 and pressure sensor 1218 to receive flow measurements from flow meter 1214 and pressure measurements from pressure sensor 1218. Controller 1220 may also be configured to communicate with a well control/monitoring system or similar centralized computing system. Notably, while illustrates as being a separate component attached to wellhead 1208, in other implementations, fracture monitoring system 1210 may be coupled to wellhead 1208 by being integrated with wellhead 1208.

When in use, pressure control valve 1216 is configured to maintain wellbore 1206 at a predetermined pressure by permitting flow from wellbore 1206 when wellbore 1206 exceeds the predetermined pressure. To do so, pressure control valve 1216 is set at the predetermined pressure. While wellbore 1206, or whatever wellbore feature connected to the valve and in fluid communication with the wellbore, is below the set pressure of pressure control valve 1216, pressure control valve 1216 remains closed and wellbore 1206 remains sealed. When pressure within wellbore 1206 exceeds the set pressure of pressure control valve 1216, pressure control valve 1216 opens, permitting flow of fluid 1250 through device body 1212. When pressure within wellbore 1206 subsequently drops, pressure control valve 1216 closes, resealing wellbore 1206.

Flow meter 1214 is in-line with and downstream of pressure control valve 1216 and is configured to measure attributes of liquid passing through pressure control valve 1216 when pressure control valve 1216 is in an open state. Measurements obtained from flow meter 1214 may be transmitted to and processed by controller 1220, which, in turn, may be configured to discriminate between thermally induced flow changes and flow changes from interactions between monitor well 1202 and a fracture extending from a target well.

Pressure sensor 1218 may be included in certain implementations and may generally be used to verify pressure within wellbore 1206, as controlled by pressure control valve 1216. As illustrated, pressure sensor 1218 is also in communication with controller 1220 and may be configured to transmit signals to controller 1220 that correspond to pressure measurements obtained by pressure sensor 1218.

In at least certain implementations, installation, and configuration of fracture monitoring system 1210 may include removing gas from wellbore 1206, e.g., eliminating an air gap at a top of pressure control valve 1216. To do so, additional liquid may be injected into wellbore 1206, wellbore 1206 may be vented through wellhead 1208, etc. Alternatively, fluid 1250 may be permitted to undergo an initial expansion, e.g., from formation heating, prior to closing pressure control valve 1216, thereby pushing out any gas that may otherwise form an air gap within wellbore 1206.

Figure 13:
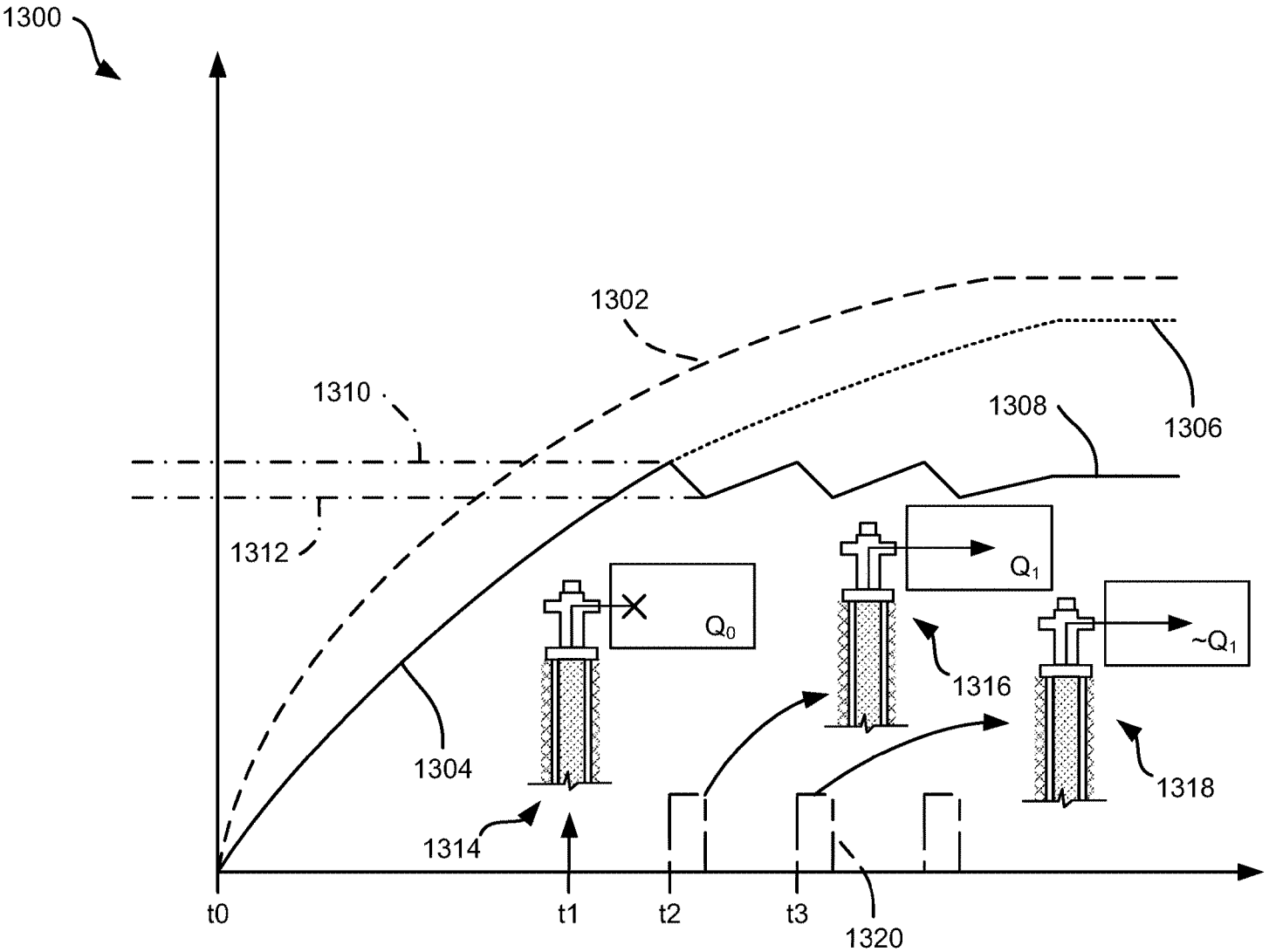
FIG. 13 is a graph illustrating pressure and temperature changes in a monitor well and corresponding flow through a fracture monitoring system according to the present disclosure during warming of fluid within the monitor well.

FIG. 13 is a graph 1300 illustrating various parameters of monitor well 1202 preceding a fracturing operation of a target well in subsurface formation 1252. Graph 1300 is described with reference to well environment 1200 of FIG. 12 with specific reference to monitor well 1202, fracture monitoring system 1210, and their respective elements.

Graph 1300 includes a temperature line 1302 indicating temperature of fluid 1250 within monitor well 1202. Graph 1300 further includes a pressure line 1304 indicating pressure within monitor well 1202. As described below, pressure line 1304 is further illustrated as splitting into uncontrolled pressure line 1306 and controlled pressure line 1308. Graph 1300 is intended to illustrate general operating principles of fracture monitoring system 1210 in the context of monitor well 1202. Accordingly, graph 1300 and the example data represented in graph 1300 are intended for explanatory purposes only and should not limit the present disclosure. In general, the horizontal axis of graph 1300 indicates time while the vertical axis indicates a suitable value for the parameters represented by the various lines of graph 1300.

Time t0 of graph 1300 indicates a time after injection of fluid 1250 into monitor well 1202. Typically, liquid injected into monitor well 1202 will be at a temperature substantially below the temperature of subsurface formation 1252. Accordingly, as time progresses, fluid 1250 will increase in temperature until it becomes substantially isothermal with subsurface formation 1252. This temperature change is generally indicated by the gradual increase in temperature line 1302 over time until ultimately plateauing at a final temperature.

While monitor well 1202 remains sealed, the increase in temperature of fluid 1250 results in a corresponding increase in pressure within monitor well 1202, as illustrated by pressure line 1304. Absent venting or pressure relief, pressure within monitor well 1202, like temperature within monitor well 1202, may eventually settle as fluid 1250 becomes isothermal with subsurface formation 1252. This trend is illustrated by uncontrolled pressure line 1306, which increases with temperature line 1302 and eventually reaches a steady state as fluid 1250 similarly reaches its plateau.

When fracture monitoring system 1210 is implemented, pressure within monitor well 1202 is controlled such that pressure within monitor well 1202 is maintained at approximately a set point of pressure control valve 1216. More specifically, pressure control valve 1216 is configured to open in response to pressure within monitor well 1202 reaching/exceeding a cracking or opening pressure of pressure control valve 1216 (indicated by cracking pressure line 1310). When opened pressure control valve 1216 permits flow to exit monitor well 1202 through device body 1212 of fracture monitoring system 1210 along flow path 1213. As fluid exits monitor well 1202 and provided the volume of fluid exiting monitor well 1202 exceeds volumetric expansion of fluid 1250 within monitor well 1202, pressure within monitor well 1202 reduces. When pressure within monitor well 1202 drops to or below a reseal pressure (indicated by reseal pressure line 1312), pressure control valve 1216 closes, allowing pressure to rebuild within monitor well 1202 until it again exceeds the cracking pressure of pressure control valve 1216. In the example illustrated, the pressure begins to decrease after the valve is opened; however, it should be recognized that the change in pressure and rate of change in pressure will depend on various factors including whether temperature of the fluid is continuing to rise in which case the pressure may be steady for some time or decrease at a lesser rate than when the temperature of the fluid has equalized with the formation temperature.

As shown by controlled pressure line 1308, the general operating cycle of pressure control valve 1216 may be repeated as fluid temperature within monitor well 1202 increases due to heating of fluid 1250 by subsurface formation 1252. Stated differently, as temperature of fluid 1250 increases and fluid 1250 expands, pressure control valve 1216 occasionally opens to permit fluid flow from monitor well 1202. As a result, pressure control valve 1216 prevents pressure within monitor well 1202 from exceeding the cracking pressure of pressure control valve 1216 for any substantial period of time.

Graph 1300 includes a series of insets further illustrating operation of fracture monitoring system 1210. Inset 1314 illustrates monitor well 1202 and fracture monitoring system 1210 at a time t1 in which flow is not permitted through fracture monitoring system 1210. More specifically, at time t1, pressure within monitor well 1202 is substantially below the cracking pressure of pressure control valve 1216. As a result, pressure control valve 1216 remains sealed, thereby sealing monitor well 1202, preventing flow through fracture monitoring system 1210 (as indicated by flow rate $Q_0$), and permitting pressure within monitor well 1202 to continue to rise with temperature. In contrast, inset 1316 illustrates monitor well 1202 and fracture monitoring system 1210 while pressure control valve 1216 is open (beginning at time t2). More specifically, inset 1316 illustrates monitor well 1202 and fracture monitoring system 1210 after pressure within monitor well 1202 reaches/exceeds the cracking pressure of pressure control valve 1216. As a result, pressure control valve 1216 opens and permits flow through fracture monitoring system 1210, as indicated by flow rate $Q_1$ and flow line 1320. Flow line 1320 may generally correspond to a flow measurement obtained by flow meter 1214. As noted above, operation of pressure control valve 1216 may be cyclical in that pressure control valve 1216 may open to relieve pressure of monitor well 1202 as temperature increases within monitor well 1202. Consistent with such operation, inset 1318 illustrates monitor well 1202 and fracture monitoring system 1210 during a subsequent portion of the operating cycle in which pressure control valve 1216 is open (beginning at time t3), thereby allowing flow through fracture monitoring system 1210, as indicated by flow line 1222.

As illustrated by controlled pressure line 1308, when flow through pressure control valve 1216 exceeds volumetric expansion of fluid 1250 within monitor well 1202, pressure within monitor well 1202 may oscillate between the cracking and set pressures of pressure control valve 1216. Alternatively, if the volume of fluid 1250 increases at a rate greater than the flow rate through pressure control valve 1216, pressure within monitor well 1202 may continue to rise even through 1216 may be open. Nevertheless, as fluid 1250 becomes isothermal with subsurface formation 1252, flow through pressure control valve 1216 will eventually exceed volumetric expansion of fluid 1250 within monitor well 1202 and pressure within monitor well 1202 will drop below the cracking pressure of pressure control valve 1216.

Notably, flow through fracture monitoring system 1210 during the state illustrated in inset 1318 may be like flow through fracture monitoring system 1210 during the state illustrate in inset 1316. Accordingly, flow through fracture monitoring system 1210 in inset 1318 is indicated as having a flow rate of $\sim Q_1$. More generally, flow through fracture monitoring system 1210 as illustrated in inset 1318 may have similar values for flow attributes to flow through fracture monitoring system 1210 as illustrated in inset 1316. As a result, each of flow through fracture monitoring system 1210 as illustrated in inset 1318 and flow through fracture monitoring system 1210 as illustrated in inset 1316 may be attributed to thermal changes in monitor well 1202.

Even more generally, characteristics and attributes of flow through fracture monitoring system 1210 prior to initiation of a fracturing operation in a target well may be used to provide information useful in distinguishing thermally induced flow through fracture monitoring system 1210 from non-thermally induced flow though fracture monitoring system 1210 (e.g., due to fracture interaction). For example, measurements obtained by fracture monitoring system 1210 preceding a fracturing operation may be used to determine a range, a maximum, a minimum, statistical measurements (e.g., standard deviation), or any other value corresponding to thermally induced flow through fracture monitoring system 1210. Such values may then be used to establish thresholds, inform models, etc., against which subsequent measurements obtained during fracturing can be tested or otherwise compared. To the extent the subsequent measurements conform to the values observed prior to fracturing, fracture monitoring system 1210 may determine that a fracture has not yet interacted with monitor well 1202. In contrast, if the measurements deviate from the values established prior to fracturing, fracture monitoring system 1210 may determine that such measurement are the result of a fracturing interacting with monitor well 1202.

In at least certain implementations, controller 1220 may perform the operations of obtaining values/measurements for a flow attribute of interest and determining a baseline indicative of thermally induced flow through fracture monitoring system 1210. For example, controller 1220 may receive measurements from flow meter 1214 prior to initiating a fracturing operation of the target well to establish a trend, a range, a pattern, etc. for flow absent a fracturing operation. Such data may then be used to compare subsequently obtained measurements during a fracturing operation. When controller 1220 determines a measurement obtained during fracturing substantial deviates from the baseline, controller 1220 may determine that such deviation is the result of interactions between a fracture and the monitor well and transmit a corresponding indicator. In other implementations, controller 1220 may be provided with or access values, ranges, thresholds, etc., indicative of fracture interactions and may compare measurements obtained during a fracturing operation with such values.

Figure 14:
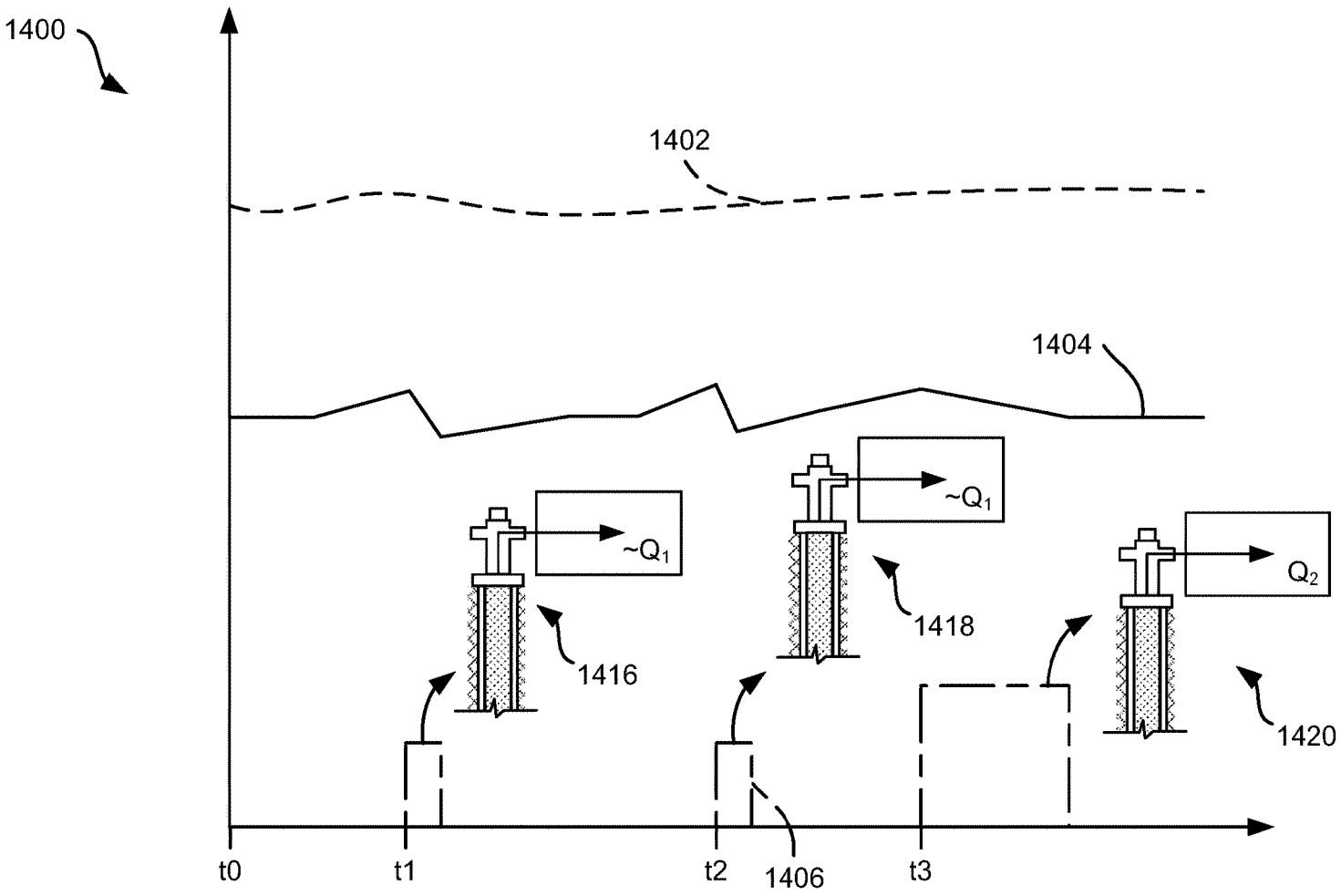
FIG. 14 is a graph illustrating pressure and temperature changes in a monitor well and corresponding flow through a fracture monitoring system according to the present disclosure including during interactions between fractures of a target well and the monitor well.

FIG. 14 is a graph 1400 illustrating various parameters of monitor well 1202 prior to and including interaction between monitor well 1202 and a fracture of a target well. Graph 1400 is described with reference to well environment 1200 of FIG. 12 with specific reference to monitor well 1202 and fracture monitoring system 1210 and their respective elements. Like graph 1300, graph 1400 includes a temperature line 1402 and a pressure line 1404 indicating temperature and pressure within monitor well 1202, respectively, with pressure line 1404 corresponding to a controlled pressure within monitor well 1202, e.g., a pressure subject to control by pressure control valve 1216. Graph 1400 further includes a flow line 1406 indicating flow through pressure control valve 1216 of fracture monitoring system 1210.

At time to, monitor well 1202 is in a substantially steady state. Nevertheless, as shown in graph 1400 and by temperature line 1402, temperature within monitor well 1202 may fluctuate, and pressure control valve 1216 may occasionally relieve any pressure buildup within monitor well 1202 that results. Graph 1400 includes inset 1416 and inset 1418, each of which illustrates monitor well 1202 and fracture monitoring system 1210 during relief of thermally induced pressure increases within monitor well 1202 (and beginning at times t1 and t2, respectively). As illustrated, flow through fracture monitoring system 1210 is indicated as ~$Q_1$ and may be substantially like other flow caused by thermal changes in monitor well 1202, e.g., flow illustrated in inset 1316 and inset 1318 of graph 1300.

At time t3, a third flow occurs through fracture monitoring system 1210 as illustrated in inset 1420. The flow beginning at time t3 is notably different than the flows beginning at times t1 and t2 and, as a result, is labeled as $Q_2$ in inset 1420. More specifically, flow at time t3 has each of an increased duration, an increased flow rate, and an increased total volume as compared to the flows occurring at times t1 and t2. As a result, and based on one or more of these differences, controller 1220 may distinguish the flow at time t3 from the thermally induced flows at times t1 and t2. Controller 1220 may further determine or identify the flow beginning at time t3 as being the result of interactions between monitor well 1202 and a fracture extending from a target well in subsurface formation 1252.

In response to identifying fracture propagation, controller 1220 may generate a signal, message, or other indicator noting the arrival of a fracture at or near monitor well 1202. In certain implementations, the indicator may be received by a well control/monitoring system. When the indicator is received, the well control/monitoring system may generate an alert, alarm, or similar response to notify personnel of the fracture status such that personnel may initiate a subsequent phase of a well completion operation. Alternatively, the indicator may cause well control/monitoring system to automatically modify a fracturing operation parameter. For example, in certain implementations, receiving an indicator corresponding to interaction between a fracture and monitor well 1202 may cause the well control/monitoring system to stop a fracturing operation (e.g., by stopping a pump or pumping system), to initiate a rate cycle, to modify a fracturing fluid, or to perform other similar operations automatically.

The term "indicator" as used herein in the context of computing device communications refers to an instance of communication and is not intended to be limited to any specific mode or type of communication. For example, in certain cases, an indicator may be an analog or digital control signal, that, when received by another device, modifies operation of the receiving device. In such instances, generating and transmitting the indicator may include generating the control signal and sending the control signal to the receiving device, respectively. In other implementations, an indicator may correspond to a change to a table, a database, a variable, or other data accessible by other devices. In such instances, generating the indicator may include computing or otherwise determining the value for the change and transmitting the indicator may include initiating the process to update the data. In still other implementations, an indicator may correspond to a message in accordance with any suitable protocol and transmitting the indicator may include sending the message directly to one or more devices, broadcasting the message, or otherwise sending the message for receipt by other devices. An indicator may be received directly and/or accessed (e.g., read from a database) by a device. When received or accessed, an indicator may cause the receiving/accessing device to automatically perform one or more processes. For example, in certain cases, receiving an indicator may cause the receiving device to automatically control operation of one or more pieces of equipment in communication with the receiving device. In other cases, receiving an indicator may cause the receiving device to update a display, a user interface, or other output modality to communicate information to a user of the receiving device.

FIG. 14 describes the application of fracture monitoring system 1210 in measuring interactions between fractures and monitor well 1202 after fluid 1250 has become substantially isothermal with subsurface formation 1252. However, similar techniques may also be used to identify fracture interactions while fluid 1250 is undergoing heating by subsurface formation 1252 and has not yet become isothermal with subsurface formation 1252.

For example, prior to initiating fracturing of the target well and during heating of fluid 1250, fracture monitoring system 1210 may obtain measurements for one or more flow attributes as fluid exits wellbore 1206 through fracture monitoring system 1210. Such measurements may be used to establish trends in the flow attribute and associate those trends with thermal changes. For example, as fluid 1250 is warmed by subsurface formation 1252, flow rate or flow volume for any given period in which pressure control valve 1216 is open may decrease over time. As another example, the time between flow events (i.e., the time between pressure control valve 1216 opening) may increase and/or the duration of flow events (i.e., the time pressure control valve 1216 remains open) may decrease.

With the foregoing in mind, fracture monitoring system 1210 may be configured to determine when one or more measurements obtained during a fracturing operation are inconsistent with previously observed trends. For example, during fracturing, fracture monitoring system 1210 may determine that pressure control valve 1216 opened to permit flow before predicted by the thermally induced trend. As another example, fracture monitoring system 1210 may determine that a given period of flow lasted longer or produced greater flow volume than predicted by the thermally induced trend. In each of the foregoing examples, deviation from the corresponding thermally induced trend may generally indicate that the cause is something other than thermal expansion within monitor well 1202. Accordingly, even though fluid 1250 may not be isothermal with subsurface formation 1252, fracture monitoring system 1210 may nevertheless distinguish between thermally induced pressure changes/flow from monitor well 1202 and pressure changes/flow resulting from other causes, such as fracture interactions. As a result, fracture monitoring system 1210 can be used to monitor fracture propagation without necessarily waiting for fluid 1250 to become isothermal with subsurface formation 1252.

Figure 15:
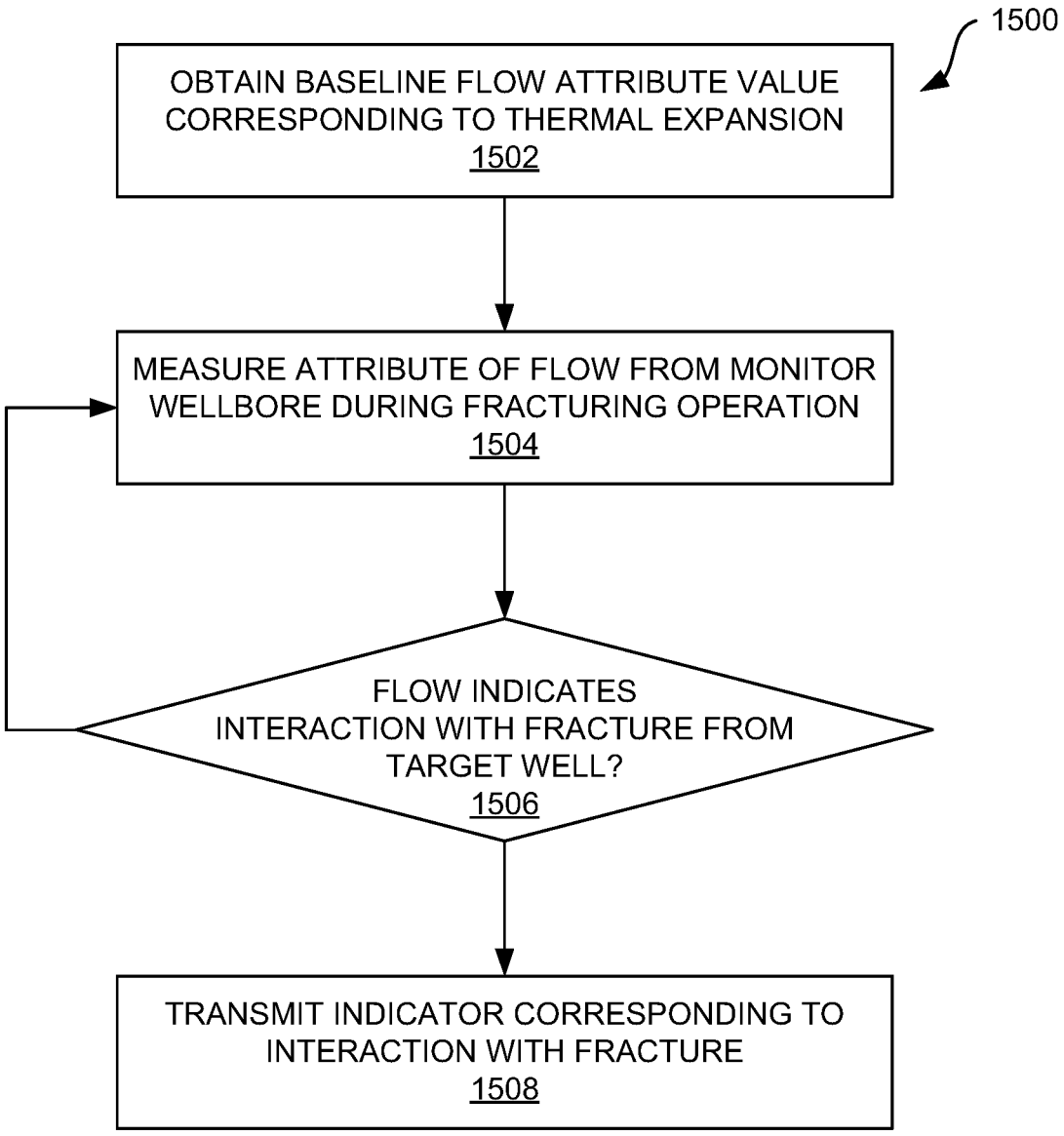
FIG. 15 is a flow chart illustrating a method of monitoring fracturing operations using a fracture monitoring system according to the present disclosure.

FIG. 15 is a flow chart illustrating a method 1500 of monitoring fracturing operations according to the present disclosure. The following discussion regarding method 1500 refers to well environment 1200 and elements thereof; however, any references to specific elements are intended to be illustrative only and implementations of method 1500 are not limited to the specific environment illustrated in FIG. 12.

At operation 1502, controller 1220 obtains a baseline flow attribute value for portions of fluid 1250 exiting monitor well 1202. As discussed in the context of FIGS. 13 and 14, the baseline flow attribute value may correspond to flow exiting monitor well 1202 in response to thermally induced pressure increases of fluid 1250 that cause fluid 1250 within monitor well 1202 to exceed a cracking pressure of pressure control valve 1216. When such pressure increases occur, a portion of fluid 1250 exits monitor well 1202 via fracture monitoring system 1210 and, as a result, is measureable by flow meter 1214. Controller 1220 (or a similar computing device) may then receive such measurements from flow meter 1214 and compute attributes of the flow. In certain implementations, controller 1220 may generate the baseline flow attribute value from a statistical analysis (e.g., an average, a median, etc.) of the multiple measurements.

In other implementations, controller 1220 may access or otherwise obtain values corresponding to fracture-induced flow through fracture monitoring system 1210. For example, controller 1220 may receive ranges, thresholds, or similar values from a well control/monitoring system that may be used to differentiate thermally induced flow from fracture-induced flow from monitor well 1202.

The flow attribute of interest may vary in applications of the present disclosure. For example, in certain implementations, the flow attribute may be a flow rate (e.g., in cubic centimeters per minute), a flow volume (e.g., in cubic centimeters), a change in flow rate, or similar flow attribute for a given portion of fluid 1250 exiting monitor well 1202. In still other implementations, the flow attribute may be based on relationships between flow events. For example, the flow attribute may be a frequency of flow through fracture monitoring system 1210 (e.g., 1 flow event per hour), a period between flow events (e.g., 2 hours between flow events), a change between flow events (e.g., an absolute or relative increase in flow volume between flow events), or any other similar measurement.

Regardless of the attribute, the baselining step of operation 1502 may generally occur before initiating a fracturing operation at a target well or other operations within subsurface formation 1252. By doing so, the baseline flow attribute value (or values) substantially correspond to thermally induced flow and may be used to isolate and differentiate thermally induced flow from other causes of flow, such as interactions with fractures of target wells.

At operation 1504, flow meter 1214 measures flow of fluid 1250 from monitor well 1202 during a fracturing operation at a target well. As noted in the context of FIGS. 12-14, flow meter 1214 obtains such measurement while pressure control valve 1216 controls pressure within monitor well 1202 or is otherwise opened or closed based on pressure in the well. Operation 1504 may further include flow meter 1214 transmitting the obtained measurement to controller 1220, which may then process the measurement to generate a value corresponding to the flow attribute of the baseline measurement obtained in operation 1502.

Notably, flow from monitor well 1202 may be relatively small, regardless of whether it is caused by thermal changes in monitor well 1202 or interactions with fractures from a target well. For example, during testing, flow rates changed by less than 100 cc/min between thermally induced and fracture-induced flow from monitor well 1202. Accordingly, flow meter 1214 may generally be selected to measure relatively low flow rates. Moreover, flow meter 1214 may also be selected to have appropriate sensitivity and accuracy to measure relatively small changes in flow through fracture monitoring system 1210. For example, in certain implementations, flow meter 1214 may be a Coriolis flow meter with capable of accurately measuring flow rates below 10 gallons per hour and, in certain implementations, below 5 gallons per hour. Nevertheless, implementations of the present disclosure are not limited to any specific flow meters and any suitable flow meter may be used in fracture monitoring system 1210. For example, and without limitation, flow meter 1214 may be any of a Coriolis meter, a differential pressure meter, a magnetic meter, a turbine meter, an ultrasonic meter, or a vortex meter.

At operation 1506, controller 1220 evaluates whether the measurement obtained in operation 1504 indicates interaction between monitor well 1202 and a fracture extending from a target well. To do so, controller 1220 generally compares the measurement/value obtained in operation 1504 to the baseline measurement/value obtained in operation 1502 (or similar values, thresholds, etc. obtained by controller 1220). If controller 1220 determines that the measurement/value obtained during operation 1504 indicates thermally induced flow, fracture monitoring system 1210 may continue monitoring flow from monitor well 1202 (e.g., by repeating operation 1504) and evaluating subsequent flow events to see if they also indicate thermally induced flow.

In contrast, if controller 1220 determines that the measurement/value obtained in operation 1504 is different from values for thermally induced flow, is outside of an expected range, or meets other criteria indicating non-thermally induced flow, controller 1220 may transmit a corresponding indicator, as provided in operation 1508. In certain implementations, the indicator may be received by a well control/monitoring system, which may then generate and transmit a corresponding alert/alarm to well personnel, automatically modify fracturing operation parameters (e.g., by selectively activating/deactivating certain pieces of well equipment), or perform other, similar operations.

Implementations of the present disclosure may include fracturing operations involving multiple wells. For example, well completion may include fracturing multiple wells within a given subsurface formation. When fracturing multiple wells in a formation, stages of a first well may be alternatingly fractured with stages of a second well. This process is generally referred to as "zippering" or "zipper fracturing".

At least one advantage of a zipper fracturing is that operators can perform certain operations on wells in parallel. For example, while a stage of the first well is undergoing a first fracturing operation, operators can plug and perforate a stage of the second well in preparation for a second fracturing operation. When the first fracturing operation is completed, the second fracturing operation can begin relatively soon thereafter, and operators can begin preparing a subsequent stage of the first well for fracturing (e.g., by plugging and perforating the first well) while the second well is fractured.

Considering the foregoing, implementations of the present disclosure may further provide improvements to zipper fracturing operations by using wells being fractured as monitor wells. For example, while a stage of a first well is subject to a fracturing operation, an operator may use an unperforated portion of a second well to monitor fracture propagation from the first well using the techniques and systems discussed herein. Subsequently, the operator may plug or otherwise isolate the fractured stage of the first well and use an uphole, unperforated portion of the first well to monitor fractures propagating from the second well during a subsequent fracturing operation performed on a stage of the second well. The fractured portion of the second well may then be plugged and isolated such that the second well may again be used to monitor fracture propagation from the first well. This process may continue until all required stages of both the first and second wells are fractured.

In other implementations, only one well in a zipper fracturing operation may be used as a monitor well. For example, an unperforated first well may be used to monitor fracture propagation from a stage of a second well. Subsequently, a stage of the first well may be fractured. Each of the fractured stages of the first and second wells may then be plugged or otherwise isolated and the process repeated for subsequent stages of the wells. Accordingly, the first well is repeatedly used as a monitor well for the second well during the process of fracturing and completing both wells.

Regardless of the specific order and sequencing of fracturing, the well used as a monitor well may include a fracture monitoring system, as described herein, to monitor fracture propagation from another well or wells. As previously discussed, such systems may be included in or otherwise coupled to a wellhead of the first well or the second well. When a well is used to monitor fractures, the casing, the pressure control valve of the fracture monitoring system, and any downhole plugs, etc. used to isolate previously fractured sections of the well, generally define an uphole monitoring portion of the well for use in monitoring fracture propagation from the other well. As described herein, while pressure within the monitoring portion is below a cracking/set pressure of the pressure control valve, the uphole monitoring portion remains substantially sealed. When pressure increases within the uphole monitoring portion, the pressure control valve opens, unsealing the wellbore and permitting fluid to flow from the wellbore. As described herein, one or more attributes of flow exiting the wellbore may be used to distinguish thermally induced from fracture-induced flow from the wellbore.

Generally, an operator or control system may interpret detection of fracture interaction by fracture monitoring system according to the present disclosure as indicating that a fracturing operation or a phase of a fracturing operation is complete. Stated differently, detection of fracture interaction by a fracture monitoring system provides a rapid and accurate way of determining when fractures have sufficiently propagated through a subsurface formation and when corresponding fracturing operations may be halted or modified. As a result, a fracture monitoring system may help to avoid unnecessary "over fracturing" or overdesigning of a fracturing operation to account for potential variability in the subsurface formation, etc. As a result, a fracture monitoring system may reduce costs, time, and other resources required to performing a fracturing operation.

In the specific context of a zipper fracturing operation, detection of fracture interactions by a fracture monitoring system may be used to signal when an operator may move on to the next phase of the fracturing operation. For example, when a first well is used as a monitor well and a fracturing operation is conducted in a second well, detection of fracture interactions using a fracture monitoring system of the first well may be used to accurately determine when the fracture operation in the second well is complete. Completion of the fracturing operation in the second well may, in turn, signal when preparation of the first well for fracturing and preparation of the second well for monitoring may begin. As a result, the zipper fracturing operation may progress to completion with relatively low risk that a well stage will be inadequately fractured, low down time between fracturing operations, and substantially eliminating the time, costs, etc. associated with over fracturing or overdesigning a fracturing operation.

Figure 16A:
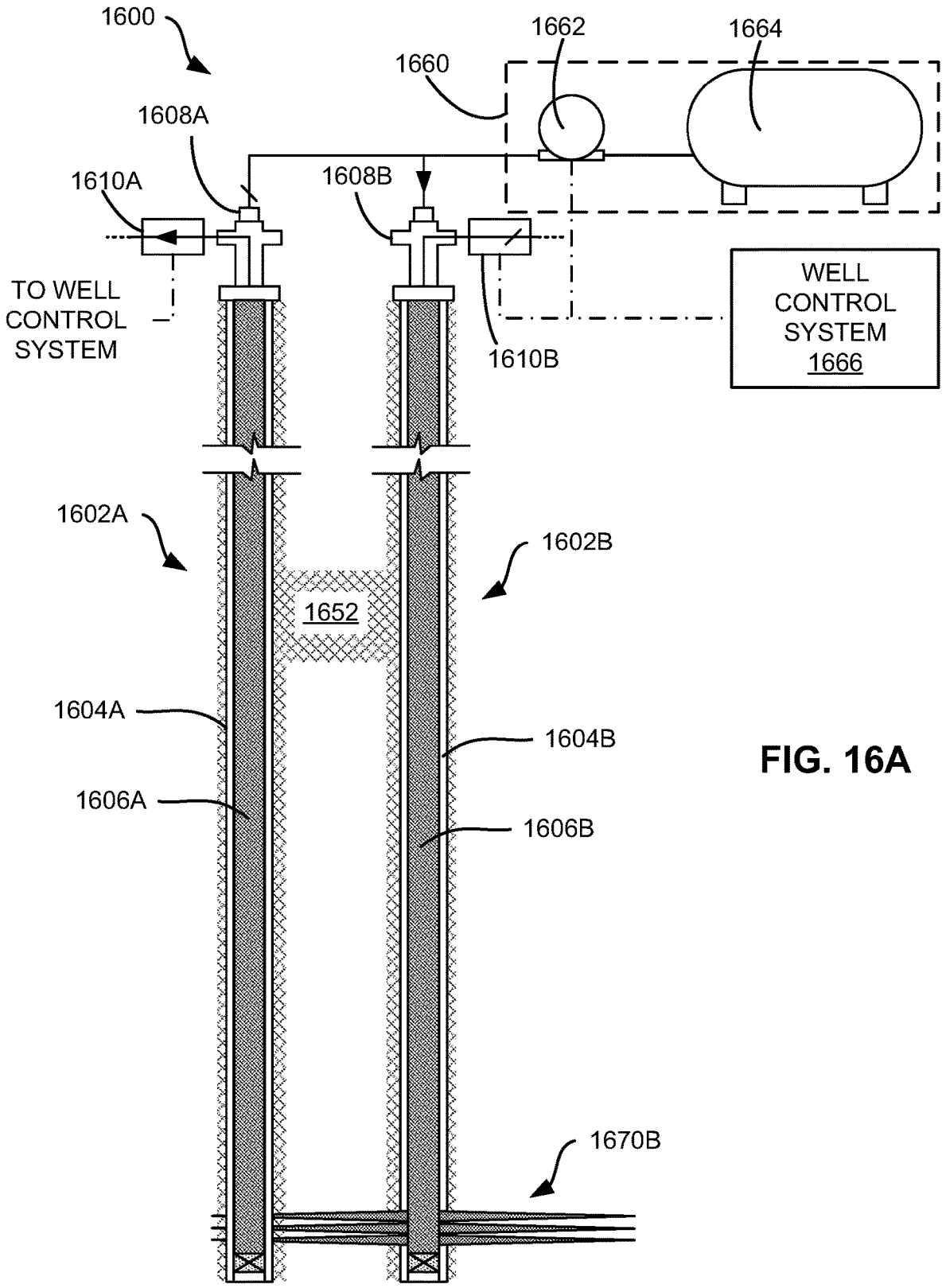
FIGS. 16A-F are schematic illustrations of a well environment during different steps of a zipper fracturing operation using fracture monitoring systems of the present disclosure.

FIGS. 16A-F illustrate the general process of a zipper fracturing operation according to the present disclosure. Referring first to FIG. 16A, a well environment 1600 is provided that includes a first well 1602A and a second well 1602B. First well 1602A includes a casing 1604A extending through a subsurface formation 1652 and defining a wellbore 1606A. First well 1602A is capped with a wellhead 1608A, which includes a fracture monitoring system 1210A. Second well 1602B similarly includes a casing 1604B extending through subsurface formation 1652 and defining a wellbore 1606B. Second well 1602B is also capped with a wellhead 1608B, which includes a fracture monitoring system 1210B.

Each of wellhead 1608A and wellhead 1608B are in communication with a fracturing fluid delivery system 1660, which is illustrated as including a pumping system 1662 and a fracturing fluid source 1664. Implementations of the present disclosure are not limited to any specific arrangement of pumping system 1662; however, in at least certain implementations, pumping system 1662 may be in the form of one or more fracturing fluid pump trucks.

Fracture monitoring system 1210A, fracture monitoring system 1210B, and fracturing fluid source 1664 are also each shown as being communicatively coupled to a well control system 1666.

FIG. 16A illustrates well environment 1600 after fracturing of an initial stage of second well 1602B while using first well 1602A as a monitor well. As illustrated, when fracturing a stage of second well 1602B, pumping system 1662 (or a flow control system between pumping system 1662 and first well 1602A and second well 1602B) may be configured to deliver fracturing fluid to wellbore 1606B.

As further illustrated in FIG. 16A, wellhead 1608A and fracture monitoring system 1610A are configured to direct fluid from wellbore 1606A through fracture monitoring system 1610A. As discussed herein, such fluid may exit wellbore 1606A in at least two scenarios. First, fluid within wellbore 1606A may gradually increase in temperature and pressure because of heat transferred to the fluid from subsurface formation 1652. Such pressure increases may result in a pressure control valve of fracture monitoring system 1610A opening and allowing a volume of fluid to exit wellbore 1606A. Fluid may also be forced out of wellbore 1606A in response to interactions between wellbore 1606A and fractures extending from second well 1602B, such as fractures 1670B.

As discussed in the context of FIGS. 12-15, fracture monitoring system 1610A may be configured to control pressure within wellbore 1606A, to measure fluid exiting wellbore 1606A, and to determine whether such flow is the result of thermal expansion of fluid within wellbore 1606A or interactions with fractures 1670B. To the extent fracture monitoring system 1610A determines changes are the result of interactions with fractures 1670B, fracture monitoring system 1610A may transmit a corresponding indicator for receipt and processing by well control system 1666, which may take appropriate action (e.g., stopping or modifying operation of fracturing fluid delivery system 1660, issuing an alert/alarm, etc.).

Wellhead 1608B similarly includes or is coupled to a fracture monitoring system 1610B. However, during fracturing of wellbore 1606B, fracture monitoring system 1610B may be closed/blocked to prevent fluid flow through fracture monitoring system 1610B. Notably, fracture monitoring system 1610B may be substantially blocked such that the pressure control valve of fracture monitoring system 1210B does not open in response to elevated pressures within wellbore 1606B caused during fracturing of wellbore 1606B.

Figure 16B:
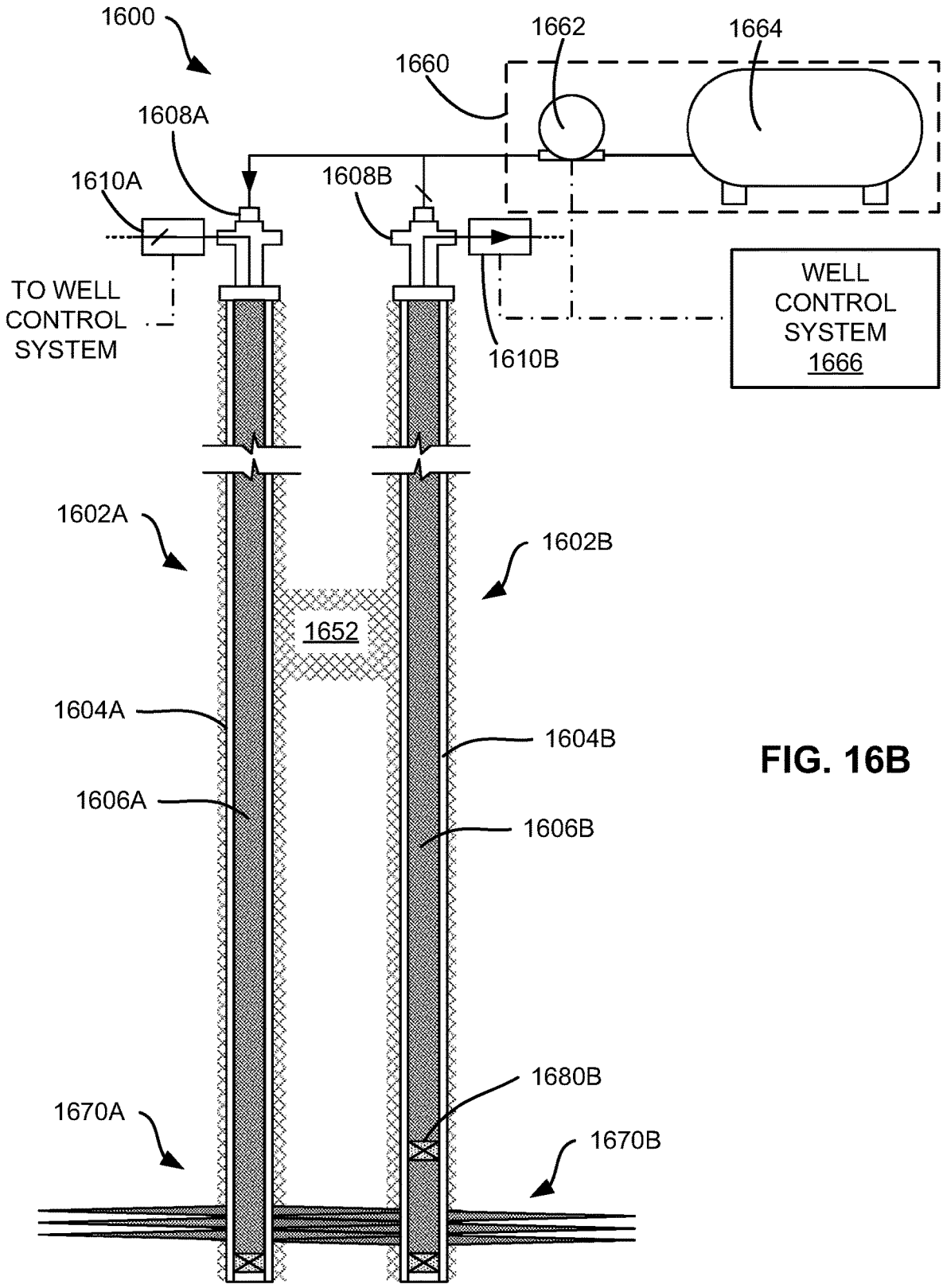

Referring next to FIG. 16B, well environment 1600 is illustrated after fracturing of wellbore 1606A and plugging of wellbore 1606B. More specifically, after wellbore 1606A detects fracture propagation from a first stage of wellbore 1606B, an operator may perform a fracturing operation on a corresponding stage of wellbore 1606A, as illustrated by fractures 1670A. For example, after fracturing wellbore 1606B, the operator may fracture a stage of wellbore 1606A by first perforating the stage and then injecting fluid from fracturing fluid delivery system 1660 to propagate fractures 1670A from the perforations. During fracturing of wellbore 1606A, wellhead 1608A or fracture monitoring system 1610A may be configured to substantially block fluid from passing through fracture monitoring system 1610A such that the pressure control valve of fracture monitoring system 1610A does not impact fracturing of wellbore 1606A.

While wellbore 1606A is fractured, an operator may perform a plugging or similar isolation process in wellbore 1606B, e.g., by installing plug 1680B. Installation of plug 1680B isolates an uphole portion 1690B of wellbore 1606B, thereby permitting uphole portion 1690B to be used to monitor subsequent fracturing operations conducted on wellbore 1606A. To further prepare uphole portion 1690B, wellhead 1608B and fracture monitoring system 1610B may be configured to permit flow through fracture monitoring system 1610B. More specifically, fracture monitoring system 1610B may be configured such that the pressure control valve of fracture monitoring system 1610B selectively permits fluid to flow through fracture monitoring system 1610B when pressure within wellbore 1606B exceeds a cracking pressure of the pressure control valve. The flow meter of fracture monitoring system 1610B may also measure flow exiting wellbore 1606B during this time to establish a baseline measurement for later distinguishing thermally induced flow from wellbore 1606B from that induced by interactions between uphole portion 1690B and fractures extending from wellhead 1608A.

Notably, in the specific example of FIG. 16A-F, formation of fractures 1670A from 1606A occurs without monitoring by wellbore 1606B. However, in alternative implementations, plugging/isolation of 1606B to create uphole portion 1690B may be conducted prior to initiating formation of fractures 1670A such that uphole portion 1690B may be used to monitor propagation of fractures 1670A.

Figure 16C:
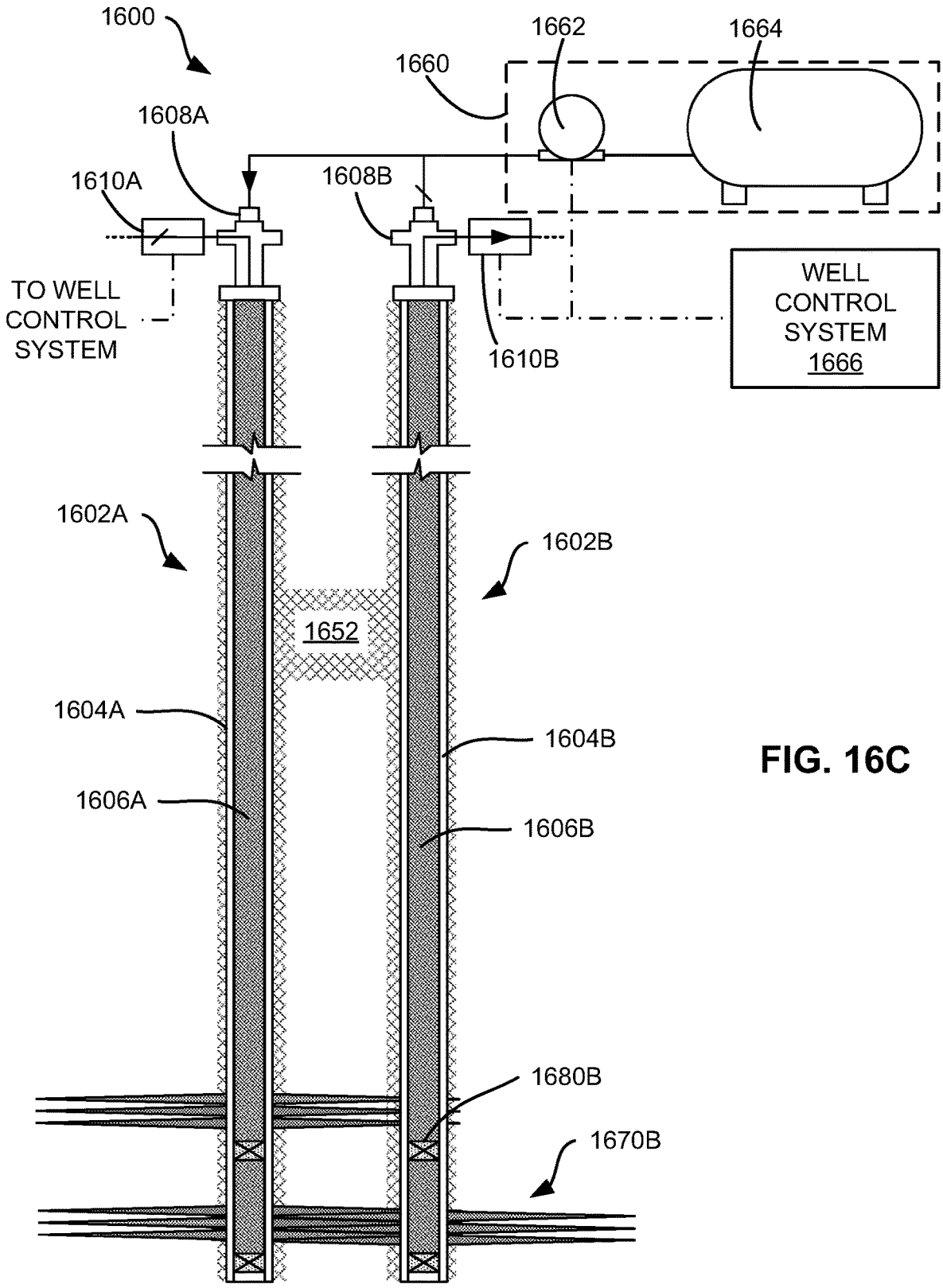

FIG. 16C illustrates a subsequent fracturing operation performed on wellbore 1606A, assuming that uphole portion 1690B has not been used to monitor for other fractures from wellbore 1606A. More specifically, following propagation of fractures 1670A, the corresponding stage of wellbore 1606A may be plugged/isolated, e.g., using a plug 1680A. The resulting uphole section 1690A may then be perforated and fractured, forming fractures 1672A. As noted above, during formation of fractures 1672A, uphole portion 1690B of wellbore 1606B is generally configured to act as a monitor well. Stated differently, fracture monitoring system 1610B is configured to control pressure within uphole portion 1690B and to measure flow through fracture monitoring system 1610B resulting from pressure changes within wellbore 1606B. Fracture monitoring system 1610B is further configured to distinguish between flow resulting from heating of fluid within wellbore 1606B and flow resulting from interactions between fractures 1672A and uphole portion 1690B and to transmit an indicator to well control system 1666 when fracture-induced flow is detected.

Figure 16D:
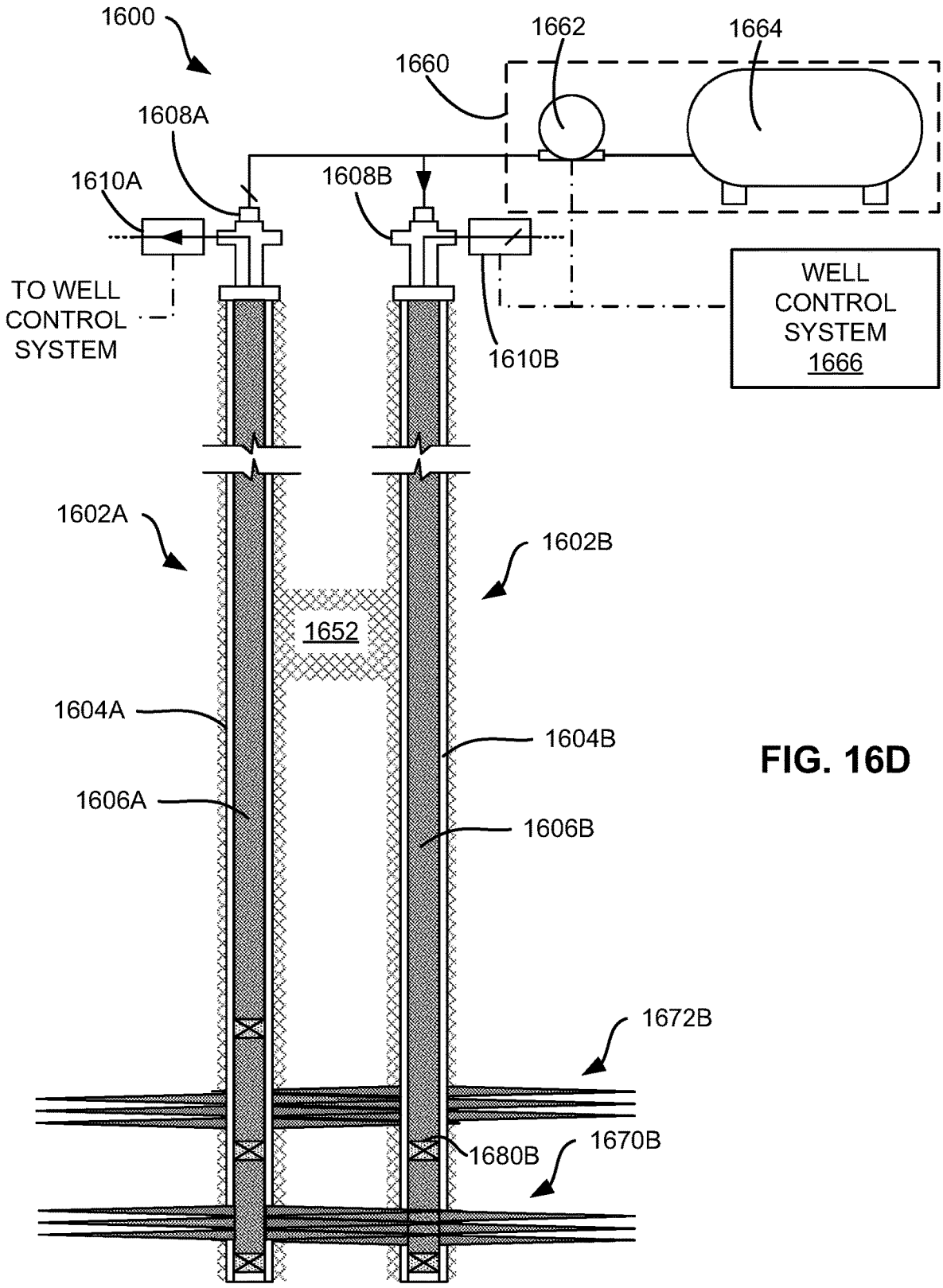
Figure 16E:
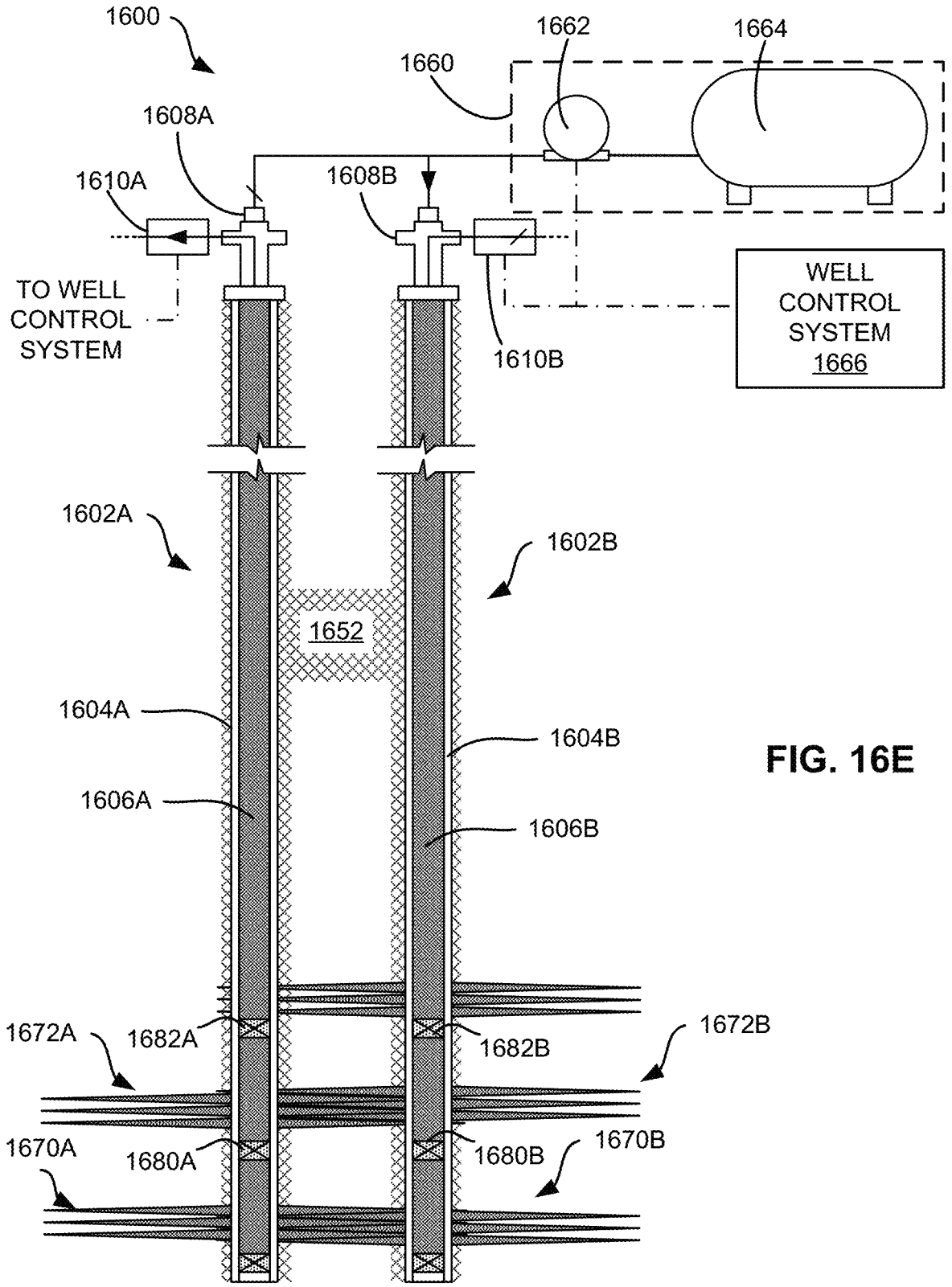
Figure 16F:
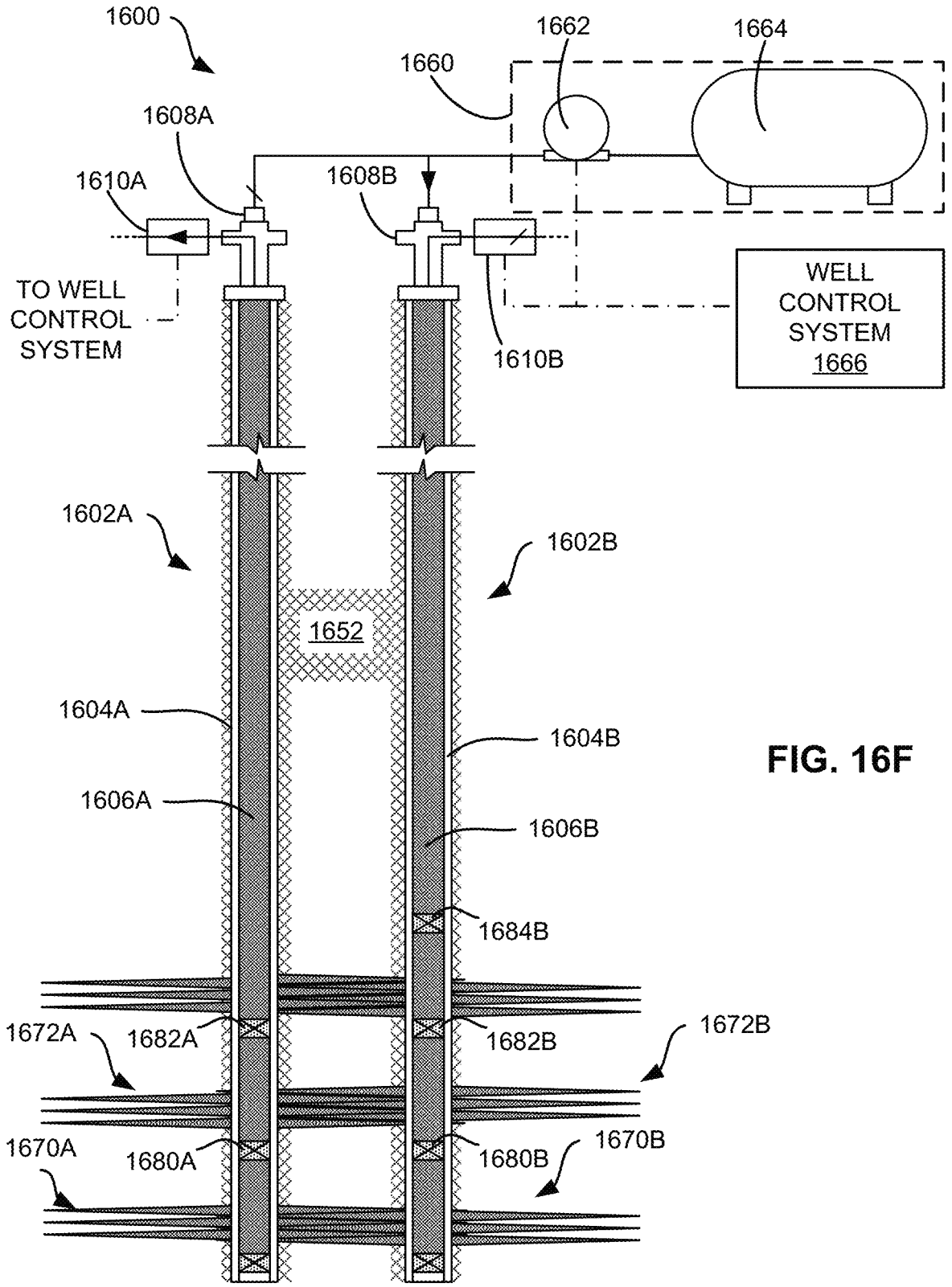

FIGS. 16D-F illustrate subsequent stages of the zipper fracturing operation. More specifically, FIG. 16D illustrates a subsequent fracturing operation conducted on wellbore 1606B. More specifically, following fracturing of wellbore 1606A, as illustrated in FIG. 16C, an operator may perforate and fracture uphole portion 1690B of wellbore 1606B, as indicated by fractures 1672B. During this fracturing operation, a plug 1682A may be installed in wellbore 1606A, thereby isolating the previously fractured stage and creating an uphole section 1692A isolated from each of fractures 1670A and fractures 1672A and that may be used to monitor fracturing operations conducted in wellbore 1606B.

FIG. 16E illustrates a subsequent step in the zipper fracturing operation in which a plug 1682B is installed in wellbore 1606B, defining an uphole section 1692B. As illustrated, uphole section 1692B may then be perforated and fractured, relying on uphole section 1692A to monitor the fracturing operations as discussed herein. Subsequently, and as illustrated in FIG. 16F, a plug 1684B may be installed in second well 1602B and a subsequent fracturing operation may be conducted on uphole section 1692A. The foregoing process may be repeated for as many stages as necessary to complete first well 1602A and second well 1602B.

Although first well 1602A and second well 1602B are illustrated in FIGS. 16A-F as being vertical and substantially parallel, implementations of the present disclosure are not limited to such arrangements. Rather, first well 1602A and second well 1602B may have any suitable orientation provided that fractures from first well first well 1602A are directed toward monitoring portions of second well 1602B and fractures from second well 1602B are directed toward monitoring portions of first well 1602A. Moreover, while FIGS. 16A-F generally illustrate a zipper operation including two wells, the foregoing concepts may be expanded to facilitate fracturing of any suitable number of wells extending through subsurface formation 1652.

Figure 17A:
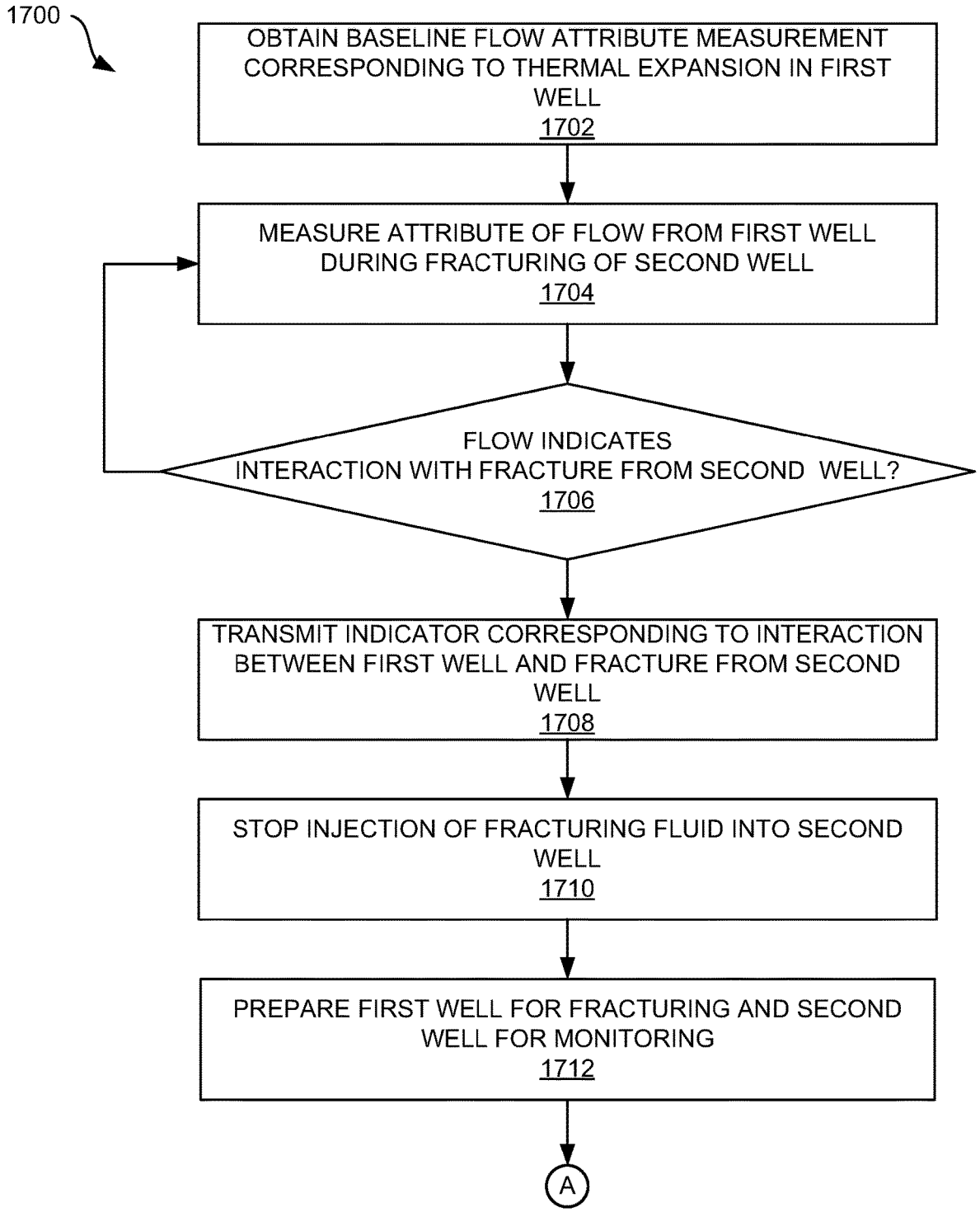
FIGS. 17A and 17B are a flow chart illustrating a method of fracturing multiple wells in a subsurface formation using a zipper fracturing technique and fracture monitoring systems of the present disclosure.
Figure 17B:
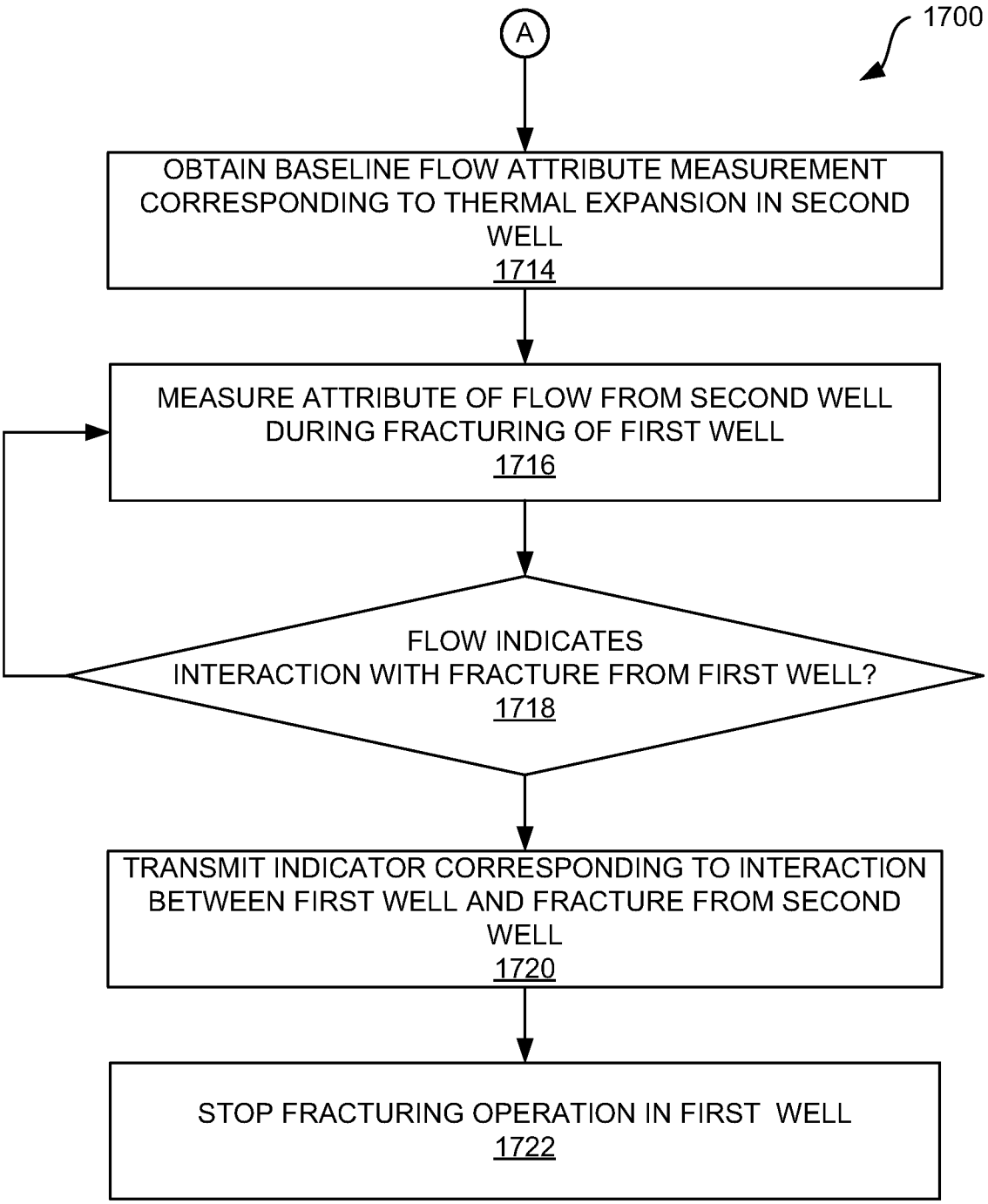

FIGS. 17A and 17B are a flow chart illustrating a method 1700 of fracturing multiple wells in a formation, such as in a zipper fracturing operation. In particular, the method 1700 includes fracturing of two wells within a subsurface formation. During fracturing of one well the other well (or a portion of the other well) is used to monitor fracture propagation from the well undergoing fracturing. Following fracturing, the well is prepared (e.g., plugged/isolated) for use as a monitor well during subsequent fracturing of a stage of the other well that previously acted as the monitor well. This process may be repeated, with each well alternating between having a stage fractured and acting as a monitor well during fracturing of the other well.

Notably, each of the wells in method 1700 includes a fracture monitoring system (like fracture monitoring system 1610A or fracture monitoring system 1610B), for flow-based monitoring/detection of fracture propagation. Among other things, implementation of fracture monitoring systems according to the present disclosure may improve the effectiveness and efficiency of zipper fracturing operations. For example, fracture monitoring systems according to the present disclosure may allow operators to accurately identify fracture propagation during zipper fracturing operations by minimizing false positives that may result from thermally induced pressure changes. As another example, fracture monitoring systems according to the present disclosure may also permit monitoring without waiting for fluid in the well acting as the monitor well to become substantially isothermal with the surrounding formation. As a result, time between fracturing of stages can be significantly reduced, improving the overall speed of the zipper fracturing operation and reducing necessary costs and resources.

Although not limited to the implementation illustrated in FIGS. 16A-F, method 1700 is generally described below with reference to certain elements of well environment 1600 for clarity. Method 1700 assumes that each of first well 1602A and second well 1602B extend through subsurface formation 1652, that first well 1602A includes wellhead 1608A in communication with fracture monitoring system 1610A, and that second well 1602B includes wellhead 1608B in communication with fracture monitoring system 1610B. Method 1700 also assumes that an initial fracturing operation is to be performed on a first stage of second well 1602B with first well 1602A acting as a monitor well and with the first stage of second well 1602B already perforated.

At operation 1702, fracture monitoring system 1610A obtains a baseline flow attribute value. The baseline flow attribute value is generally obtained prior to initiating a fracturing in second well 1602B and, as a result, generally corresponds to a measurement of the flow attribute resulting from thermal expansion within first well 1602A. As previously noted in the context of method 1500, fracture monitoring system 1610A may alternatively receive a range, value, threshold, etc. for use in distinguishing thermal from fracture-induced flow from wellbore 1606A.

At operation 1704 and during fracturing of the first stage of second well 1602B, fracture monitoring system 1610A obtains values/measurements of the flow attribute for flow from first well 1602A (e.g., using a flow meter of fracture monitoring system 1610A). At operation 1706, a controller of fracture monitoring system 1610A or similar computing device determines whether the measurements obtained in operation 1704 are indicative of interaction between fractures extending form the first stage of second well 1602B and first well 1602A. For example, the controller may compare the values/measurements obtained in operation 1704 with the baseline measurements (or other values, thresholds, ranges, etc.) obtained in operation 1702. Until the controller determines that the values/measurements obtained in operation 1704 are substantially like the baseline values obtained in operation 1702 (e.g., indicating strong likelihood of thermally induced flow), operation 1704 and operation 1706 may be repeated for additional values/measurements of the attribute.

On the other hand, when the controller determines that a substantial change in the flow attribute has occurred, the controller may transmit an indicator (operation 1708). In certain implementations, when the indicator is received by a well monitor/control system, the well monitoring/control system may generate an alert, alarm, or similar message notifying personnel/operators that the fracture from the first stage of second well 1602B has interacted with first well 1602A. In addition, or alternatively, the well monitoring/control system may initiate one or more processes, including, but not limited to stopping injection of fracturing fluid into second well 1602B (operation 1710).

At operation 1712, each of first well 1602A and second well 1602B are prepared for fracturing a first stage of first well 1602A. For example, an operator may perforate a location of first well 1602A corresponding to the first stage of first well 1602A. The operator may also install a plug or otherwise isolate the first stage of second well 1602B such that an uphole portion of second well 1602B becomes suitable for monitoring fracture propagation from the first stage of first well 1602A. Preparation of first well 1602A and second well 1602B may also include reconfiguring fluid distribution systems, wellhead 1608A, fracture monitoring system 1610A, wellhead 1608B, fracture monitoring system 1610B, and the like to permit injection of fracturing fluid from fracturing fluid delivery system 1660 into first well 1602A and to reconfigure second well 1602B to act as a monitoring well.

At operation 1714, fracture monitoring system 1610B obtains a baseline flow attribute measurement. The baseline flow attribute measurement is generally obtained prior to initiating injection of fracturing fluid to fracture the first stage first well 1602A and, as a result, generally corresponds to a measurement of the flow attribute resulting from thermal expansion within second well 1602B.

At operation 1716 and during injection of fracturing fluid to fracture the first stage of first well 1602A, fracture monitoring system 1610B obtains values/measurements of the flow attribute for flow from second well 1602B (e.g., using a flow meter of fracture monitoring system 1610B).

At operation 1718, a controller of fracture monitoring system 1610B or similar computing device determines whether the measurements obtained in operation 1718 are indicative of interaction between fractures extending form the first stage of first well 1602A and second well 1602B. Until the controller determines that the values/measurements obtained in operation 1706 are substantially like the baseline values obtained in operation 251 (e.g., indicating strong likelihood of thermally induced flow), operation 1718 and operation 1720 may be repeated for additional values/measurements of the attribute.

On the other hand, when the controller determines that a substantial change in the flow attributed has occurred, the controller may transmit an indicator (operation 1720) like that transmitted in operation 1710 and which may be received by a well monitoring/control system. Subsequently, an operator of the well monitoring/control system may stop injection of fracturing fluid into first well 1602A (operation 1722).

Following operation 1722, each of first well 1602A and second well 1602B may be prepared for fracturing a second stage of second well 1602B. For example, an operator may perforate a location of second well 1602B corresponding to the first stage of second well 1602B. The operator may also install a plug or otherwise isolate the first stage of first well 1602A such that an uphole portion of first well 1602A becomes suitable for monitoring fracture propagation from the second stage of second well 1602B. As discussed herein, preparation of first well 1602A and second well 1602B may also include additional steps to reconfigure various components illustrated in well environment 1600 for injection of fracturing fluid into second well 1602B and to reconfigure first well 1602A for use as a monitoring well during fracturing of the second stage of second well 1602B.

The general process illustrated in FIGS. 17A and 17B may continue to be repeated, alternating between fracturing a stage of first well 1602A while second well 1602B is used to monitor fracture propagation and fracturing a stage of second well 1602B while first well 1602A is used to monitor fracture propagation, with appropriate preparation of first well 1602A and second well 1602B (e.g., installation of plugs, reconfiguration of flow systems, reconfiguration of fracture monitoring systems, etc.) occurring between each fracturing operation.

Figure 18:
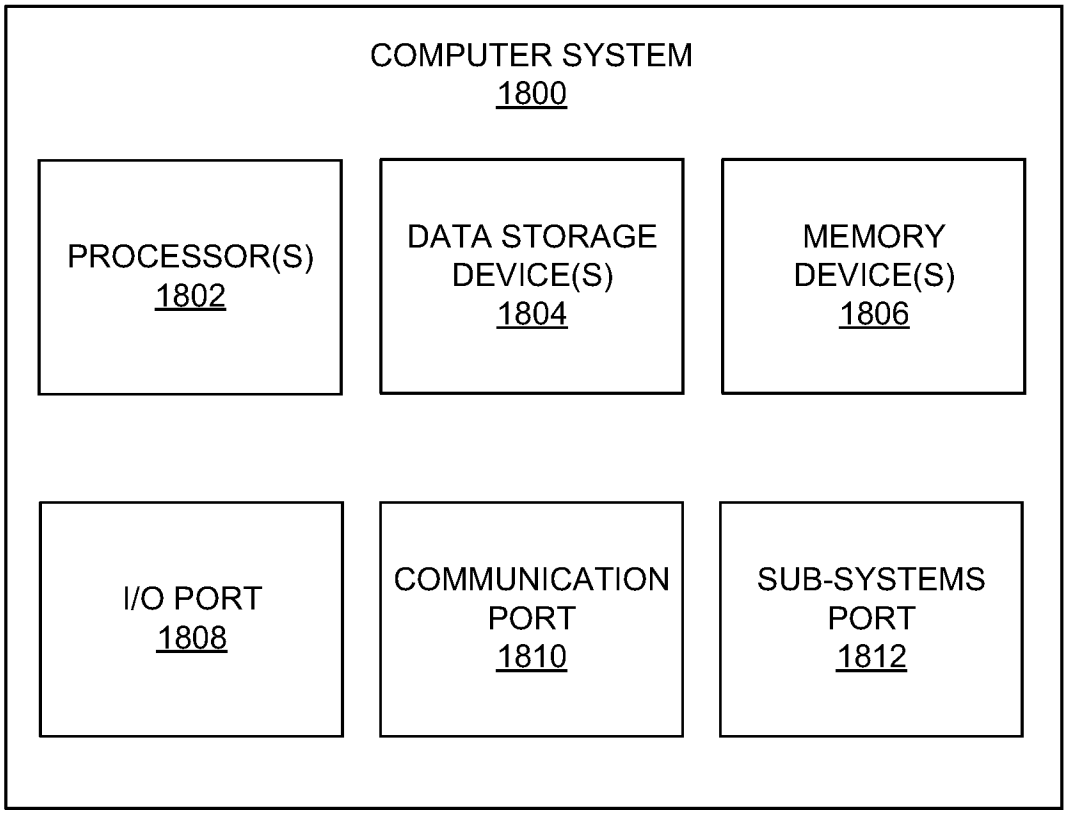
FIG. 18 is an example computing system that may implement various systems and methods of the presently disclosed technology.
Figure 12:
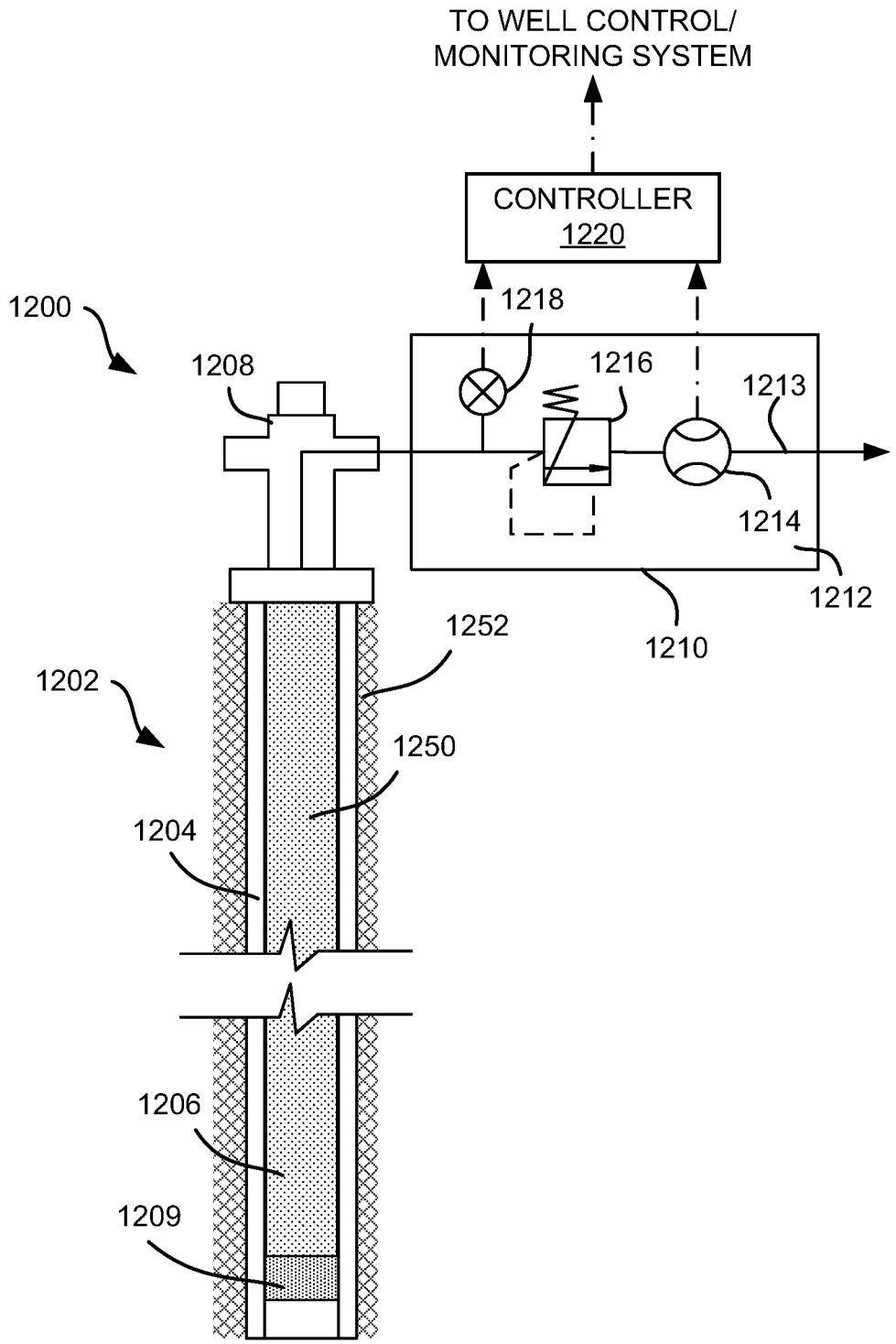

Referring to FIG. 18, a detailed description of an example computing system 1800 having one or more computing units that may implement various systems and methods discussed herein is provided. It will be appreciated that specific implementations of these devices may be of differing possible specific computing architectures not all of which are specifically discussed herein but will be understood by those of ordinary skill in the art.

The computing system 1800 is generally configured to receive and process pressure measurement data from a pressure transducer or similar sensor associated with the monitor well, such as the monitor well 122 shown in FIG. 1 (or any other monitor well discussed herein). Processing of pressure measurement data from the monitor well 122 may include, without limitation, performing one or more calculations on the pressure measurement data, transmitting the pressure measurement data, storing the pressure measurement data, formatting the pressure measurement data, displaying the pressure measurement data or data derived therefrom, and generating or suggesting control signals in response to the pressure measurement data. In one implementation, for example, the computing system 1800 is communicatively coupled to the pumping system 132 and is configured to generate and send control signals to the pumping system 132 to adjust the properties of the fracturing fluid provided by the pumping system 132.

The computing system 1800 may be a computing system capable of executing a computer program product to execute a computer process. Data and program files may be input to the computing system 1800, which reads the files and executes the programs therein. Some of the elements of the computing system 1800 are shown in FIG. 18, including one or more hardware processors 1802, one or more data storage devices 1804, one or more memory devices 1806, and/or one or more ports 1808-1812. Additionally, other elements that will be recognized by those skilled in the art may be included in the computing system 1800 but are not explicitly depicted in FIG. 18 or discussed further herein. Various elements of the computing system 1800 may communicate with one another by way of one or more communication buses, point-to-point communication paths, or other communication means not explicitly depicted in FIG. 18.

The processor 1802 may include, for example, one or more of a central processing unit (CPU), a graphics processing unit (GPU), an application specific integrated circuit (ASIC), a tensor processing unit (TPU), an a artificial intelligence (AI) processor, a microprocessor, a microcontroller, a digital signal processor (DSP), and/or one or more internal levels of cache. There may be one or more processors 1802, such that the processor 1802 comprises a single central-processing unit, or a plurality of processing units capable of executing instructions and performing operations in parallel with each other, commonly referred to as a parallel processing environment.

The computing system 1800 may be a conventional computer, a distributed computer, or any other type of computer, such as one or more external computers made available via a cloud computing architecture. The presently described technology is optionally implemented in software stored on the data stored device(s) 1804, stored on the memory device(s) 1806, and/or communicated via one or more of the ports 1808-1812, thereby transforming the computing system 1800 in FIG. 18 to a special purpose machine for implementing the operations described herein. Examples of the computing system 1800 include personal computers, terminals, workstations, clusters, nodes, mobile phones, tablets, laptops, personal computers, multimedia consoles, gaming consoles, set top boxes, and the like.

The one or more data storage devices 1804 may include any non-volatile data storage device capable of storing data generated or employed within the computing system 1800, such as computer executable instructions for performing a computer process, which may include instructions of both application programs and an operating system (OS) that manages the various components of the computing system 1800. The data storage devices 1804 may include, without limitation, magnetic disk drives, optical disk drives, solid state drives (SSDs), flash drives, and the like. The data storage devices 1804 may include removable data storage media, non-removable data storage media, and/or external storage devices made available via a wired or wireless network architecture with such computer program products, including one or more database management products, web server products, application server products, and/or other additional software components. Examples of removable data storage media include Compact Disc Read-Only Memory (CD-ROM), Digital Versatile Disc Read-Only Memory (DVD-ROM), magneto-optical disks, flash drives, and the like. Examples of non-removable data storage media include internal magnetic hard disks, SSDs, and the like. The one or more memory devices 1806 may include volatile memory (e.g., dynamic random access memory (DRAM), static random access memory (SRAM), etc.) and/or non-volatile memory (e.g., read-only memory (ROM), flash memory, etc.).

Computer program products containing mechanisms to effectuate the systems and methods in accordance with the presently described technology may reside in the data storage devices 1804 and/or the memory devices 1806, which may be referred to as machine-readable media. It will be appreciated that machine-readable media may include any tangible non-transitory medium that is capable of storing or encoding instructions to perform any one or more of the operations of the present disclosure for execution by a machine or that is capable of storing or encoding data structures and/or modules utilized by or associated with such instructions. Machine-readable media may include a single medium or multiple media (e.g., a centralized or distributed database, and/or associated caches and servers) that store the one or more executable instructions or data structures.

In some implementations, the computing system 1800 includes one or more ports, such as an input/output (I/O) port 1808, a communication port 1810, and a sub-systems port 1812, for communicating with other computing, network, or vehicle devices. It will be appreciated that the ports 1808-1812 may be combined or separate and that more or fewer ports may be included in the computing system 1800.

The I/O port 1808 may be connected to an I/O device, or other device, by which information is input to or output from the computing system 1800. Such I/O devices may include, without limitation, one or more input devices, output devices, and/or environment transducer devices.

In one implementation, the input devices convert a human-generated signal, such as, human voice, physical movement, physical touch or pressure, and/or the like, into electrical signals as input data into the computing system 1800 via the I/O port 1808. Similarly, the output devices may convert electrical signals received from the computing system 1800 via the I/O port 1808 into signals that may be sensed as output by a human, such as sound, light, and/or touch. The input device may be an alphanumeric input device, including alphanumeric and other keys for communicating information and/or command selections to the processor 1802 via the I/O port 1808. The input device may be another type of user input device including, but not limited to: direction and selection control devices, such as a mouse, a trackball, cursor direction keys, a joystick, and/or a wheel; one or more sensors, such as a camera, a microphone, a positional sensor, an orientation sensor, a gravitational sensor, an inertial sensor, and/or an accelerometer; and/or a touch-sensitive display screen ("touchscreen"). The output devices may include, without limitation, a display, a touchscreen, a speaker, a tactile and/or haptic output device, and/or the like. In some implementations, the input device and the output device may be the same device, for example, in the case of a touchscreen.

The environment transducer devices convert one form of energy or signal into another for input into or output from the computing system 1800 via the I/O port 1808. For example, an electrical signal generated within the computing system 1800 may be converted to another type of signal, and/or vice-versa. In one implementation, the environment transducer devices sense characteristics or aspects of an environment local to or remote from the computing system 1800, such as, light, sound, temperature, pressure, magnetic field, electric field, chemical properties, physical movement, orientation, acceleration, gravity, and/or the like. Further, the environment transducer devices may generate signals to impose some effect on the environment either local to or remote from the computing system 1800, such as, physical movement of some object (e.g., a mechanical actuator), heating or cooling of a substance, adding a chemical substance, and/or the like.

In one implementation, a communication port 1810 is connected to a network by way of which the computing system 1800 may receive network data useful in executing the methods and systems set out herein as well as transmitting information and network configuration changes determined thereby. Stated differently, the communication port 1810 connects the computing system 1800 to one or more communication interface devices configured to transmit and/or receive information between the computing system 1800 and other devices by way of one or more wired or wireless communication networks or connections. Examples of such networks or connections include, without limitation, Universal Serial Bus (USB), Ethernet, Wi-Fi, Bluetooth®, Near Field Communication (NFC), Long-Term Evolution (LTE), and so on. One or more such communication interface devices may be utilized via the communication port 1810 to communicate with one or more other machines, either directly over a point-to-point communication path, over a wide area network (WAN) (e.g., the Internet), over a local area network (LAN), over a cellular (e.g., third generation (3G) or fourth generation (4G)) network, or over another communication means including any existing or future protocols including, without limitation fifth generation (5G), mesh networks and distributed networks. Further, the communication port 1810 may communicate with an antenna for electromagnetic signal transmission and/or reception.

In certain implementations, the communication port 1810 is configured to communicate with one or more process control networks and/or process control devices including one or more of standalone, distributed, or remote/server-based control systems. In such implementations, the communication port 1810 is coupled to the process control networks and/or devices by a network, bus, hard-wire, or any other suitable connection. Such process control systems may include, without limitation, supervisory control and data acquisition (SCADA) systems and distributed control systems (DCSs) and may include one or more of programmable logic controllers (PLCs), programmable automation controllers (PACs), input/output (I/O) devices, human-machine interfaces (HMIs) and HMI workstations, servers, process historians, and other process control-related devices. Accordingly, the communication port 1810 facilitates communication between the computing system 1800 and process control equipment using one or more process-control related protocols including, without limitation, fieldbus, Ethernet fieldbus, Ethernet TCP/IP, Controller Area Network, ControlNet, DeviceNet, Highway Addressable Remote Transducer (HART) protocol, and OLE for Process Control (OPC), Wellsite Information Transfer Standard Markup Language (WITSML), and Universal File and Stream Loading (UFL).

Computing system 1800 may include a sub-systems port 1812 for communicating with one or more external systems to control an operation of the external system and/or exchange information between the computing system 1800 and one or more sub-systems of the external system. In certain implementations, the sub-systems port 1812 is configured to communicate with sub-systems of a pump truck or similar vehicle configured to provide pressurized fracturing fluid to a well including, without limitation, sub-systems directed to controlling and monitoring pumps and associated pumping equipment.

The system set forth in FIG. 18 is but one possible example of a computing system that may employ or be configured in accordance with aspects of the present disclosure. It will be appreciated that other non-transitory tangible computer-readable storage media storing computer-executable instructions for implementing the presently disclosed technology on a computing system may be utilized.

In the present disclosure, the methods disclosed may be implemented, at least in part, as sets of instructions or software readable by a device. Further, it is understood that the specific order or hierarchy of steps in the methods disclosed are instances of example approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may be provided as a computer program product, or software, that may include a non-transitory machine-readable medium having stored thereon instructions, which may be used to program a computing system (or other electronic devices) to perform a process according to the present disclosure. A machine-readable medium includes any mechanism for storing information in a form (e.g., software, processing application) readable by a machine (e.g., a computer). The machine-readable medium may include, but is not limited to, magnetic storage medium, optical storage medium; magneto-optical storage medium, read only memory (ROM); random access memory (RAM); erasable programmable memory (e.g., EPROM and EEPROM); flash memory; or other types of medium suitable for storing electronic instructions.

While the present disclosure has been described with reference to various implementations, it will be understood that these implementations are illustrative and that the scope of the present disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow further below.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended thereto.

What is claimed is:

1. A method of monitoring fracturing operations comprising:

obtaining a measurement of a flow attribute for fluid exiting a monitor wellbore of a monitor well, wherein the monitor well is in a subsurface formation, and wherein the measurement of the flow attribute is measured during a fracturing operation conducted on a target well in the subsurface formation;

transmitting an indicator in response to the flow attribute indicating an interaction of a fracture extending from the target well with the monitor well; and regulating pressure within the monitor well during the fracturing operation using a pressure control valve, wherein the pressure control valve is disposed along a flow path extending from the monitor wellbore, and wherein obtaining the measurement of the flow attribute includes obtaining a flow meter measurement from a flow meter disposed downstream of the pressure control valve, wherein, while pressure within the monitor well is below a predetermined pressure, the monitor well is sealed.

2. The method of claim 1, wherein, when received by a control system, the indicator causes the control system to modify the fracturing operation.

3. The method of claim 1, wherein the target well is a first target well, wherein the fracturing operation is a first fracturing operation, and wherein when received by a well control system, the indicator causes the well control system to modify the first fracturing operation and to modify a second fracturing operation at a second target well different than the first target well.

4. The method of claim 1, further comprising removing gas from the monitor wellbore before measuring the flow attribute.

5. The method of claim 1, further comprising obtaining a value of the flow attribute associated with thermally induced flow from the monitor well, wherein transmitting the indicator is in response to a difference between the measurement of the flow attribute and the value of the flow attribute associated with thermally induced flow.

6. The method of claim 1, further comprising:

obtaining a baseline value for the flow attribute, wherein the baseline value is measured before initiation of a fracturing operation to propagate the fracture such that the baseline value corresponds to thermally induced flow from the monitor well; and computing a difference between the baseline value for the flow attribute and the measurement of the flow attribute, wherein the measurement of the flow attribute is measured after initiation of the fracturing operation, wherein transmitting the indicator in response to a difference between the baseline value and the measurement of the flow attribute.

7. An apparatus comprising:

a body defining a flow path, wherein, when the body is coupled to a wellhead of a well extending through a subsurface formation, the flow path is in communication with a wellbore of the well;

a flow meter in communication with the flow path, wherein the flow meter is configured to measure a flow attribute of fluid from the wellbore along the flow path;

a computing device communicatively coupled to the flow meter, wherein the computing device is operable to receive a flow attribute measurement from the flow meter and to transmit an indicator in response to determining that the flow attribute measurement indicates interaction of a fracture in the subsurface formation with the well;

a pressure control valve upstream of the flow meter, wherein the pressure control valve is operable to open when pressure within the wellbore is above a pressure setting of the pressure control valve, thereby permitting flow of fluid from the well, and to seal the wellbore when pressure within the wellbore is below the pressure setting; and a pressure transducer upstream of the pressure control valve to measure pressure within the wellbore.

8. The apparatus of claim 7, wherein the computing device is operable to:

obtain a value for the flow attribute associated with thermally induced flow from the well, and transmit the indicator in response to a difference between the flow attribute measurement and the value for the flow attribute associated with thermally induced flow.

9. The apparatus of claim 7, wherein the computing device is operable to:

obtain a baseline value for the flow attribute from the flow meter, wherein the baseline value is measured by the flow meter before initiation of a fracturing operation to propagate the fracture such that the baseline value corresponds to thermally induced flow from the well, compute a difference between the baseline value for the flow attribute and the flow attribute measurement, wherein the flow attribute measurement is received by the computing device after initiation of the fracturing operation, and transmit the indicator in response to a difference between the baseline value and the flow attribute measurement.

10. The apparatus of claim 7, wherein, when received by a well control system, the indicator causes the well control system to generate a control system indicator associated with modifying a fracturing operation.

11. The apparatus of claim 7, wherein, when received by a well control system, the indicator causes the well control system to transmit a first control system indicator associated with stopping a first fracturing operation in a first well and to transmit a second control system indicator associated with initiating a second fracturing operation in a second well.

12. The apparatus of claim 7, wherein the flow attribute is a flow rate or a rate of change of a flow rate.

13. A method of fracturing multiple wells comprising:

obtaining a first flow attribute measurement for a first flow attribute, wherein the first flow attribute measurement corresponds to fluid exiting a first well, wherein the first well is in a subsurface formation, and wherein the first flow attribute is measured during a first fracturing operation conducted on a second well in the subsurface formation;

modifying the first fracturing operation in response to the first flow attribute measurement indicating interaction of a first fracture extending from the second well with the first well;

modifying a second fracturing operation conducted on the first well in response to the first flow attribute measurement indicating interaction of the first fracture extending from the second well with the first well;

obtaining a second flow attribute measurement for a second flow attribute during the second fracturing operation, wherein the second flow attribute measurement corresponds to fluid exiting the second well; and modifying the second fracturing operation in response to the second flow attribute measurement indicating interaction of a second fracture extending from the first well with an unfractured portion of the second well.

14. The method of claim 13, wherein modifying the second fracturing operation includes initiating the second fracturing operation, the method further comprising:

perforating an unfractured portion of the first well before initiating the second fracturing operation; and sealing an unfractured portion of the second well before initiating the second fracturing operation.

15. The method of claim 13, further comprising regulating pressure within the first well using a pressure control valve, wherein obtaining the first flow attribute measurement includes measuring the first flow attribute of fluid passing through the pressure control valve.

* * * * *